US006492970B1

(12) United States Patent
Furuhashi et al.

(10) Patent No.: US 6,492,970 B1
(45) Date of Patent: Dec. 10, 2002

(54) LIQUID CRYSTAL DISPLAY AND DRIVING METHOD THEREFOR

(75) Inventors: Tsutomu Furuhashi, Yokohama; Kikuo Ono; Yoshiaki Nakayoshi, both of Mobara; Yoshihisa Ooishi, Yokohama; Norio Mamba, Fujisawa, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/437,315

(22) Filed: Nov. 10, 1999

(30) Foreign Application Priority Data

Nov. 13, 1998 (JP) ..... 10-323267
Feb. 26, 1999 (JP) ..... 11-050974

(51) Int. Cl.[7] ..... G09G 3/36
(52) U.S. Cl. ..... 345/94; 345/96
(58) Field of Search ..... 345/87–100, 58, 345/55

(56) References Cited

U.S. PATENT DOCUMENTS 5,841,410 A * 11/1998 Oda et al. ..... 345/58
5,926,157 A * 7/1999 Moon ..... 345/89

FOREIGN PATENT DOCUMENTS

JP 06194622 A * 7/1994 ..... G02F/1/133
JP 08248394 A * 9/1996 ..... G02F/1/133
JP 8-278485 10/1996

* cited by examiner

*Primary Examiner*—Richard Hjerpe
*Assistant Examiner*—Alexander Eisen
(74) *Attorney, Agent, or Firm*—Antonelli, Terry, Stout & Kraus, LLP

(57) ABSTRACT

A liquid crystal display apparatus includes a circuit for generating an alternating signal and a correction time-period signal, the alternating signal indicating alternating of an opposed electrode voltage applied to an opposed electrode, the correction time-period signal indicating a time period during which a correcting voltage is applied to the opposed electrode voltage applied to the opposed electrode, and an opposed electrode voltage generating circuit that, in accordance with the alternating signal and the correction time-period signal and with respect to the alternated opposed electrode voltage applied to the opposed electrode, adds an upwardly convex correcting voltage to the alternated opposed electrode voltage when the alternated opposed electrode voltage is a positive polarity voltage, and subtracts the upwardly convex correcting voltage from the alternated opposed electrode voltage when the alternated opposed electrode voltage is a negative polarity voltage.

19 Claims, 31 Drawing Sheets

LIQUID CRYSTAL DISPLAY AND DRIVING METHOD THEREFOR

BACKGROUND OF THE INVENTION

The present invention relates to a liquid crystal display. More particularly, it relates to a TFT liquid crystal display that allows display of high picture quality to be embodied with the use of a low voltage driving circuit. Also, it relates to the driving circuit therefor.

Referring to FIG. 2 and FIGS. 3A, 3B, the explanation will be given below concerning a conventional TFT liquid crystal display.

FIG. 2 is a block diagram for illustrating the conventional TFT liquid crystal display. Also, FIGS. 3A, 3B illustrate driving waveform diagrams for the conventional liquid crystal display.

In FIG. 2, a reference numeral 201 denotes an interface signal including display data and a synchronization signal that are transferred from a system (not illustrated). A numeral 202 denotes an interface circuit for generating display data and control signals that drive the conventional liquid crystal display. A numeral 203 denotes a signal driving circuit for generating a tone voltage corresponding to the display data. A numeral 204 denotes a scan driving circuit for selecting scanning lines in sequence. A numeral 205 denotes a power supply circuit for generating a power supply necessary for the operation of each block. Also, a numeral 206 denotes a liquid crystal panel on which there is executed a display corresponding to the display data inputted.

Of the signals that the interface circuit 202 generates, a numeral 207 denotes a control signal that controls the signal driving circuit 203 and includes the display data and the synchronization signal. A numeral 208 denotes a control signal that controls the scan driving circuit 204 and transfers a timing signal for scanning the scanning lines in sequence. A numeral 209 denotes a liquid crystal-applying voltage alternating signal "M" that is transferred to the power supply circuit 205.

Of the signals that the power supply circuit 205 generates, a numeral 210 denotes a tone voltage signal transferred to the signal driving circuit 203. The tone voltage signal 210 transfers a voltage that functions as a reference voltage of the tone voltage corresponding to the display data transferred to the liquid crystal panel 206. A numeral 211 denotes a scanning voltage signal transferred to the scan driving circuit 204. A numeral 212 denotes an opposed electrode voltage feeding line that transfers an opposed electrode voltage "Vcom" to an opposed electrode of a liquid crystal 217 and an opposed electrode of a compensation capacitor 218. Here, the liquid crystals 217 and the compensation capacitors 218 constitute the liquid crystal panel 206. Moreover, a numeral 213 denotes a group of signal lines for transferring the tone voltage corresponding to the display data generated in the signal driving circuit 203. A numeral 214 denotes a group of scanning lines for transferring a scanning voltage that switches, into a selection or a non-selection state, each of the scanning lines generated in the scan driving circuit 204. A numeral 215 denotes pixels constituting the liquid crystal panel 206. The pixels 215 are formed at the intersection points of the group of signal lines 213 and the group of scanning lines 214, and thus the liquid crystal panel 206, eventually, has a matrix structure. Also, the numbers of the pixels 215 in the horizontal and the vertical directions are equivalent to the horizontal and the vertical resolutions. Incidentally, in general, in the case of a color liquid crystal display, the three primary colors, i.e., red, green and blue colors, constitute one pixel thereof. Accordingly, when the respective color pixels are arranged in the horizontal direction, the number of the pixels in the horizontal direction becomes equal to 3 times as large as the horizontal resolution. Also, the configuration employed commonly is that the pixels 215 arranged in the horizontal direction share one scanning line of the group of scanning lines 214 and the pixels 215 arranged in the vertical direction share one signal line of the group of signal lines 213. Furthermore, reference numerals within each of the pixels 215 denote the following components: 216 a thin film transistor (hereinafter, referred to as "TFT"), i.e., a switching element, 217 the liquid crystal, 218 the compensation capacitor, 219 a source electrode, 220 a between-gate/source parasitic capacitor configured between the scanning line (this is also referred to as "gate line") 214 and the source electrode 219.

In FIGS. 3A, 3B, reference notations Vg(n), Vg(n+1) denote, of the group of scanning lines 214 illustrated in FIG. 2, driving waveforms of scanning lines that drive the nth line and the (n+1)th line, respectively. In addition, a notation Vgon denotes a selection voltage level, and a notation Vgoff denotes a non-selection voltage level. The notation Vcom indicates an ideal driving waveform of the opposed electrode voltage feeding line 212, and a notation Vcomh denotes a high electric potential voltage level and a notation VcomL denotes a low electric potential voltage level. A notation Vd indicates the tone voltage of the group of signal lines 213. When, with reference to the opposed electrode voltage Vcom, the tone voltage Vd is positioned on the negative polarity side, a voltage with negative polarity is applied to the pixel 215. Conversely, when the tone voltage Vd is positioned on the positive polarity side, a voltage with positive polarity is applied to the pixel 215. In the liquid crystal display, the electric potential difference between the opposed electrode voltage Vcom and the tone voltage Vd becomes equal to an effective voltage value applied to the liquid crystal 217. The effective voltage value causes the liquid crystal display to operate in such a manner that the luminance thereof is varied. Moreover, in the present embodiment, the explanation will be given based on the following characteristic: If the electric potential difference between the opposed electrode voltage Vcom and the tone voltage Vd is small, the display becomes a dark display (the example: black display) and if the electric potential difference is large, the display becomes a light display (the example: white display). In FIGS. 3A, 3B, the drain voltage Vd is the tone voltage executing the white display, and a notation VdWH denotes a white display drain voltage with positive polarity, and a notation VdWL denotes a white display drain voltage with negative polarity. When, with reference to the opposed electrode voltage Vcom, the drain voltage is positioned on the negative polarity side, an effective voltage value Vrms 1 is applied to the pixel. Conversely, when the drain voltage is positioned on the positive polarity side, an effective voltage value Vrms 2 is applied to the pixel.

Referring to FIG. 2 once again, the detailed explanation will be given below concerning the operation of the conventional TFT liquid crystal display.

The interface circuit 202 inputs the display data and the synchronization signal transferred by the interface signal 201. Then, the interface circuit 202 generates and outputs the control signal 207 to the signal driving circuit 203, the control signal 208 to the scan driving circuit 204, and the liquid crystal-applying voltage alternating signal M 209 to the power supply circuit 205. The signal driving circuit 203 fetches in sequence the display data by the amount of one horizontal line, using the display data and the synchronization signal transferred by the control signal 207. Then, after fetching the display data by the amount of one horizontal line, the signal driving circuit 203 outputs, simultaneously from the group of signal lines 213, the tone voltage corresponding to the fetched display data by the amount of one horizontal line. The signal driving circuit 203 continues outputting the tone voltage by the amount of one horizontal line during one horizontal time-period. Also, at this time, in parallel to the continuous outputting of the tone voltage, the signal driving circuit 203 executes an operation of fetching in sequence the display data of the next horizontal line.

Accordingly, it turns out that the display data that the interface circuit 202 outputs is converted into the tone voltage, then being outputted to the liquid crystal panel 206 during the next horizontal time-period. The signal driving circuit 203 repeats this operation, thereby outputting, to the liquid crystal panel 206, the tone voltage corresponding to the display data by the amount of one frame, i.e., by the amount of one screen. Also, the tone voltage that the signal driving circuit 203 outputs is generated by employing, as a reference voltage, the tone voltage transferred by the tone voltage line 210. In general, the reference voltage of the tone voltage transferred by the tone voltage line 210 is a voltage including a plurality of levels that range from the voltage for the black display to the voltage for the white display. Furthermore, the scan driving circuit 204 synchronizes with the control signal 208, thus applying a selection voltage to the group of scanning lines 214 from the 1st line in sequence. At this time, the selection voltage is applied to the TFT 216 in each of the pixels 215. As the result, the TFT 216 is switched into the selection state, thereby applying the tone voltage, which is transferred from each of the group of signal lines 213, to the liquid crystal 217 and the compensation capacitor 218. Then, if a non-selection voltage is applied to each of the scanning lines 214, the resultant non-selection state is maintained until it is switched back into the selection state next. In this way, in the liquid crystal display, the scanning is controlled in the sequence of the lines, and an amount of the light passing through the liquid crystal 217 is controlled at a voltage level of the effective voltage value applied to the liquid crystal 217. These controls have made it possible to embody the tone display.

Referring to FIGS. 3A, 3B once again, the explanation will be given below in more detail concerning the operation of applying the electric voltage to the liquid crystal 217 in the pixel 215. As illustrated in FIGS. 3A, 3B, if the selection voltage Vgon is applied to the scanning line G(n), the TFT 216 illustrated in FIG. 2 is switched into the "ON" state. Then, as explained earlier, the drain (tone) voltage Vd transferred by the signal line 213 is applied to the liquid crystal 217 in the pixel 215. Meanwhile, if the non-selection voltage Vgoff is applied to the scanning line G(n), the TFT 216 is switched into the "OFF" state with this timing, and the voltage thereof is maintained. In the timing with which the selection voltage Vgon is applied to the scanning line G(n), the voltage level of the opposed electrode voltage feeding line 212 is the low electric potential voltage VcomL (negative polarity). Accordingly, the voltage applied to the liquid crystal turns out to be the voltage with positive polarity (The white display drain voltage is VdWH.). Similarly, in the timing with which the selection voltage Vgon is applied to the scanning line G(n+1), the voltage level of the opposed electrode voltage feeding line 212 is the high electric potential voltage VcomH (positive polarity). Accordingly, the voltage applied to the liquid crystal turns out to be the voltage with negative polarity (The white display drain voltage is VdWL.).

Generally speaking, it is required to apply an alternating voltage to the liquid crystal with a period of one frame (about 60 Hz). Consequently, in a line corresponding to each of the group of the scanning lines 214, it is required to apply, in a timing with which the voltage is applied next, a voltage the polarity of which is opposite to that of the voltage applied before. Furthermore, if the polarity of the tone voltage applied all over the surface of one screen is biased onto either of the two types of polarities, there occurs a flickering phenomenon called "flicker". Accordingly, in the present embodiment, an alternating driving for each line has been embodied so that the tone voltage with positive polarity and that with negative polarity will be able to be applied for each line. Consequently, the voltage level of the opposed electrode voltage feeding line 212 alternates for each line the high electric potential voltage VcomH (positive polarity) and the low electric potential voltage VcomL (negative polarity).

The characteristic of the present conventional driving system is as follows: The present conventional driving system can be configured using the signal driving circuit 203 that has a dynamic range of the tone voltage Vd illustrated in FIGS. 3A, 3B, i.e., a withstand voltage that the tone voltage with either of the polarities can generate. This is made possible by the fact that, in the driving system, the opposed electrode voltage Vcom of the opposed electrode voltage feeding line 212 has been alternated. In contrast to this, in general, when applying the tone voltage with positive polarity and that with negative polarity to the liquid crystal, a signal driving circuit becomes necessary that has a dynamic range 2 times as long as the above-described dynamic range illustrated in FIGS. 3A, 3B.

Next, referring to FIGS. 4A, 4B to FIGS. 7A, 7B, the explanation will be given below regarding problems in the conventional liquid crystal display. FIGS. 4A, 4B illustrate driving waveform diagrams in the respective portions in the case where the white display is performed by the conventional liquid crystal display. FIGS. 5A, 5B illustrate driving waveform diagrams in the respective portions in the case where the black display is performed by the conventional liquid crystal display. FIG. 6 illustrates an example of a displayed screen at the time of being displayed by the conventional liquid crystal display. FIGS. 7A, 7B illustrate driving waveform diagrams in the case where the example of the displayed screen illustrated in FIG. 6 is displayed by the conventional liquid crystal display.

Both of FIGS. 4A, 4B illustrate operations of applying the white display voltage. FIG. 4A illustrates an example where the tone voltage with negative polarity is applied. FIG. 4B illustrates an example where the tone voltage with positive polarity is applied. In FIG. 4A, a reference notation Vg denotes a voltage waveform applied to the respective scanning lines. In addition, Vgon denotes the selection voltage level, and Vgoff denotes the non-selection voltage level. Vd indicates the tone voltage waveform applied to the respective signal lines. VdWH denotes the white display voltage with positive polarity, and VdWL denotes the white display voltage with negative polarity. Vcom 1 denotes an opposed electrode voltage waveform inputted into the liquid crystal panel 206, and Vcom 2 denotes the opposed electrode voltage waveform inside the liquid crystal panel 206. Vs denotes a source voltage waveform of the source electrode 219 in the pixel 215 inside the liquid crystal panel 206. Also, the reference notations in FIG. 4B are the same as those in FIG. 4A.

Both of FIGS. 5A, 5B illustrate operations of applying the black display voltage. FIG. 5A illustrates an example where the tone voltage with negative polarity is applied. FIG. 5B illustrates an example where the tone voltage with positive polarity is applied. In FIG. 5A, Vd indicates the tone voltage waveform applied to the respective signal lines. In addition, VdBH denotes a black display voltage with positive polarity, and VdBL denotes a black display voltage with negative polarity. The other waveforms are the same as those of the driving voltages illustrated in FIG. 4A. Also, the reference notations in FIG. 5B are the same as those in FIG. 5A.

FIG. 6 presents the example of the displayed screen in the case where an intermediate luminance is displayed all over the entire screen and a white rectangle is displayed at the central portion. In FIG. 6, there is illustrated a phenomenon that the luminances come to differ between intermediate luminance display regions "B" where the white rectangle is not displayed and display regions "A" that are located on the right and the left sides of the white rectangle. This phenomenon is a picture quality deterioration called "transverse smear", which, in the conventional liquid crystal display, occurs in the case of the low voltage driving that alternates the opposed electrode voltage to be applied to the opposed electrode voltage feeding line.

FIGS. 7A, 7B illustrate driving waveform diagrams in the respective portions in the example of the displayed screen illustrated in FIG. 6. FIG. 7A illustrates the driving waveform diagram in the intermediate tone display regions "B" illustrated in FIG. 6, and FIG. 7B illustrates the driving waveform diagram in the intermediate tone display regions "B" illustrated in FIG. 6. Additionally, in the present conventional embodiment, there are described both of the examples where the tone voltage with negative polarity is applied. In FIG. 7A, Vd indicates a voltage waveform in the intermediate luminance display. VdGH denotes an intermediate luminance display voltage with positive polarity, and VdGL denotes an intermediate luminance display voltage with negative polarity. The other waveforms are the same as those of the driving voltages illustrated in FIG. 4A. Also, the reference notations in FIG. 7B are the same as those in FIG. 7A.

Next, the detailed explanation will be given below regarding the occurrence mechanism of the transverse smear, i.e., the phenomenon that the variation in the luminance occurs in the display regions "A" that are located on the right and the left sides of the white rectangle as illustrated in FIG. 6.

In the case of the low voltage driving that alternates the opposed electrode voltage to be applied to the opposed electrode voltage feeding line, since the opposed electrode voltage feeding line is common to all the pixels, there can be said the following: When the opposed electrode voltage is the high electric potential voltage (positive polarity), in all the pixels on the lines into which the tone voltage is to be written, the tone voltage with negative polarity is applied. Also, when the opposed electrode voltage is the low electric potential voltage (negative polarity), in all the pixels on the lines into which the tone voltage is to be written, the tone voltage with positive polarity is applied. As the result, it turns out that there occurs an electric current concentration. This electric current concentration is such that, through the liquid crystals 217 and the compensation capacitors 218 in all the pixels 215, electric currents in all the pixels flow into or out of the opposed electrode voltage feeding line in one direction. At this time, a time constant of the opposed electrode voltage feeding line exerts influences, thereby causing a distortion to occur in the opposed electrode voltage. FIGS. 4, 5 reflect and illustrate the manner of this process.

In the driving waveform diagrams in FIGS. 4A, 4B and FIGS. 5A, 5B, as illustrated in FIG. 2, there exists the between-gate/source parasitic capacitor 220 in each of the pixels 215 in the liquid crystal panel 205. Capacitance of the parasitic capacitor 220 is caused by the TFT 216, and thus is concerned with insulating films and silicon (the both are not illustrated) of the TFT 216. When the scanning line is transitioned from the selection state to the non-selection state, the TFT 216 is switched from the "ON" state to the "OFF" state. At this time, the voltage that has been applied to the liquid crystal 217 and the compensation capacitor 218 is distributed to the parasitic capacitor 220 as well, since the above-described insulating films and silicon can also be regarded as capacitors.

Assuming that the capacitance of the parasitic capacitor 220 is Cgs, equivalent capacitance of the liquid crystal 217 is Clc, capacitance of the compensation capacitor 218 is Cstg, and the selection voltage of the scanning line is Vgon, ΔVgs, i.e., the voltage that has moved to the parasitic capacitor, is given by the following formula (1):

$$\Delta Vgs=(Cgs/(Cgs+Ccl+Cstg))\times Vgon \quad (1)$$

Consequently, it has been found that the voltage applied to the liquid crystal 217 drops by the amount of the voltage that has moved to the parasitic capacitor 220. This requires that Vcom 1, i.e., the opposed electrode voltage to be applied to the opposed electrode voltage feeding line, be shifted in advance down to a lower electric potential level by the amount of the voltage that will drop because of the influence of the parasitic capacitor 220.

Next, the explanation will be given below concerning operations of the respective voltage waveforms in pursuit of time. When applying VdWL, i.e., the white display voltage with negative polarity illustrated in FIG. 4A, if the selection voltage Vgon is applied to the scanning line, during a time-period "T1", the source voltage vs is transitioned to the voltage level of the drain voltage Vd in the previous line (Vs is shifted up to a higher electric potential.). After that, if the opposed electrode voltage is alternated during a time-period "T2", as illustrated in FIG. 4A, the source voltage Vs is shifted up to a higher electric potential in response to the alternating of the opposed electrode voltage. This is due to the fact that the variation in the opposed electrode voltage is steeper than writing speed of the TFT 216. After that, during time-periods "T3", "T4", the source voltage Vs is transitioned to the electric potential of the drain voltage Vd. Here, during the time-period "T3", the source voltage Vs lies in a higher electric potential state than the opposed electrode voltage Vcom 2 inside the liquid crystal panel 206, and during the time-period "T4", the source voltage Vs falls in a lower electric potential state than the opposed electrode voltage Vcom 2 inside the liquid crystal panel 206. In this operation, the source voltage electric potential is positioned at a considerably higher electric potential level as compared with the opposed electrode voltage electric potential. This increases the voltage distortion in the opposed electrode voltage, thus slowing down the convergence rate. Accordingly, in the timing with which the time-period "T4" is over, i.e., the timing with which the non-selection voltage Vgoff is applied to the scanning line, the electric potential difference between the source voltage Vs and the opposed electrode voltage Vcom 2 plays a role of VrmsWL 1, i.e., the effective voltage value to be applied to the liquid crystal 217. In the present conventional embodiment, the opposed electrode voltage Vcom 2 inside the liquid crystal panel 206 does not attain to the desired opposed electrode voltage Vcom 1. This generates an electric potential difference ΔVcomH, which appears as a lack of the effective voltage value. Also, if the TFT 216 is transitioned to the "OFF" state, there occurs the above-described diving phenomenon of the voltage into the parasitic capacitor 220. This diving voltage level becomes equal to ΔVgsWL. Thus, eventually, the resultant effective voltage value to be applied to the liquid crystal 217 becomes equal to −VrmsWL2 (=−VrmsWL1−ΔVgsWH). Also, in this effective voltage value, there has occurred the lack of the effective voltage value that is equivalent to ΔVcomH. This is because, as described above, the opposed electrode voltage Vcom 2 inside the liquid crystal panel 206 is lacked by the amount of ΔVcomH as compared with the desired opposed electrode voltage Vcom 1.

Similarly, when applying VdWH, i.e., the white display voltage with positive polarity illustrated in FIG. 4B, if the selection voltage Vgon is applied to the scanning line, during a time-period "T1", the source voltage vs is transitioned to the voltage level of the drain voltage Vd in the previous line (Vs is shifted up to a higher electric potential.). After that, during a time-period "T2", alternating the opposed electrode voltage transitions the source voltage down to a lower electric potential voltage. Since the variation in the opposed electrode voltage is steeper than the writing speed of the TFT 216, as illustrated in FIG. 4B, the source voltage Vs is shifted down to the lower electric potential in response to the alternating of the opposed electrode voltage. After that, during time-periods "T3", "T4", the source voltage Vs is transitioned to the electric potential of the drain voltage Vd. Here, during the time-period "T3", the source voltage Vs lies in a lower electric potential state than the opposed electrode voltage Vcom 2 inside the liquid crystal panel 206, and during the time-period "T4", the source voltage Vs rises in a higher electric potential state than the opposed electrode voltage Vcom 2 inside the liquid crystal panel 206. In this operation, the electric potential difference between the opposed electrode voltage and the drain voltage has become larger than that in the above-described case illustrated in FIG. 4A where the tone voltage with negative polarity is applied. This condition increases amount of writing voltage during the time-period "T4". Accordingly, the opposed electrode voltage Vcom 2 does not attain to the desired opposed electrode voltage Vcom 1, thus generating an electric potential difference ΔVcomL. Consequently, the effective voltage value to be applied to the liquid crystal 217 becomes VrmsWH1, and thus it turns out that there has occurred a lack of the effective voltage value that is equivalent to ΔVcomL. Also, if the TFT 216 is transitioned to the "OFF" state, there occurs the diving phenomenon of the voltage because of the above-described influence of the parasitic capacitor 220. This diving voltage level becomes equal to ΔVgsWH. Thus, eventually, the resultant effective voltage value to be applied to the liquid crystal 217 becomes equal to VrmsWH2 (=VrmsWH1−ΔVgsWL). Accordingly, it turns out that, on account of the insufficiency in the convergence of the opposed electrode voltage Vcom 2, there has occurred the lack of the effective voltage value that is equivalent to ΔVcomL.

Next, referring to FIGS. 5A, 5B, the explanation will be given below regarding the manner in which the black display voltage is applied. When applying VdBL, i.e., the black display voltage with negative polarity illustrated in FIG. 5A, if the selection voltage Vgon is applied to the scanning line, during a time-period "T1", the source voltage Vs is transitioned to the voltage level of the drain voltage Vd in the previous line (Vs is shifted up to a higher electric potential.). After that, during a time-period "T2", the opposed electrode voltage is alternated and, as illustrated in FIG. 5A, the source voltage Vs is shifted up to a higher electric potential in response to the alternating of the opposed electrode voltage. After that, during a time-period "T3", the source voltage Vs is transitioned to the electric potential of the drain voltage Vd. Then, during a time-period "T4", the source voltage Vs is stabilized and, at this point in time, the effective voltage value applied to the liquid crystal 217 is VrmsBL1. Here, taking a diving voltage ΔVgsBL into consideration, it is found that the effective voltage value applied to the liquid crystal 217 in the holding state becomes −VrmsBL2 (=VrmsBL1−ΔVgSBL). Namely, this means the following: The opposed electrode voltage Vcom 1 has been shifted onto the lower electric potential side. Accordingly, when the TFT 216 lies in the "ON" state, the source voltage Vs is positioned nearer to the positive polarity side than the opposed electrode voltages Vcom 1, Vcom 2. Then, the TFT 216 is transitioned to the "OFF" state. This causes the diving voltage to occur, thereby changing the effective voltage value VrmsBL1 into the tone voltage with the negative polarity. In addition to this, in comparison with the case illustrated in FIG. 4A where the white display voltage is applied, the electric potential variation in the source voltage Vs is infinitesimal during the time-period "T2". This condition enhances the convergence rate at which the opposed electrode voltage Vcom 2 converges onto the desired opposed electrode voltage Vcom 1. Consequently, there occurs none of the variation in the effective voltage value on account of the insufficiency in the convergence of the opposed electrode voltage Vcom 2.

When applying VdBH, i.e., the black display voltage with positive polarity illustrated in FIG. 5B, if the selection voltage Vgon is applied to the scanning line, during a time-period "T1", the source voltage Vs is transitioned to the voltage level of the drain voltage Vd in the previous line (Vs is shifted up to a higher electric potential.). After that, during a time-period "T2", the opposed electrode voltage is alternated and, as illustrated in FIG. 5B, the source voltage Vs is shifted down to a lower electric potential in response to the alternating of the opposed electrode voltage. After that, during time-periods "T3", "T4", the source voltage Vs is transitioned to the electric potential of the drain voltage Vd, and the source voltage Vs is stabilized. In comparison with the case illustrated in FIG. 4B where the white display voltage is applied, the electric potential variations in the source voltage Vs and the opposed electrode voltage Vcom 2 are small enough. This condition decreases the amount of the writing voltage, thus enhancing the convergence rate at which the opposed electrode voltage Vcom 2 converges onto the desired opposed electrode voltage Vcom 1. Assuming that the effective voltage value applied to the liquid crystal 217 is VrmsBH1 during the time-period "T4" and taking a diving voltage ΔVgsBH into consideration, it is found that the effective voltage value applied in the holding state becomes −VrmsBH2 (=VrmsBH1−ΔVgsBH). As is the case with the description in FIG. 5A, there occurs none of the variation in the effective voltage value on account of the insufficiency in the convergence of the opposed electrode voltage Vcom 2.

In this way, in the state where the electric potential difference between the opposed electrode voltage Vcom and the drain voltage Vd is large, the voltage distortion in the opposed electrode voltage Vcom becomes larger. As the result, there occurs the lack of the effective voltage value toward the liquid crystal 217. Conversely, in the state where the electric potential difference between the opposed electrode voltage Vcom and the drain voltage Vd is small, the voltage distortion in the opposed electrode voltage Vcom becomes smaller. As the result, there occurs no lack of the effective voltage value toward the liquid crystal 217.

Next, the explanation will be given below regarding causes of the picture quality deterioration illustrated in FIG. 6, referring to FIGS. 7A, 7B and taking into consideration the voltage-applied state in the white display and the voltage-applied state in the black display.

In the lines in the regions (A) illustrated in FIG. 6, the white display data are included in the display data in the horizontal direction. This condition causes the opposed electrode voltage waveform Vcom 2 inside the liquid crystal panel 206 to take on a voltage waveform as illustrated in FIG. 7A. Namely, there occurs a voltage variation in the opposed electrode voltage Vcom 2 that is attributed to the white display, and thus there occurs a lack of the effective voltage value that is equivalent to ΔVcomGH as compare with the desired opposed electrode voltage Vcom 1.

Similarly, in the lines in the regions (B) illustrated in FIG. 6, all the display data in the horizontal direction are the intermediate tone display data. This condition causes the opposed electrode voltage waveform Vcom 2 inside the liquid crystal panel 206 to take on a voltage waveform as illustrated in FIG. 7B. Namely, it turns out that the opposed electrode voltage Vcom 2 attains to the desired opposed electrode voltage Vcom 1. Accordingly, even in the same intermediate luminance display, the effective voltage value applied to the liquid crystal 217 in the holding state becomes different by the amount of ΔVcomGH, and thus there occurs a lack of the effective voltage value. As the result, the white display data are included in the display data in the horizontal direction, and thus the intermediate luminance of the lines becomes dark display. Consequently, the difference in the effective voltage value, i.e., the amount equivalent to the insufficiency in the convergence of the opposed electrode voltage, is able to be recognized by the human eyes as the variation in the luminance, then being perceived as the transverse smear explained earlier.

Next, based on FIGS. 8 to 12, the further explanation will be given below concerning another conventional embodiment of a liquid crystal display. By the way, the configuration components in a circuit illustrated in FIG. 8 are the same as those in the conventional embodiment illustrated in FIG. 2 except for a compensation electrode 213. Accordingly, here, the explanation will be given regarding only the points that differ from those in the embodiment in FIG. 2.

In FIG. 9, a reference notation G1 denotes, of a group of scanning lines 214 illustrated in FIG. 8, a driving waveform of a scanning line that drives the 1st line. In addition, Vgon denotes a selection voltage level, and Vgoff denotes a non-selection voltage level. Similarly, G2 denotes a driving waveform of a scanning line that drives the 2nd line. Vcom indicates a driving waveform of an opposed electrode voltage signal line 212, and VcomP denotes a voltage level with positive polarity and VcomN denotes a voltage level with negative polarity. Vd indicates a tone voltage of a group of signal lines 213. When, with reference to the opposed electrode voltage Vcom, the tone voltage Vd is positioned on the negative polarity side, a voltage with negative polarity is applied to a pixel 215. Conversely, when the tone voltage Vd is positioned on the positive polarity side, a voltage with positive polarity is applied to the pixel 215.

The electric potential difference between the opposed electrode voltage Vcom and the tone voltage Vd causes the liquid crystal display to operate in such a manner that the luminance thereof is varied.

Additionally, in the conventional liquid crystal display illustrated in FIG. 8, there takes place a phenomenon that a voltage applied to a liquid crystal 217 causes a current leakage during a holding time-period, thus instabilizing a holding voltage of the liquid crystal 217. In order to prevent this phenomenon, in the liquid crystal display, there is commonly provided the compensation electrode 213. In addition, since a driving voltage for the compensation electrode 213 is also the same as a driving voltage waveform of the opposed electrode voltage Vcom, the description thereof will be omitted in the explanation in FIG. 9 and thereafter.

Next, referring to FIGS. 9 to 12, the explanation will be given below concerning problems in the conventional liquid crystal display. FIGS. 10A, 10B are diagrams for illustrating examples of displayed screens at the time of being displayed by the conventional liquid crystal display. FIG. 11 is a current path diagram for explaining causes of the picture quality deterioration in the conventional liquid crystal display. FIG. 12 is a driving waveform diagram for explaining the causes of the picture quality deterioration in the conventional liquid crystal display.

FIG. 10A is about an example of the following case: An intermediate gray is displayed all over the entire screen, and at the central portion, there are displayed a white rectangle, a light gray (gray the luminance (lightness) of which is higher as compared with that of the intermediate gray displayed all over the entire screen) rectangle, and a lighter gray (gray the luminance (lightness) of which is higher as compared with that of the above-mentioned light gray) rectangle. In FIG. 10A, there is illustrated the following phenomenon: Luminances of grays in display areas located on the right and the left sides of the three rectangles are lowered as compared with that of gray in the other display areas, and in addition, the respective amounts of the lowering in the luminances of the grays in the display areas located on the right and the left sides of the three types of rectangles are varied depending on the luminance levels of the three types of rectangles displayed at the central portion.

Similarly, FIG. 10B is about an example of the following case: Gray is displayed all over the entire screen, and at the central portion, there are displayed a black rectangle, a dark gray (gray the luminance (lightness) of which is lower as compared with that of the gray displayed all over the entire screen) rectangle, and a darker gray (gray the luminance (lightness) of which is lower as compared with that of the above-mentioned dark gray) rectangle. In FIG. 10B, there is illustrated the following phenomenon: Luminances of grays in display areas located on the right and the left sides of the three rectangles are heightened as compared with that of gray in the other display areas, and in addition, the respective amounts of the heightening in the luminances of the grays in the display areas located on the right and the left sides of the three types of rectangles are varied depending on the luminance levels of the three types of rectangles displayed at the central portion.

FIG. 11 illustrates electric current paths in the case where a voltage applied to each pixel on a line that a scanning line G1 selects has positive polarity, and indicates the manner in which the electric currents are concentrated onto the opposed electrode voltage signal line 212 and the compensation electrode 213.

In FIG. 12, a reference notation CL1 denotes a horizontal synchronization signal. The signal CL1 becomes effective at a ratio of one time during one horizontal time-period, and becomes a timing signal with which tone display data by the amount of one horizontal line are outputted by being transformed into a tone voltage. A notation M denotes the liquid crystal-applying voltage alternating signal. The signal M executes a control of converting the polarity of the opposed electrode voltage Vcom into negative polarity at the time of "Low" level and converting the polarity of the opposed electrode voltage Vcom into positive polarity at the time of "High" level. A notation Vda denotes a tone voltage waveform that is applied to a portion of Da described in FIG. 10A and that is described by simplifying the portion of Da (i.e., described by reducing the number of the lines). A notation Vdb denotes a tone voltage waveform that is applied to a portion of Db described in FIG. 10A and that is described by simplifying the portion of Db (i.e., described by reducing the number of the lines).

Concerning the opposed electrode voltage Vcom, a full line (VcomA) indicates a waveform diagram of the opposed electrode voltage signal line 212 connected to an output terminal of a power supply circuit 205 illustrated in FIG. 8. Moreover, a dashed line (VcomB) indicates a waveform diagram inside a liquid crystal panel 206.

Next, referring to FIGS. 11, 12, the detailed explanation will be given below regarding the causes of the picture quality deterioration described in FIGS. 10A, 10B.

The luminances that the present conventional liquid crystal display displays are controlled by an effective voltage value Vdrms that is applied to the liquid crystal 217. The liquid crystal display is controlled so that, for example, when the effective voltage value is high, it displays a color of high luminance (white) and, when the effective voltage value is low, it displays a color of low luminance (black).

In FIG. 11, the opposed electrode voltage signal line 212 and the compensation electrode 213 are common to the respective pixels. Accordingly, in all the pixels, the electric currents are concentrated onto the opposed electrode voltage signal line 212 and the compensation electrode 213. When the electric currents are concentrated in this way, such loads as resistances (not illustrated) in the opposed electrode voltage signal line 212 and the compensation electrode 213 cause a voltage distortion to occur in the opposed electrode voltage and a compensation electrode voltage.

This voltage distortion has been found to be as illustrated in FIG. 12. Namely, during time-periods tH 1, tH 2 (both of which are the uppermost gray display areas of the rectangle region illustrated in FIG. 10A) and tH 9 (which is the lowermost gray display area of the rectangle region illustrated in FIG. 10A), the voltage level of the tone voltage remains constant (the tone voltage at the intermediate voltage level) in the horizontal direction as indicated by Vda, Vdb, and the opposed electrode voltage turns out to be expressed by VcomB. Meanwhile, during time-periods tH 3, tH 4 (both of which are the display areas of the white rectangle region illustrated in FIG. 10A), tH 5, tH 6 (both of which are the display areas of the lighter gray rectangle region illustrated in FIG. 10A) and tH 7, tH 8 (both of which are the display areas of the light gray rectangle region illustrated in FIG. 10A), Vda plays a role of executing the white rectangle display, the lighter gray rectangle display and the light gray rectangle display, which increases quantity of the electric current.

This condition increases quantity of the electric currents concentrated onto the opposed electrode voltage signal line 212 and the compensation electrode 213. This, further, prevents the opposed electrode voltage VcomB inside the liquid crystal panel 206 from attaining to the voltage level of the desired opposed electrode voltage VcomA. As the result, the opposed electrode voltage Vcom is lowered by the following amounts: ΔVcom 1 at the time of the white rectangle display, ΔVcom 2 at the time of the lighter gray rectangle display, and ΔVcom 3 at the time of the light gray rectangle display.

Also, in correspondence with the luminance levels of the three types of rectangles displayed at the central portion, the quantity of the electric currents concentrated onto the opposed electrode voltage signal line 212 and the compensation electrode 213 is also varied. Concretely speaking, the amount of the opposed electrode voltage Vcom that has been lowered as compared with the desired opposed electrode voltage VcomA is varied like +Vcom 1, ΔVcom 2, and ΔVcom 3. This results in a condition that effective voltage values, each of which has been lowered in the following way, are applied to the liquid crystal 217: With reference to the original effective voltage value Vdrms obtained during tH 1, tH 2 and tH 9, Vdrms−ΔVcom 1 in the white rectangle display during tH 3, tH 4, Vdrms−ΔVcom 2 in the lighter gray rectangle display during tH 5, tH 6, and Vdrms−ΔVcom 3 in the light gray rectangle display during tH 7, tH 8.

The luminances that the liquid crystal display displays are controlled by the effective voltage value applied to the liquid crystal 217. Consequently, if the desired opposed electrode voltage fails to be obtained, the result is as follows: The display luminances are varied, and the luminances of grays in the display areas located on the right and the left sides of the three types of rectangle regions in the Db region described in FIG. 10A are lowered as compared with that of gray in the other display areas.

Meanwhile, as illustrated in FIG. 10B, there are provided the black rectangle region, the darker gray rectangle region and the dark gray rectangle region. This decreases quantity of the electric currents concentrated onto only the line region, thereby increasing the effective voltage value applied to the liquid crystal. Accordingly, there occurs the phenomenon that the luminances are heightened.

In this way, in the conventional liquid crystal display, the quantity of the electric currents concentrated onto the opposed electrode voltage signal line 212 and the compensation electrode 213 has been increased/decreased in correspondence with the display data. This has fluctuated the amount of the voltage distortion in the opposed electrode voltage and the compensation electrode voltage, thus causing the picture quality deterioration to occur.

The present invention has been made in view of the above-described problems. An object thereof is to provide a liquid crystal display that allows display of high picture quality to be embodied with the use of a low voltage driving circuit, and a driving method therefor.

SUMMARY OF THE INVENTION

It is an object of the present invention to provide a liquid crystal display that allows display of high picture quality to be embodied with the use of a low voltage driving circuit.

The present invention has been made in order to accomplish the above-described object. As the first mode thereof, there is provided a liquid crystal display including a liquid crystal panel having M units of pixels in the horizontal direction and N units of pixels in the vertical direction, each of the pixels including a switching element and a liquid crystal, a signal driving circuit for inputting display data and generating a tone voltage corresponding to the inputted display data so as to apply the tone voltage to one group of the pixels arranged in the horizontal direction and corresponding to the display data, and a scan driving circuit for selecting, in sequence, any one group of the pixels arranged in the vertical direction, the scan driving circuit, then, applying a selection voltage to the one group of the pixels arranged in the vertical direction and selected at that time and, meanwhile, applying a non-selection voltage to the other groups of the pixels arranged in the vertical direction and not selected at that time, the liquid crystal having, at one end thereof, an opposed electrode common to the respective pixels, wherein, when the selection voltage outputted by the scan driving circuit is applied to the switching element in each of the pixels, the tone voltage generated by the signal driving circuit is applied to the liquid crystal so that display luminance is controlled by an effective voltage value of the tone voltage toward the opposed electrode, and there are further included a circuit for detecting amount of data of the inputted display data and a power supply circuit for executing, in correspondence with the detected amount of the display data, an addition/subtraction control of a correction voltage value over an opposed electrode voltage value applied to the opposed electrode.

In the present invention, in order to accomplish the above-described object, there is provided a liquid crystal display apparatus or a driving method therefor, including a liquid crystal panel having M units of pixels in the horizontal direction and N units of pixels in the vertical direction, each of the pixels including a switching element and a liquid crystal, a signal driving circuit for inputting display data and generating a tone voltage corresponding to the inputted display data so as to apply the tone voltage to one group of the pixels arranged in the horizontal direction and corresponding to the display data, and a scan driving circuit for selecting, in sequence, any one group of the pixels arranged in the vertical direction, the scan driving circuit, then, applying a selection voltage to the one group of the pixels arranged in the vertical direction and selected at that time and, mean-while, applying a non-selection voltage to the other groups of the pixels arranged in the vertical direction and not selected at that time, the liquid crystal having, at one end thereof, an opposed electrode common to the respective pixels, wherein, when the selection voltage outputted by the scan driving circuit is applied to the switching element in each of the pixels, the tone voltage generated by the signal driving circuit is applied to the liquid crystal so that display luminance is controlled by an effective voltage value of the tone voltage toward the opposed electrode, and there are further included a member for detecting amount of data of the inputted display data and a voltage correcting member for executing a correction to the opposed electrode voltage value or an applying time-period thereof in correspondence with the detected amount of the display data and for each horizontal time-period.

Here, it is allowable that the voltage correcting member is configured to have, as an example, a circuit for generating a correction time-period controlling signal, the correction time-period controlling signal being generated for controlling the time-period during which the correction is executed to the opposed electrode voltage value in correspondence with the detected amount of the display data and for each horizontal time-period, and a circuit for executing an addition/subtraction control of a constant correction voltage value over the opposed electrode voltage value in correspondence with the correction time-period controlling signal generated and during only a time-period corresponding to the detected amount of the display data within each horizontal time-period. In this case, it is preferable that the circuit for generating the correction time-period controlling signal should include a data converting circuit including decoder circuits, a coincidence circuit, and a counter circuit. Also, it is preferable that the circuit for executing the addition/subtraction control of the correction voltage value should include an analog addition/subtraction circuit and an analog selecting circuit.

Also, it is allowable that the voltage correcting member is configured to have, as another example, a circuit for generating a correction time-period controlling signal for executing a correction to the opposed electrode voltage value during only a fixed time-period within one horizontal time-period, and a circuit for executing an addition/subtraction control of a correction voltage value over the opposed electrode voltage value in correspondence with the correction time-period controlling signal generated and during only a fixed time-period within one horizontal time-period. In this case, it is preferable that the circuit for generating the correction time-period controlling signal should include a counter circuit and a coincidence circuit. Also, it is preferable that the circuit for executing the addition/subtraction control of the correction voltage value should include a digital/analog converting circuit, an analog addition/subtraction circuit, and an analog selecting circuit.

Also, it is allowable that the voltage correcting member is configured to have, as still another example, a circuit for generating a correction time-period controlling signal, the correction time-period controlling signal being generated for controlling a time-period during which a correction is executed to the opposed electrode voltage value in correspondence with the detected amount of the display data and within one horizontal time-period, and a circuit for executing an addition/subtraction control of a correction voltage value over the opposed electrode voltage value during only a time-period corresponding to the correction time-period controlling signal generated, the correction voltage value corresponding to the detected amount of the display data. In this case, it is preferable that the circuit for generating the correction time-period controlling signal should include a data converting circuit including decoder circuits, a coincidence circuit, and a counter circuit. Also, it is preferable that the circuit for executing the addition/subtraction control of the correction voltage value should include a digital/analog converting circuit, an analog addition/subtraction circuit, and an analog selecting circuit.

DESCRIPTION OF THE EMBODIMENTS

Referring to FIG. 1 and FIGS. 13 to 35, the explanation will be given below concerning an embodiment of a liquid crystal display according to the present invention.

Figure 1:
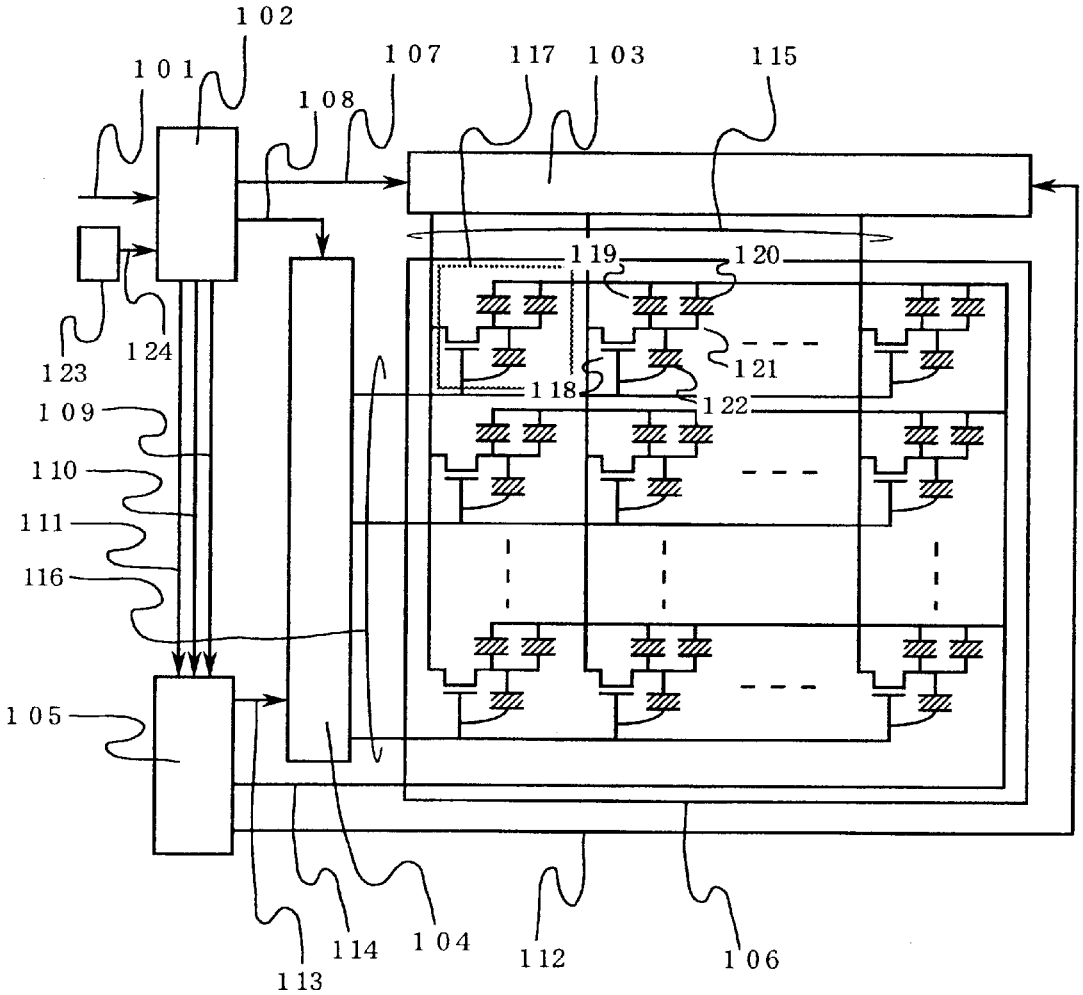
FIG. 1 is a block diagram for illustrating a liquid crystal display according to the present invention.
Figure 13:
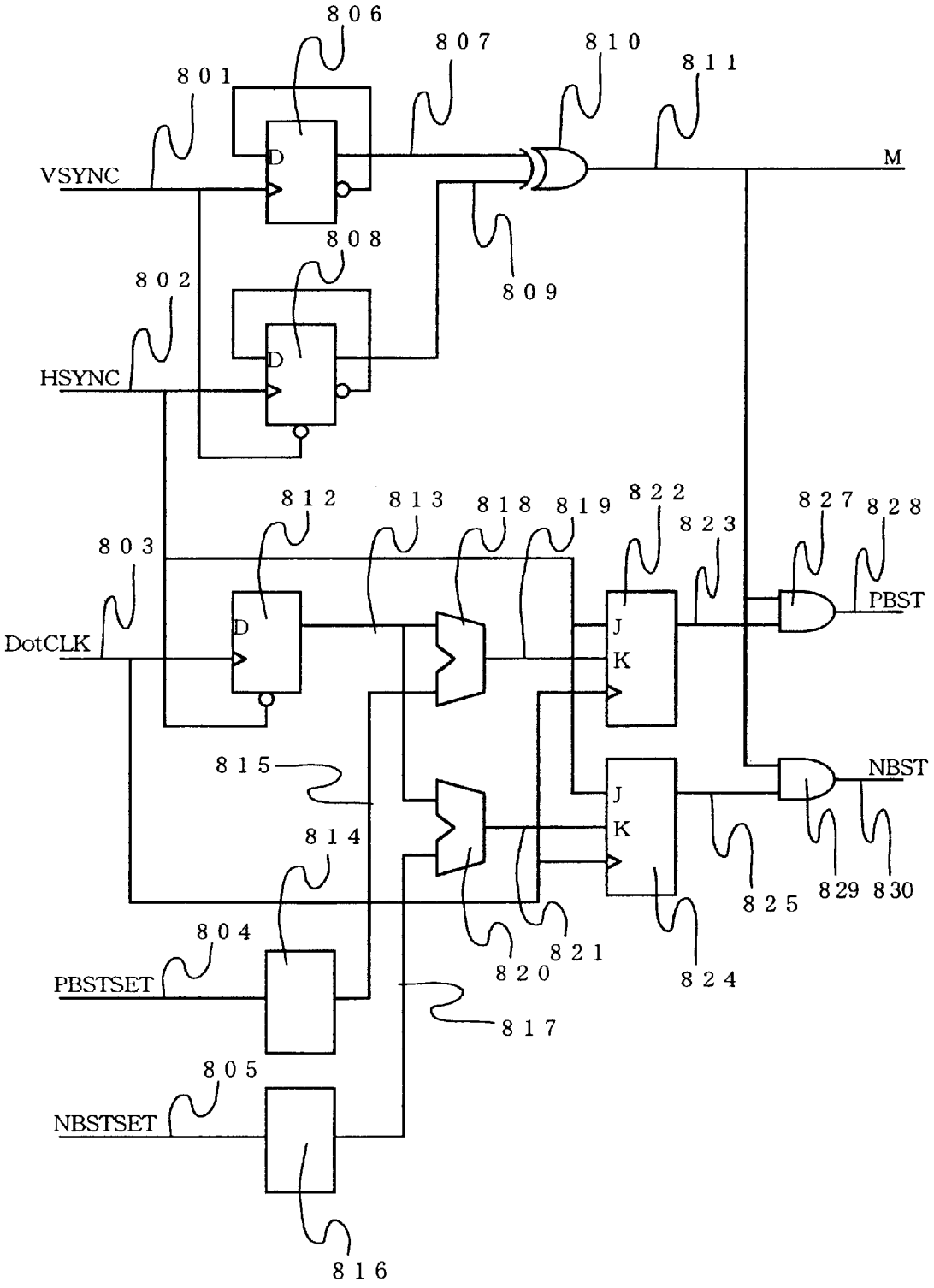
FIG. 13 is a block diagram for illustrating an alternating circuit and a correcting circuit according to the present invention.
Figure 14:
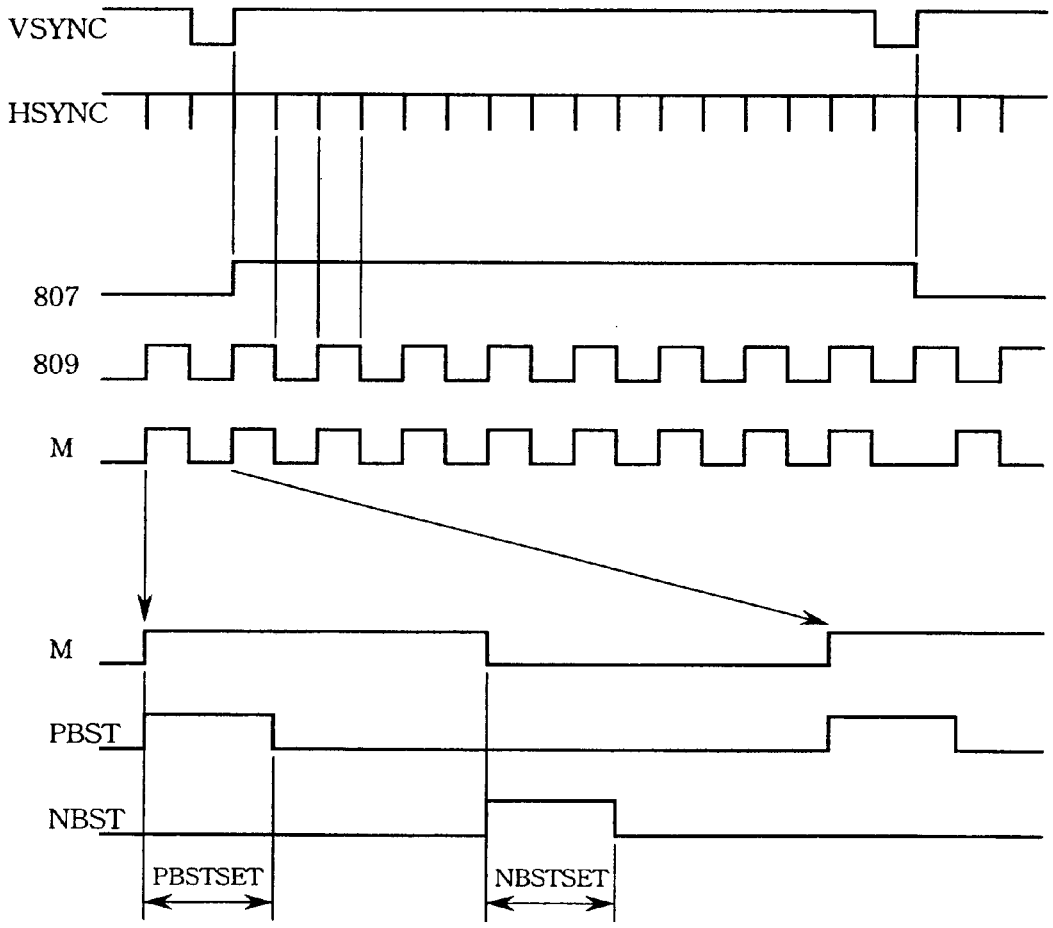
FIG. 14 is a timing chart diagram for illustrating operations of the alternating circuit and the correcting circuit according to the present invention.
Figure 15:
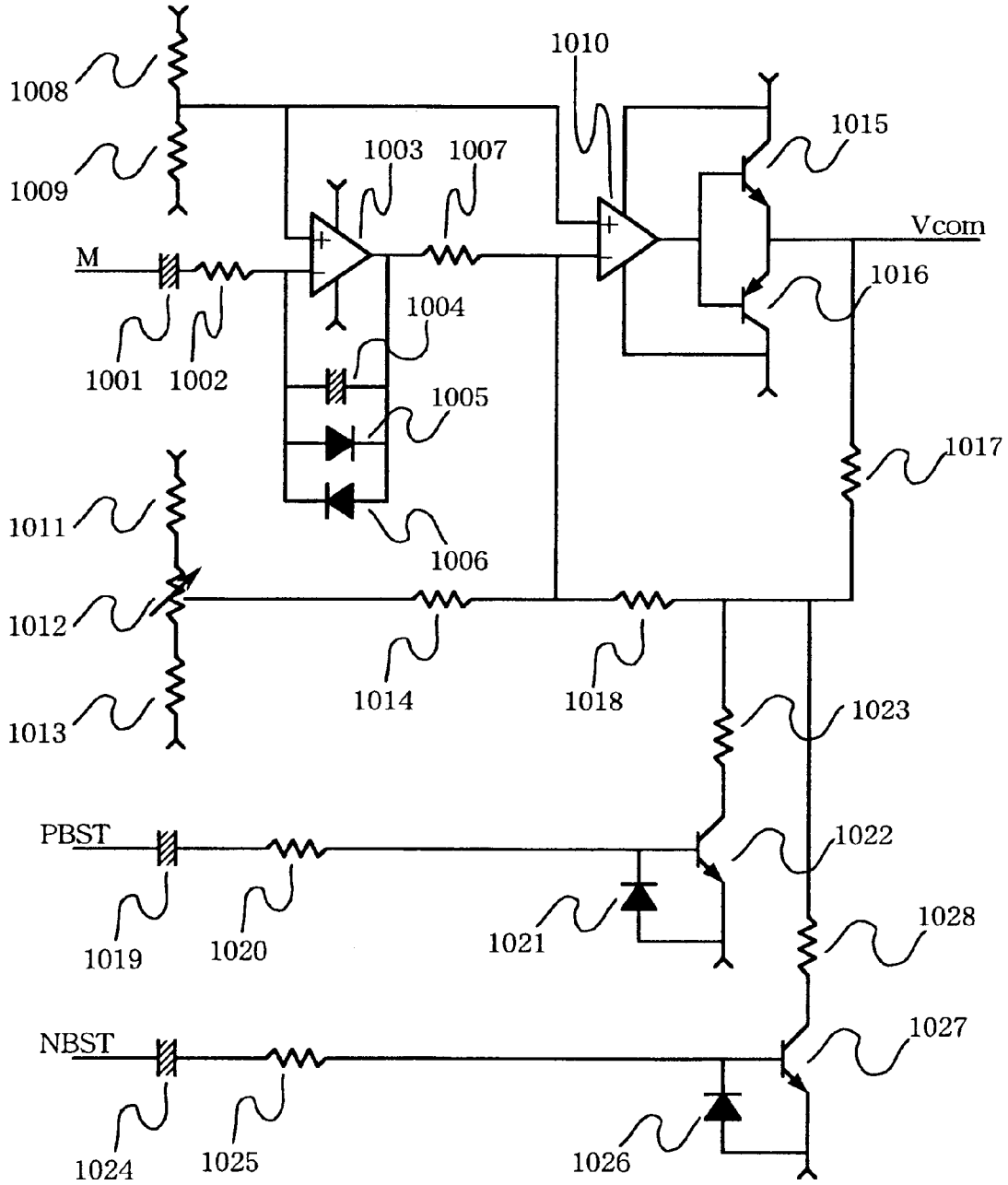
FIG. 15 is a diagram for illustrating an opposed electrode voltage generating circuit according to the present invention.
Figure 16:
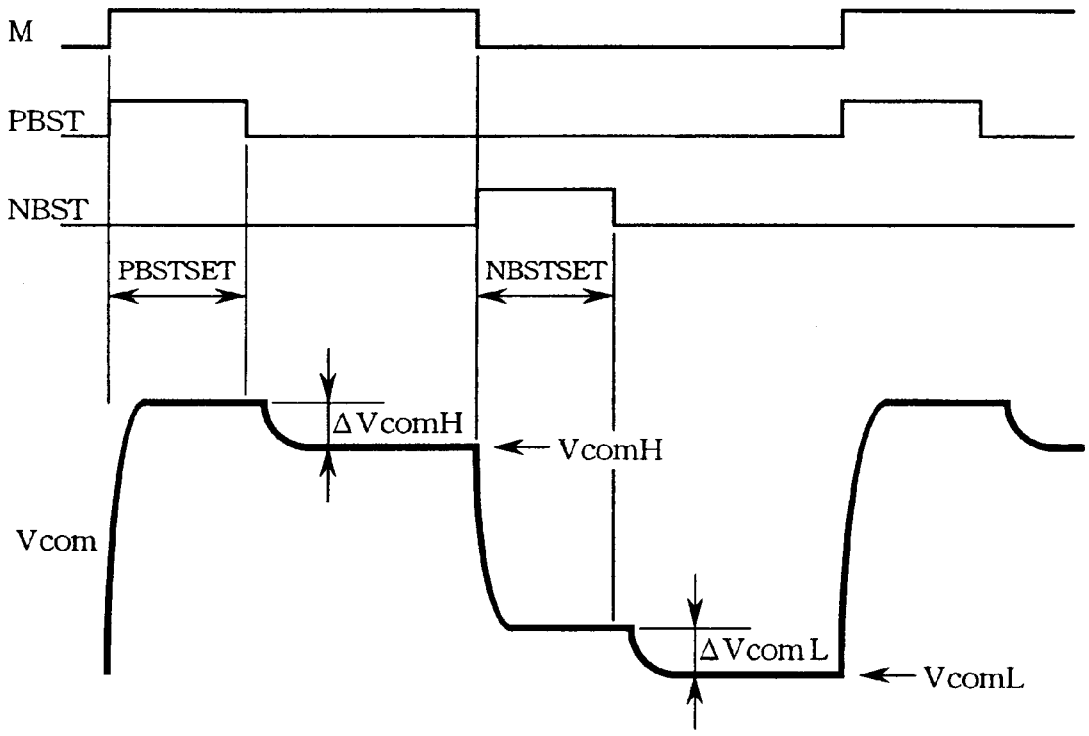
FIG. 16 is a driving waveform diagram for illustrating an operation of the opposed electrode voltage generating circuit according to the present invention.

FIG. 1 is a block diagram for illustrating the liquid crystal display in the present invention. FIG. 13 illustrates a liquid crystal-applying voltage alternating signal generating circuit and a correcting voltage time-period signal generating circuit within an interface circuit according to the present invention. FIG. 14 is a timing chart diagram for explaining operations of the liquid crystal-applying voltage alternating signal generating circuit and the correcting voltage time-period signal generating circuit illustrated in FIG. 13. FIG. 15 illustrates an opposed electrode voltage Vcom generating circuit. FIG. 16 is a timing chart diagram for explaining an operation of an opposed electrode voltage Vcom that the opposed electrode voltage Vcom generating circuit generates. Also, FIGS. 17A, 17B and FIGS. 18A, 18B are driving waveform diagrams for explaining the operations in the present invention.

In FIG. 1, a reference numeral 101 denotes an interface signal including display data and a synchronization signal that are transferred from a system (not illustrated). A numeral 102 denotes the interface circuit for generating display data and control signals that drive the liquid crystal display in the present invention. A numeral 103 denotes a signal driving circuit for generating a tone voltage corresponding to the display data. A numeral 104 denotes a scan driving circuit for selecting scanning lines in sequence. A numeral 105 denotes a power supply circuit. Also, a numeral 106 denotes a liquid crystal panel on which there is executed a display corresponding to the display data.

Of the control signals that the interface circuit 102 generates, a numeral 107 denotes a control signal that controls the signal driving circuit 103 and includes the display data and the synchronization signal. A numeral 108 denotes a control signal that controls the scan driving circuit 104 and transfers a timing signal for scanning the scanning lines in sequence. A numeral 109 denotes a liquid crystal-applying voltage alternating signal "M" that is transferred to the power supply circuit 105. Also, numerals 110, 111 denote control signals that transfer a correcting voltage time-period signal for indicating a time-period during which a correcting voltage is applied.

Of the voltage signals that the power supply circuit 105 generates, a numeral 112 denotes a tone voltage signal transferred to the signal driving circuit 103. The tone voltage signal 112 transfers a voltage that functions as a reference voltage of the tone voltage corresponding to the display data transferred to the liquid crystal panel 106. A numeral 113 denotes a scanning voltage signal transferred to the scan driving circuit 104. A numeral 114 denotes an opposed electrode voltage feeding line that feeds the opposed electrode voltage Vcom into an opposed electrode 119*c* of a liquid crystal 119 and an opposed electrode 120*c* of a compensation capacitor 120. Moreover, a numeral 115 denotes a group of signal lines for transferring the tone voltage corresponding to the display data. A numeral 116 denotes a group of scanning lines for transferring a scanning voltage that switches each of the scanning lines into a selection or a non-selection state. A numeral 117 denotes pixels constituting the liquid crystal panel 106. The pixels 117 are formed at the intersection points of the group of signal lines 115 and the group of scanning lines 116, and accordingly the liquid crystal panel 106 has a matrix structure. In addition, reference numerals within each of the pixels 115 denote the following components: 118 a thin film transistor (hereinafter, referred to as "TFT"), i.e., a switching element, 119 the liquid crystal, 120 the compensation capacitor, 121 a source electrode, 122 a between-gate/source parasitic capacitor configured between the scanning line (this is also referred to as "gate line") 116 and the source electrode 121. Also, a numeral 123 denotes a setting circuit for setting the time-period during which the correcting voltage is applied, and a numeral 124 denotes a setting signal that the setting circuit 123 outputs.

In FIG. 13, a reference numeral 801 denotes a vertical synchronization signal VSYNC, which becomes effective at a ratio of one time in one frame. A numeral 802 denotes a horizontal synchronization signal VSYNC, which becomes effective at a ratio of one time during one horizontal time-period. A numeral 803 denotes a dot clock DotCLK, which has an operation frequency in synchronization with the display data. A numeral 804 denotes a signal PBSTSET for setting a correcting voltage time-period that becomes effective when the opposed electrode voltage Vcom exhibits positive polarity. A numeral 805 denotes a signal NBSTSET for setting a correcting voltage time-period that becomes effective when the opposed electrode voltage Vcom exhibits negative polarity.

A numeral 811 denotes the liquid crystal-applying voltage alternating signal M, which applies a tone voltage with positive polarity and a tone voltage with negative polarity to the liquid crystal panel 106 and is inverted for each horizontal period. A numeral 828 denotes a signal PBST for setting the correcting voltage time-period that becomes effective when the opposed electrode voltage Vcom exhibits positive polarity. A numeral 830 denotes a signal NBST for setting the correcting voltage time-period that becomes effective when the opposed electrode voltage Vcom exhibits negative polarity.

Numerals 806, 808 denote flip-flop circuits. The flip-flops 806, 808 have functions of dividing the vertical synchronization signal 801 and the horizontal synchronization signal 802, respectively, thus generating division signals 807, 809, respectively. A numeral 810 denotes an Exclusive-OR logical circuit. A numeral 812 denotes a counter, which is brought into a reset state by the horizontal synchronization signal 802 and counts up in synchronization with the dot clock 803. A numeral 813 denotes an output signal from the counter 812. Numerals 814, 816 denote decoding circuits that decode set values set by PBSTSET 804, NBSTSET 805, respectively. Numerals 815, 817 denote output signals from the respective decoding circuits. Numerals 818, 820 denote comparing circuits that generate effective pulses at the time when a counted value outputted by the counter 812 coincides with decoded values outputted by the decoding circuits. Numerals 819, 821 denote output signals that transfer the effective pulses generated by the comparing circuits 818, 820, respectively. Numerals 822, 824 denote JK flip-flop circuits, which perform an operation of being set if the horizontal synchronization signal 802 becomes effective and an operation of being reset if the effective pulses are outputted to the output signals 819, 821. Numerals 823, 825 denote output signals from the JK flip-flop circuits 822, 824. Numerals 827, 829 denote AND circuits. The AND circuits 827, 829 perform the logical gate operation with the alternating signal 811, thereby generating the control signals, i.e., PBST 828, NBST 830.

FIG. 14 is the timing chart diagram for indicating operations of the circuits that generate the respective timing signals illustrated in FIG. 13.

In FIG. 15, a numeral 1001 denotes a capacitor for making effective only an alternating voltage component of the liquid crystal-applying voltage alternating signal M and cutting a direct voltage component thereof. A numeral 1002 denotes a resistor for receiving an output from the capacitor 1001. A numeral 1003 denotes a buffer amplifier for amplifying a driving capability of the alternating signal M the direct voltage component of which has been cut. A numeral 1004 denotes a capacitor used in a feedback system of the buffer amplifier 1003. Numerals 1005, 1006 denote diodes used in the feedback system of the buffer amplifier 1003. A numeral 1007 denotes a resistor for determining a value of an output current from the buffer amplifier. Numerals 1008, 1009 denote voltage-dividing resistors for generating a reference voltage. A numeral 1010 denotes a buffer amplifier for alternating the opposed electrode voltage Vcom. Numerals 1011, 1012 and 1013 denote resistors and a volume resistor that set a reference voltage of the opposed electrode voltage Vcom. A numeral 1014 denotes a resistor that is provided for an output from the volume resistor and determines a value of the current. Numerals 1015, 1016 denote buffer transistors for amplifying a current of the buffer amplifier 1010. Numerals 1017, 1018 denote resistors provided in a feedback system consisting of the buffer amplifier 1010 and the buffer transistors 1015, 1016. A numeral 1019 denotes a capacitor for making effective only an alternating voltage component of the opposed electrode voltage Vcom correcting voltage time-period signal "PBST" and cutting a direct voltage component thereof. A numeral 1020 denotes a resistor for receiving an output from the capacitor 1019. Numerals 1021, 1022, and 1023 denote a diode, a transistor performing a switching operation, and a resistor, respectively. When PBST is positioned at a "High" level, the transistor 1022 is switched into an "ON" state, then performing an operation of pulling in a current included in the feedback system consisting of the buffer amplifier 1010 and the buffer transistors 1015, 1016.

A numeral 1024 denotes a capacitor for making effective only an alternating voltage component of the opposed electrode voltage Vcom correcting voltage time-period signal "NBST" and cutting a direct voltage component thereof. A numeral 1025 denotes a resistor for receiving an output from the capacitor 1024. Numerals 1026, 1027, and 1028 denote a diode, a transistor performing a switching operation, and a resistor, respectively. When NBST is positioned at a "High" level, the transistor 1027 is switched into an "ON" state, then performing an operation of pulling in the current included in the feedback system consisting of the buffer amplifier 1010 and the buffer transistors 1015, 1016.

In FIG. 16, Vcom denotes the opposed electrode voltage applied to the opposed electrode voltage feeding line using the embodiment in the present invention. FIG. 16 illustrates the manner in which correcting voltages are applied at the time when the correcting voltage time-period signals PBST, NBST are at the "High" level. When the opposed electrode voltage Vcom is transitioned to a higher electric potential voltage, Vcom is positioned at a higher electric potential level by the amount of ΔVcomH as compared with VcomH, i.e., a predetermined opposed electrode voltage level. Also, when the opposed electrode voltage Vcom is transitioned to a lower electric potential voltage, Vcom is positioned at a higher electric potential level by the amount of ΔVcomL as compared with VcomL, i.e., a predetermined opposed electrode voltage level. The correcting voltage applying time-period, i.e., the time-period during which the correcting voltages are applied, is adjustable in correspondence with the load onto the liquid crystal panel.

Figure 17A:
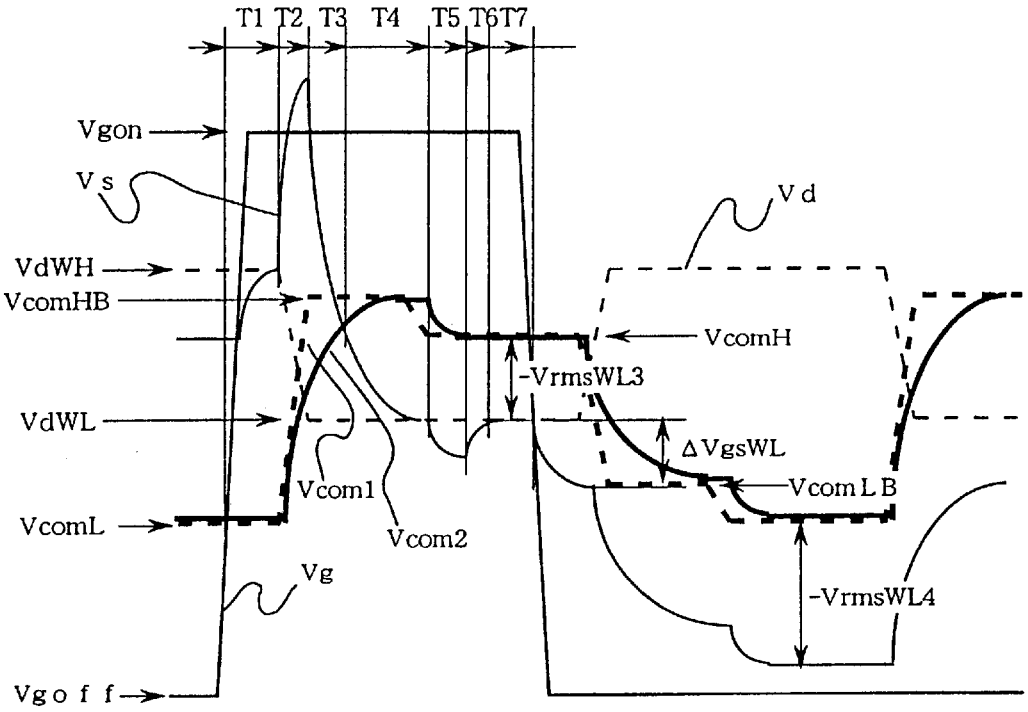
FIGS. 17A, 17B illustrate driving waveform diagrams in the liquid crystal display according to the present invention.
Figure 17B:
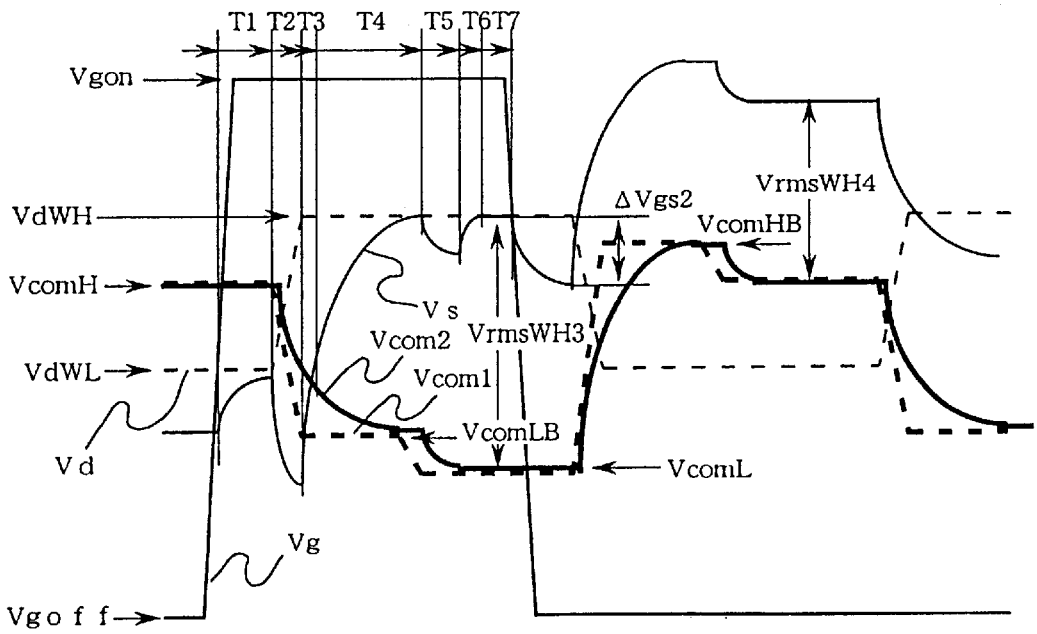

FIGS. 17A, 17B illustrate operations of applying the white display voltage according to the present embodiment. FIG. 17A illustrates an example where the tone voltage with negative polarity is applied. FIG. 17B illustrates an example where the tone voltage with positive polarity is applied. In FIG. 17A, a reference notation Vg denotes a voltage waveform applied to the respective scanning lines. In addition, Vgon denotes a selection voltage level, and Vgoff denotes a non-selection voltage level. Vd indicates a tone voltage waveform applied to the respective signal lines. VdWH denotes a white display voltage with positive polarity, and VdWL denotes a white display voltage with negative polarity. Vcom 1 denotes an opposed electrode voltage waveform inputted into the liquid crystal panel 106, and Vcom 2 denotes the opposed electrode voltage waveform inside the liquid crystal panel 106. Moreover, VcomHB is an opposed electrode voltage resulting from adding the correcting voltage ΔVcomH to VcomH, i.e., a normal opposed electrode voltage level with positive polarity. Similarly, VcomLB is an opposed electrode voltage resulting from adding the correcting voltage ΔVcomL to VcomL, i.e., a normal opposed electrode voltage level with negative polarity. vs denotes a source voltage waveform of the source electrode 121 in the pixel 118 inside the liquid crystal panel 106. Also, the reference notations in FIG. 17B are the same as those in FIG. 17A.

Figure 18A:
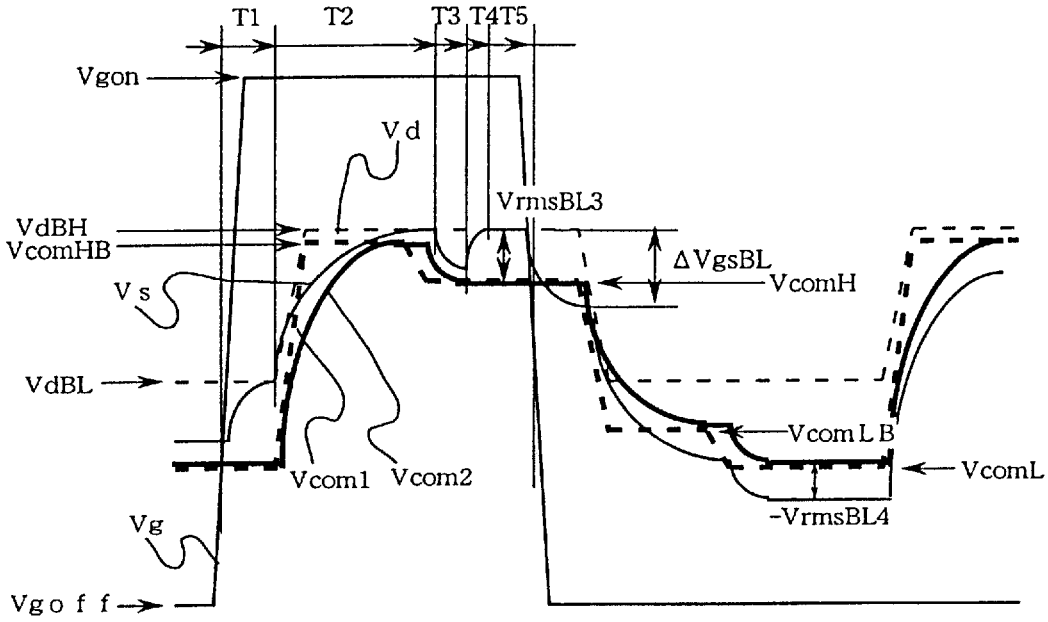
FIGS. 18A, 18B illustrate driving waveform diagrams in the liquid crystal display according to the present invention.
Figure 18B:
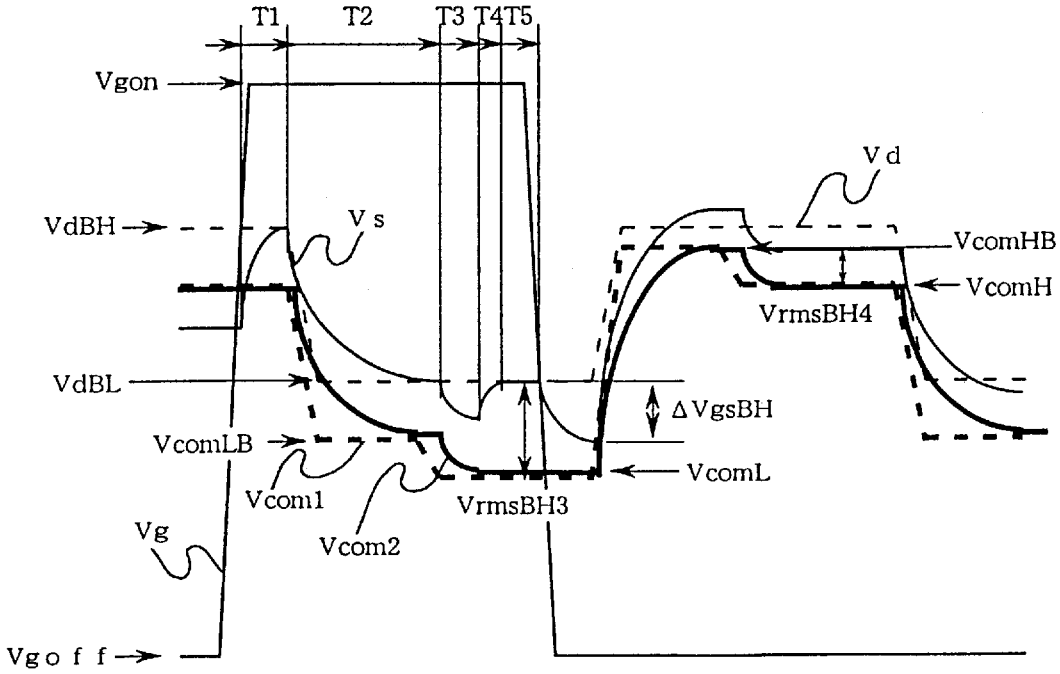

FIGS. 18A, 18B illustrate operations of applying the black display voltage according to the present embodiment. FIG. 18A illustrates an example where the tone voltage with negative polarity is applied. FIG. 18B illustrates an example where the tone voltage with positive polarity is applied. Vd indicates a tone voltage waveform applied to the respective signal lines. In addition, VdBH denotes a black display voltage with positive polarity, and VdBL denotes a black display voltage with negative polarity. Also, the other reference notations are the same as those illustrated in FIGS. 17A, 17B.

Referring to FIG. 1 once again, the explanation will be given below concerning the detailed operation of the embodiment according to the present invention.

The interface circuit 102 inputs the display data and the synchronization signal transferred by the interface signal 101. Then, the interface circuit 102 generates the control signal 107 for controlling the signal driving circuit 103, the control signal 108 for controlling the scan driving circuit 104, the liquid crystal-applying voltage alternating signal M 109 for controlling the power supply circuit 105, and the control signals 110, 111.

Figure 2:
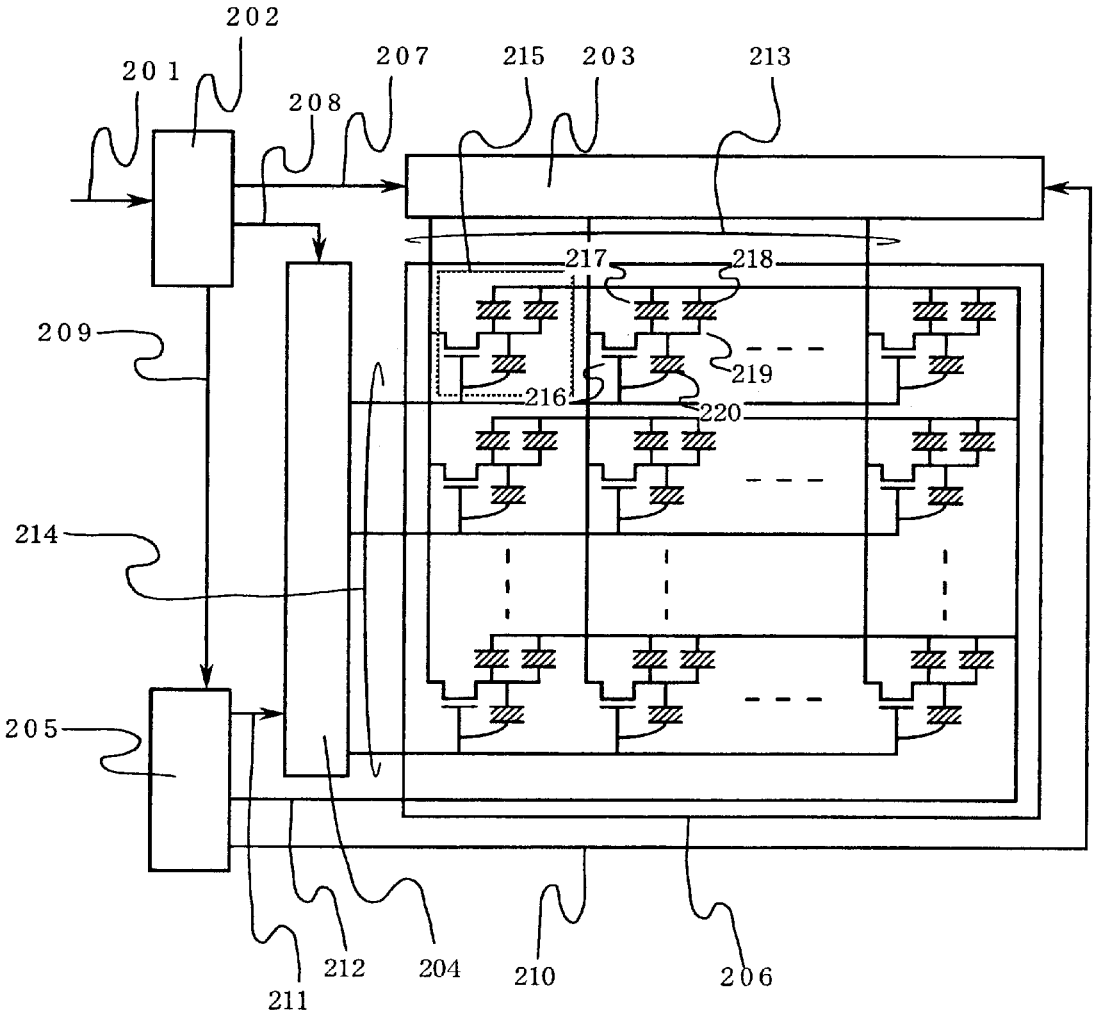
FIG. 2 PRIOR ART
FIG. 2 is a block diagram for illustrating a conventional liquid crystal display.
Figure 3A:
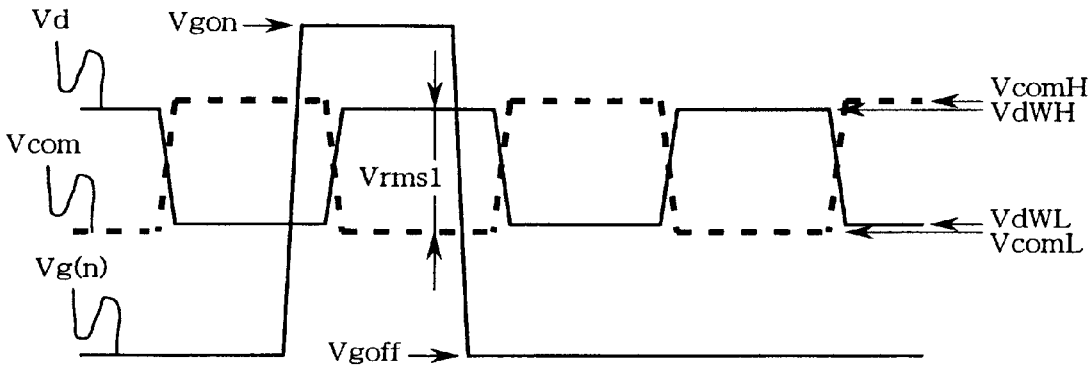
FIG. 3A PRIOR ART
FIGS. 3A, 3B illustrate driving waveform diagrams in the conventional liquid crystal display.
Figure 3B:
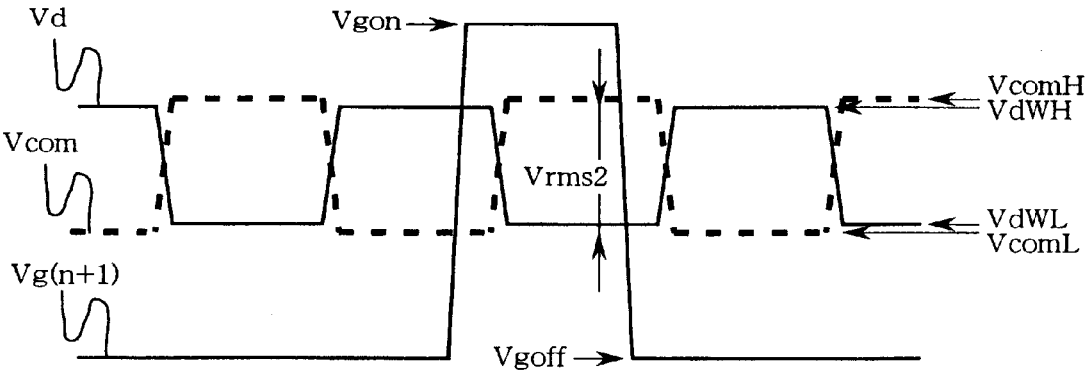
FIG. 3B PRIOR ART
Figure 4A:
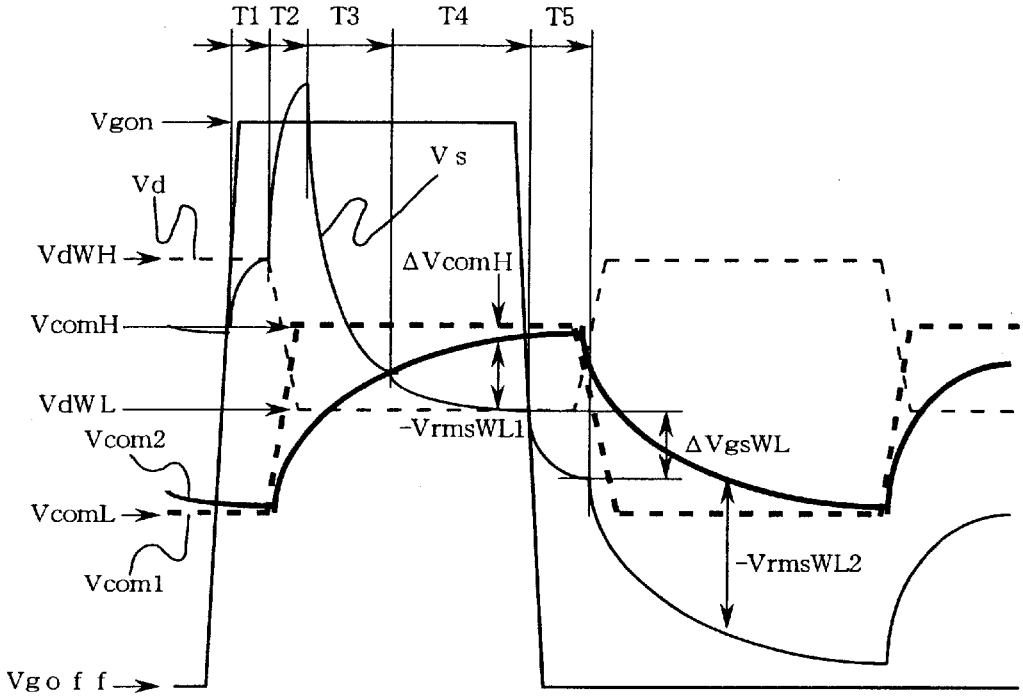
FIG. 4A PRIOR ART
FIGS. 4A, 4B illustrate driving waveform diagrams in the conventional liquid crystal display.
Figure 4B:
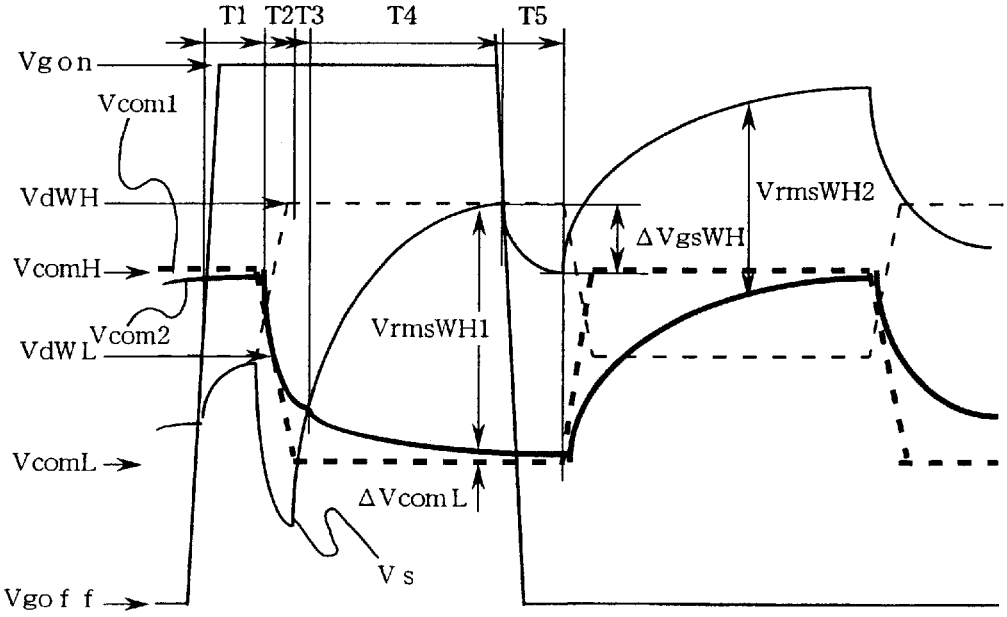
FIG. 4B PRIOR ART
Figure 5A:
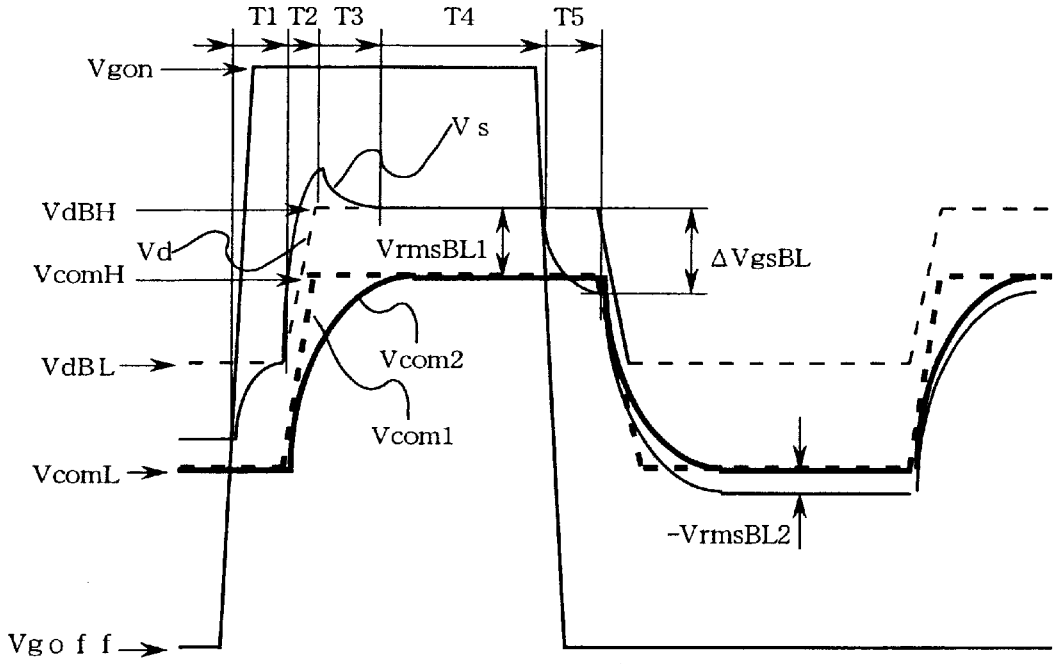
FIG. 5A PRIOR ART
FIGS. 5A, 5B illustrate driving waveform diagrams in the conventional liquid crystal display.
Figure 5B:
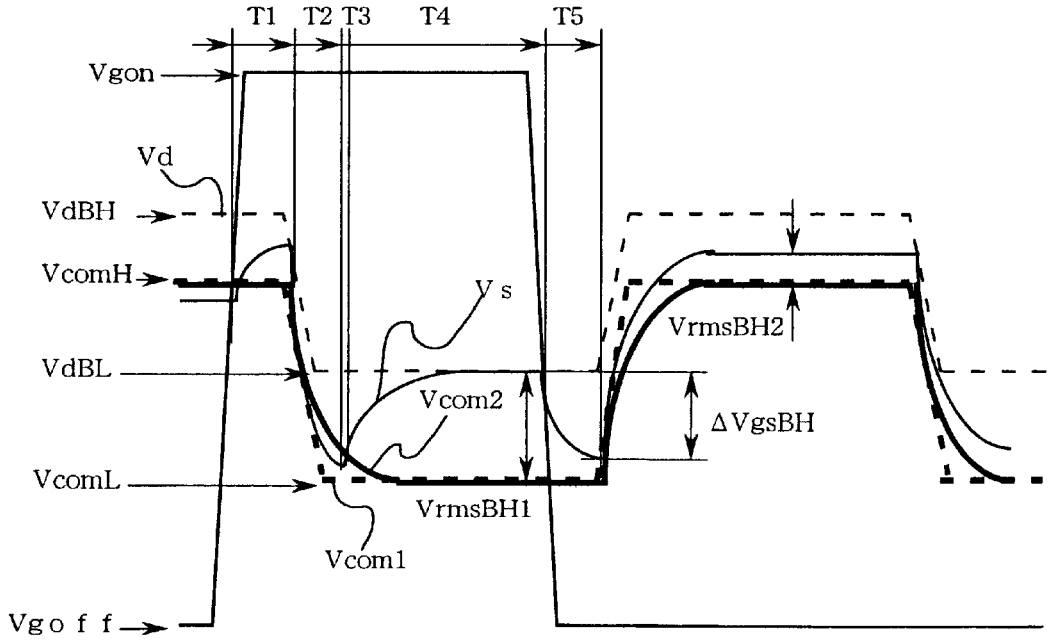
FIG. 5B PRIOR ART

The signal driving circuit 103 fetches in sequence the display data by the amount of one horizontal line. Then, after fetching the display data by the amount of one horizontal line, the signal driving circuit 103 outputs, simultaneously from the group of signal lines 115, the tone voltage corresponding to the fetched display data by the amount of one horizontal line. The signal driving circuit 103 continues outputting the tone voltage by the amount of one horizontal line during one horizontal time-period. Also, at this time, in parallel to the continuous outputting of the tone voltage, the signal driving circuit 103 executes an operation of fetching in sequence the display data of the next horizontal line. Accordingly, it turns out that the display data that the interface circuit 102 outputs is converted into the tone voltage, then being outputted to the liquid crystal panel 106 during the next horizontal time-period. The signal driving circuit 103 repeats this operation, thereby outputting, to the liquid crystal panel 106, the tone voltage corresponding to the display data by the amount of one frame, i.e., by the amount of one screen. Also, the tone voltage that the signal driving circuit 103 outputs is generated by employing, as a reference voltage, the tone voltage transferred by the tone voltage line 112. In general, the reference voltage of the tone voltage transferred by the tone voltage line 112 is a voltage including a plurality of levels that range from the voltage for the black display to the voltage for the white display. Thus, the present embodiment will also be described in the same manner. Furthermore, the scan driving circuit 104 synchronizes with the control signal 108, thus applying a selection voltage to the group of scanning lines 116 from the 1st line in sequence. At this time, the selection voltage is applied to the TFT 118 in each of the pixels 117. As the result, the TFT 118 is switched into the selection state, thereby applying the tone voltage, which is transferred from each of the group of signal lines 115, to the liquid crystal 119 and the compensation capacitor 120. Then, if a non-selection voltage is applied to each of the scanning lines 116, the resultant non-selection state is maintained until it is switched back into the selection state next. In this way, in the liquid crystal display, the scanning toward the pixels 117 forming the matrix structure is controlled in the sequence of the lines, and an amount of the light passing through the liquid crystal is controlled at the voltage level applied to the liquid crystal 119. These controls have made it possible to embody the tone display. Incidentally, the fundamental operations up to this point are basically the same as those in the conventional liquid crystal display (FIG. 2, FIGS. 3A, 3B).

The characteristic of the present invention lies in adding the circuits for correcting the opposed electrode voltage to the interface circuit 102 and the power supply circuit 105. Namely, as illustrated in FIG. 13, the flip-flop 806 divides the vertical synchronization signal, thereby generating the division signal 807 indicated in the timing chart illustrated in FIG. 14. Also, similarly, the flip-flop 808 divides the horizontal synchronization signal, thereby generating the division signal 809 indicated in the timing chart illustrated in FIG. 14. A signal generated as the result of inputting these two types of division signals into the Exclusive-OR logical circuit 810 is the liquid crystal-applying voltage alternating signal M.

Figure 9:
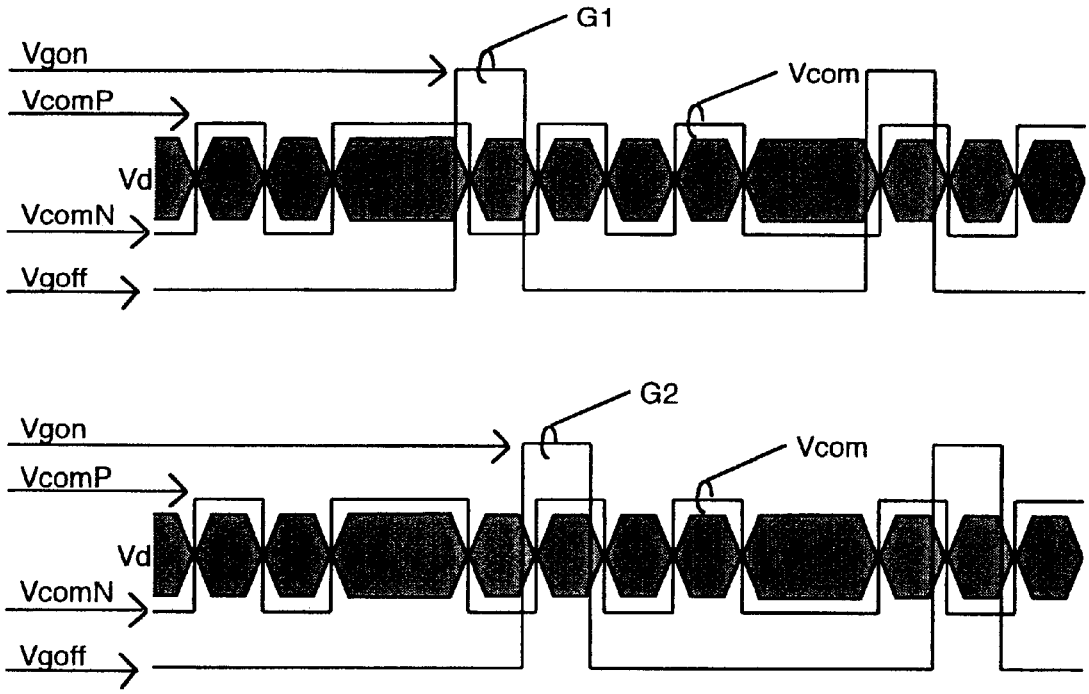
FIG. 9 PRIOR ART
FIG. 9 illustrates driving waveform diagrams in the conventional liquid crystal display.
Figure 10A:
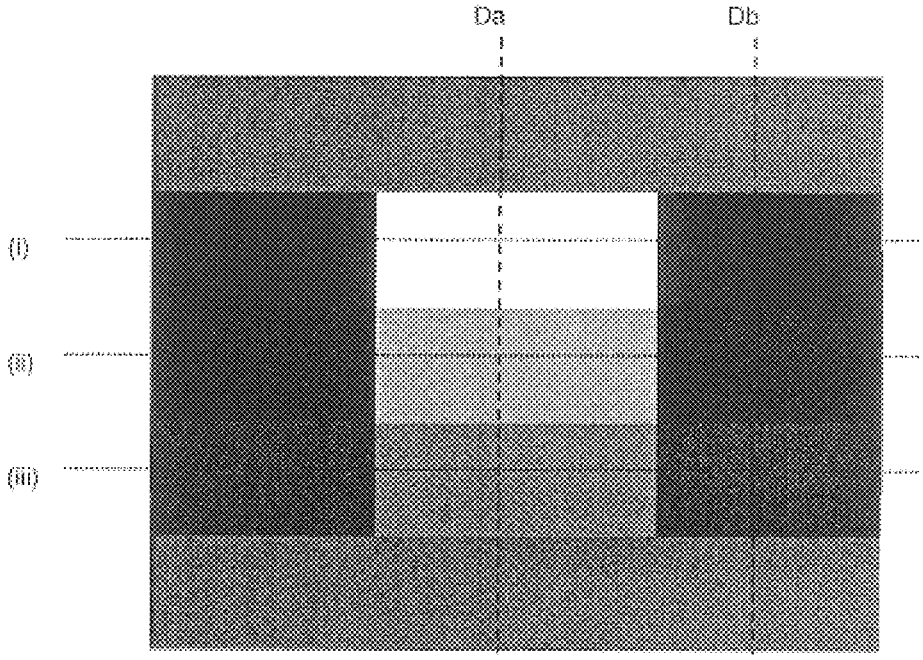
FIG. 10A PRIOR ART
FIGS. 10A, 10B illustrate explanatory diagrams for illustrating displayed examples in the conventional liquid crystal display.
Figure 10B:
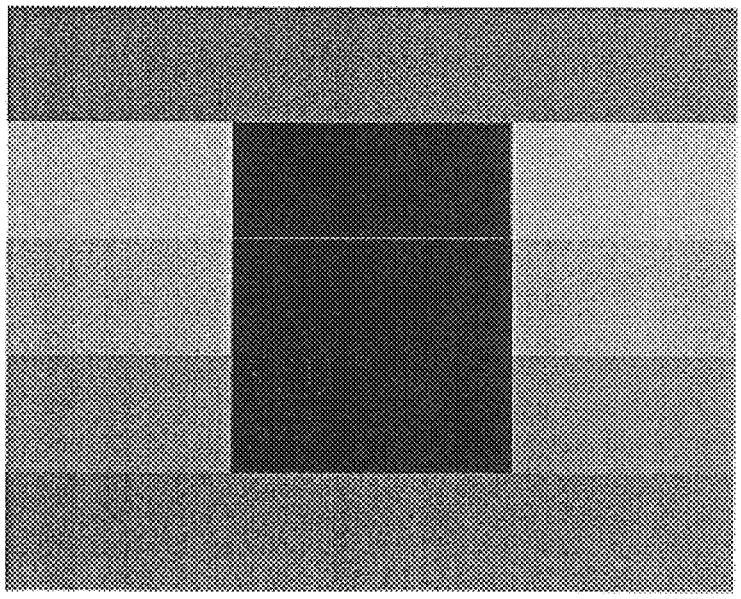
FIG. 10B PRIOR ART
Figure 11:
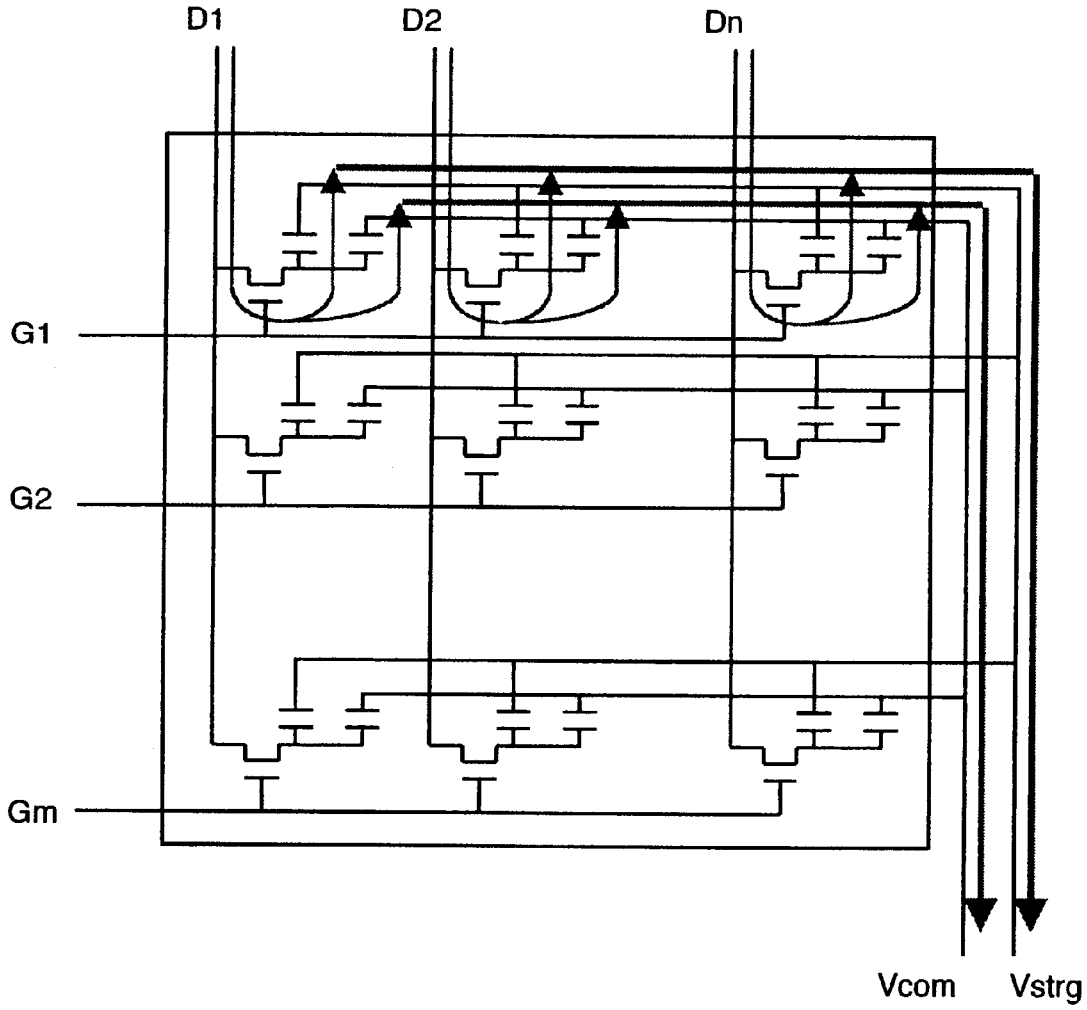
FIG. 11 PRIOR ART
FIG. 11 is an explanatory diagram for illustrating current paths in the conventional liquid crystal display.

Also, the counter 812, which the horizontal synchronization signal 802 resets, performs a count-up operation in accordance with the inputted dot clock 803. In synchronization with this count-up operation, the JK flip-flops 822, 824 are set. Making comparisons among the following three values: the counted value outputted by the counter 812, the decoded value obtained by decoding PBSTSET 804 by the decoding circuit 814 and the decoded value obtained by decoding NBSTSET 805 by the decoding circuit 816, the comparing circuits 818, 820 generate the effective pulses and transfer them to signal lines 819, 821. The effective pulses are then inputted into the JK flip-flops 822, 824 from the signal lines 819, 821, which allows the JK flip-flops 822, 824 to be reset. Consequently, it turns out that the time-period, which ranges from a timing with which the horizontal synchronization signal 802 has been inputted to a timing with which the effective pulses in the signal lines 819, 821 become effective, is the time-period during which the correcting voltages are to be applied. Then, the AND circuits 827, 829 execute a mask processing, and when the alternating signal 811 exhibits positive polarity, the result is reflected upon PBST 828 and when the alternating signal 811 exhibits negative polarity, the result is reflected upon NBST 830. FIG. 9 illustrates the manner of this processing. Incidentally, both of the setting signals PBSTSET 804, NBSTSET 805 for setting the correcting voltage time-period are included in the signal 124 illustrated in FIG. 1. In addition, the setting circuit 123 permits the pulse widths of the setting signals to be changed easily in accordance with the load condition imposed onto the liquid crystal panel 106.

Next, referring to FIG. 15, the explanation will be given below regarding the generation of the opposed electrode voltages Vcom to which the correcting voltages illustrated in FIG. 16 have been added.

When a voltage with positive polarity ("High" level voltage) is inputted into the liquid crystal-applying voltage alternating signal M, the capacitor 1001 cuts the direct voltage component thereof. Then, an electric current flows through the capacitor 1004 and the resistor 1002, and thus an output from the buffer amplifier 1003 is gradually decreased. Moreover, if the electric potential difference between both ends of the capacitor 1004 exceeds a forward direction voltage of the diode 1006, the diode 1006 is brought into conduction. As the result, the output voltage becomes a fixed voltage value on the lower electric potential side. Also, when a voltage with negative polarity ("Low" level voltage) is inputted into the alternating signal M, the capacitor 1001 cuts the direct voltage component thereof. Then, an electric current flows in a direction opposite to the voltage with positive polarity ("High" level voltage) through the capacitor 1004 and the resistor 1002, and thus the output from the buffer amplifier 1003 is gradually increased. Moreover, if the electric potential difference between both ends of the capacitor 1004 exceeds a forward direction voltage of the diode 1005, the diode 1005 is brought into conduction. As the result, the output voltage becomes a fixed voltage value on the higher electric potential side. Repeating the above-described processes makes it possible to obtain an alternated voltage waveform as the output voltage of the buffer amplifier 1003. At this time, the reference voltage that the resistors 1008, 1009 generate is employed as the central voltage level of the alternating. Also, by causing this alternated voltage waveform to pass through the resistor 1007, the waveform is also varied as a current value. The varied current value is inputted into a negative polarity input terminal portion of the buffer amplifier 1010, then being amplified and outputted. At the negative polarity input terminal portion of the buffer amplifier 1010, the principle of imaginary short-circuit results in a coincidence among quantities of the following three electric currents: the current passing through the resistor 1007, a current passing through the resistor 1014, and a current passing through the resistors 1017, 1018. Accordingly, by controlling the current flowing through the feedback system consisting of the buffer amplifier 1010 and the buffer transistors 1015, 1016, it becomes possible to control the voltage value of the opposed electrode voltage Vcom. Namely, when the opposed electrode voltage Vcom is positioned at the positive polarity (higher electric potential) voltage level, the voltage of the correcting voltage time-period signal PBST is switched into the "High" level voltage. This procedure switches the transistor 1022 into the selection state, thereby causing a current to pass through the resistor 1023. At this time, the current passing through the resistor 1017 is separated into the two currents that pass through the resistors 1018, 1023, respectively. This condition decreases quantity of the current passing through the resistor 1018. Consequently, in order to permit more quantity of current to flow, the opposed electrode voltage Vcom shifts the opposed electrode voltage level up to the higher electric potential one. This makes it possible to apply the correcting voltage to the opposed electrode voltage Vcom. Also, the voltage of the correcting voltage time-period signal PBST is switched into the "Low" level voltage. This procedure switches the transistor 1022 into the non-selection state, thereby preventing the current from passing through the resistor 1023. At this time, there occurs an operation of reducing the current passing through the resistor 1018, and thus the opposed electrode voltage Vcom is shifted to the normal voltage level. Also, the operation based on the polarity of the correcting voltage time-period signal NBST is performed in much the same way.

Next, referring to the driving waveforms illustrated in FIGS. 17A, 17B and FIGS. 18A, 18B, the explanation will be given below regarding the detailed operations inside the liquid crystal panel 106 in the present embodiment.

The explanation will be given below concerning operations of the respective voltage waveforms in pursuit of time. When applying VdWL, i.e., the white display voltage with negative polarity illustrated in FIG. 17A, when the selection voltage Vgon is applied to the scanning line, during a time-period "T1", the source voltage Vs is transitioned to a voltage level of the drain voltage Vd in the previous line (Vs is shifted up to a higher electric potential.). After that, when the opposed electrode voltage is alternated during a time-period "T2", as illustrated in FIG. 17A, the electric potential of the source voltage Vs is shifted up to a higher electric potential in response to the alternating of the opposed electrode voltage. This is due to the fact that the variation in the opposed electrode voltage is steeper than writing speed of the TFT 118. At this time, in order to correct the voltage distortion, the voltage level of the opposed electrode voltage Vcom is corrected in advance up to a higher electric potential voltage level (VcomHB). After that, during time-periods "T3", "T4", the source voltage Vs is transitioned to the electric potential of the drain voltage Vd. Here, during the time-period "T3", the source voltage Vs lies in a higher electric potential state than the opposed electrode voltage Vcom 2 inside the liquid crystal panel 106, and during the time-period "T4", the source voltage Vs falls in a lower electric potential state than the opposed electrode voltage Vcom 2 inside the liquid crystal panel 106. In this operation, the source voltage electric potential is positioned at a considerably higher electric potential level as compared with the opposed electrode voltage electric potential. At this time, a correcting voltage is applied to the opposed electrode voltages Vcom 1, Vcom 2, thereby reducing the voltage distortion and aiming at an effect of enhancing the convergence rate. Next, during a time-period "T5", the opposed electrode voltages Vcom 1, Vcom 2 are transitioned to the normal opposed electrode voltage level (Vcom 1, Vcom 2 are shifted down to a lower voltage level side.). This causes the source electrode voltage Vs to be transitioned once to the lower electric potential side. After that, when the opposed electrode voltages Vcom 1, Vcom 2 are stabilized, the source voltage Vs is transitioned again to the drain voltage VdWL to be inputted. Then, during a time-period "T7", the opposed electrode voltage Vcom 2 and the source voltage Vs are transitioned to the desired voltage levels. The effective voltage value to be applied to the liquid crystal 119 at this time becomes equal to VrmsWL3. Also, if the non-selection voltage is applied to the scanning line and thus the TFT 118 is transitioned to the "OFF" state, there occurs the above-described diving phenomenon of the voltage into the parasitic capacitor 122. This diving voltage level becomes equal to ΔVgsWL. Thus, eventually, the resultant effective voltage value to be applied to the liquid crystal 119 becomes equal to −VrmsWL4 (=−VrmsWL3−ΔVgsWL). This effective voltage value is the desired effective voltage value, because, as described above, the opposed electrode voltage Vcom 2 inside the liquid crystal panel 106 coincides with the desired opposed electrode voltage Vcom 1.

As explained above, the upwardly convex correcting voltage is applied to the positive polarity (higher electric potential) opposed electrode voltage Vcom described in the present embodiment. This procedure, accordingly, provides the effect of enhancing the convergence rate of the opposed electrode voltage Vcom 2 inside the liquid crystal panel 106.

Next, when applying VdWH, i.e., the white display voltage with positive polarity illustrated in FIG. 17B, when the selection voltage Vgon is applied to the scanning line, during a time-period "T1", the source voltage Vs is transitioned to a voltage level of the drain voltage Vd in the previous line (Vs is shifted up to a higher electric potential.). After that, when the opposed electrode voltage is alternated during a time-period "T2", as illustrated in FIG. 17B, the electric potential of the source voltage Vs is shifted down to a lower electric potential in response to the alternating of the opposed electrode voltage. This is due to the fact that the variation in the opposed electrode voltage is steeper than writing speed of the TFT 118. At this time, in order to correct the voltage distortion, the voltage level of the opposed electrode voltage Vcom is corrected in advance up to a higher electric potential voltage level (VcomLB). After that, during time-periods "T3", "T4", the source voltage Vs is transitioned to the electric potential of the drain voltage Vd. Here, during the time-period "T3", the source voltage vs lies in a lower electric potential state than the opposed electrode voltage Vcom 2 inside the liquid crystal panel 106, and during the time-period "T4", the source voltage Vs falls in a lower electric potential state than the opposed electrode voltage Vcom 2 inside the liquid crystal panel 106. In this operation, a correcting voltage is applied to the opposed electrode voltages Vcom 1, Vcom 2 so that the opposed electrode voltage electric potential is positioned at a higher electric potential level as compared with the normal opposed electrode voltage level. This accelerates convergence rate of the source voltage Vs, thereby, eventually, aiming at an effect of enhancing the convergence rate of the opposed electrode voltage Vcom 2. Next, during a time-period "T5", the opposed electrode voltages Vcom 1, Vcom 2 are transitioned to the normal opposed electrode voltage level (Vcom 1, Vcom 2 are shifted down to a lower voltage level side.). This causes the source electrode voltage Vs to be transitioned once to the lower electric potential side. After that, when the opposed electrode voltages Vcom 1, Vcom 2 are stabilized, the source voltage Vs is transitioned again to the drain voltage VdWH to be inputted. Then, during a time-period "T7", the opposed electrode voltage Vcom 2 and the source voltage Vs are transitioned to the desired voltage levels. The effective voltage value to be applied to the liquid crystal 119 at this time becomes equal to VrmsWH 3. Also, if the non-selection voltage is applied to the scanning line and thus the TFT 118 is transitioned to the "OFF" state, there occurs the above-described diving phenomenon of the voltage into the parasitic capacitor 122. This diving voltage level becomes equal to ΔVgsWH. Thus, eventually, the resultant effective voltage value to be applied to the liquid crystal 119 becomes equal to VrmsWH 4 (=VrmsWH3−ΔVgsWH). This effective voltage value is the desired effective voltage value, because, as described above, the opposed electrode voltage Vcom 2 inside the liquid crystal panel 106 coincides with the desired opposed electrode voltage Vcom 1.

As explained above, the upwardly convex correcting voltage is applied to the negative polarity (lower electric potential) opposed electrode voltage Vcom described in the present embodiment. This procedure, accordingly, enhances the writing speed, thereby providing the effect of enhancing the convergence rate of the opposed electrode voltage Vcom 2 inside the liquid crystal panel 106.

When applying VdBL, i.e., the black display voltage with negative polarity illustrated in FIG. 18A, when the selection voltage Vgon is applied to the scanning line, during a time-period "T1", the source voltage Vs is transitioned to a voltage level of the drain voltage Vd in the previous line (Vs is shifted up to a higher electric potential.). After that, when the opposed electrode voltage is alternated during a time-period "T2", since the variation in the opposed electrode voltage is steeper than the writing speed of the TFT 118, as illustrated in FIG. 18A, the electric potential of the source voltage Vs is shifted up to a higher electric potential in response to the alternating of the opposed electrode voltage, and is transitioned to the electric potential of the drain voltage Vd and stabilized. At this time, in order to make a voltage correction at the time of applying the white display voltage, the voltage level of the opposed electrode voltage Vcom is corrected in advance up to a higher electric potential voltage level (VcomHB). After that, during a time-period "T3", the opposed electrode voltages Vcom 1, Vcom 2 are transitioned to the normal opposed electrode voltage level (Vcom 1, Vcom 2 are shifted down to a lower voltage level side.). This causes the source electrode voltage Vs to be transitioned once to the lower electric potential side. After that, when the opposed electrode voltages Vcom 1, Vcom 2 are stabilized, the source voltage Vs is transitioned again to the drain voltage VdBL to be inputted. Then, during a time-period "T4", the opposed electrode voltage Vcom 2 and the source voltage Vs are transitioned to the desired voltage levels. The effective voltage value to be applied to the liquid crystal 119 at this time becomes equal to VrmsBL 3. Also, if the non-selection voltage is applied to the scanning line and thus the TFT 118 is transitioned to the "OFF" state, there occurs the above-described diving phenomenon of the voltage into the parasitic capacitor 122. This diving voltage level becomes equal to ΔVgsBL. Thus, eventually, the resultant effective voltage value to be applied to the liquid crystal 119 becomes equal to −VrmsBL4 (=VrmsBL3−ΔVgsBL). This effective voltage value is the desired effective voltage value, because, as described above, the opposed electrode voltage Vcom 2 inside the liquid crystal panel 106 coincides with the desired opposed electrode voltage Vcom 1.

Accordingly, even if the upwardly convex correcting voltage is applied to the positive polarity (higher electric potential) opposed electrode voltage Vcom described in the present embodiment, since amount of the writing voltage is small, there occurs no influence upon the effective voltage value.

Next, when applying VdBH, i.e., the black display voltage with positive polarity illustrated in FIG. 18B, when the selection voltage Vgon is applied to the scanning line, during a time-period "T1", the source voltage Vs is transitioned to a voltage level of the drain voltage Vd in the previous line (Vs is shifted up to a higher electric potential.). After that, when the opposed electrode voltage is alternated during a time-period "T2", since the variation in the opposed electrode voltage is steeper than the writing speed of the TFT 118, as illustrated in FIG. 18B, the electric potential of the source voltage Vs is shifted down to a lower electric potential in response to the alternating of the opposed electrode voltage, and is transitioned to the voltage level of the drain voltage Vd and stabilized. At this time, in order to apply the white display voltage, the voltage level of the opposed electrode voltage Vcom is corrected in advance up to a higher electric potential voltage level (VcomLB). After that, the source voltage Vs is transitioned to the electric potential of the drain voltage Vd. After that, during a time-period "T3", the opposed electrode voltages Vcom 1, Vcom 2 are transitioned to the normal opposed electrode voltage level (Vcom 1, Vcom 2 are shifted down to a lower voltage level side.). This causes the source electrode voltage Vs to be transitioned once to the lower electric potential side. After that, when the opposed electrode voltages Vcom 1, Vcom 2 are stabilized, the source voltage Vs is transitioned again to the drain voltage VdBH to be inputted. Then, during a time-period "T4", the opposed electrode voltage Vcom 2 and the source voltage Vs are transitioned to the desired voltage levels. The effective voltage value to be applied to the liquid crystal 119 at this time becomes equal to VrmsBH3. Also, if the non-selection voltage is applied to the scanning line and thus the TFT 118 is transitioned to the "OFF" state, there occurs the above-described diving phenomenon of the voltage into the parasitic capacitor 122. This diving voltage level becomes equal to ΔVgsBH. Thus, eventually, the resultant effective voltage value to be applied to the liquid crystal 119 becomes equal to VrmsBH4 (=VrmsBH3−ΔVgsBH). This effective voltage value is the desired effective voltage value, because, as described above, the opposed electrode voltage Vcom 2 inside the liquid crystal panel 106 coincides with the desired opposed electrode voltage Vcom 1.

Accordingly, even if the upwardly convex correcting voltage is applied to the positive polarity (higher electric potential) opposed electrode voltage Vcom described in the present embodiment, since amount of the writing voltage is small, there occurs no influence upon the effective voltage value.

As described above, the application of the correcting voltage to the opposed electrode voltage described in the present embodiment makes it possible to correct the waveform distortion in the opposed electrode voltage, thus allowing an excellent displayed screen to be obtained without depending on the display data.

Figure 19:
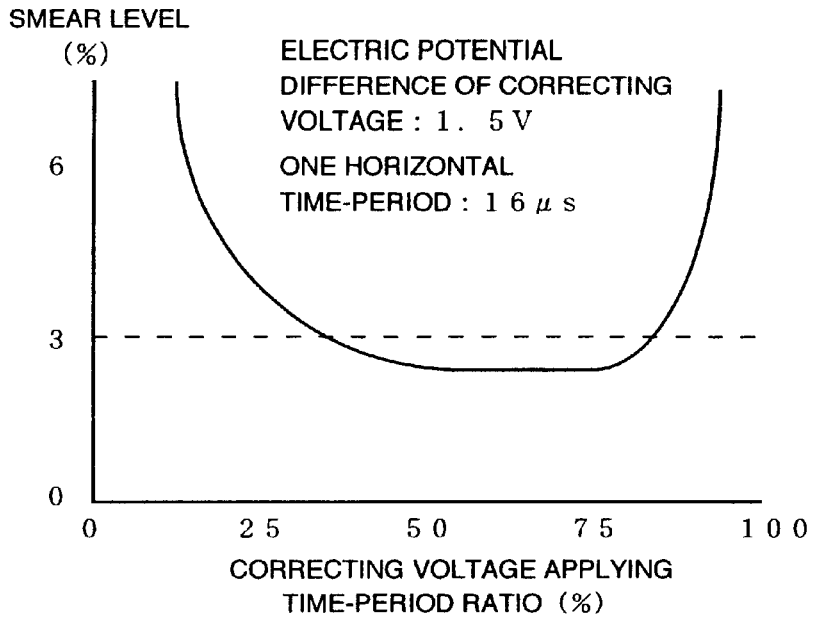
FIG. 19 is a graph for illustrating the relation between a smear level and a correcting voltage applying time-period in the present invention.
Figure 20:
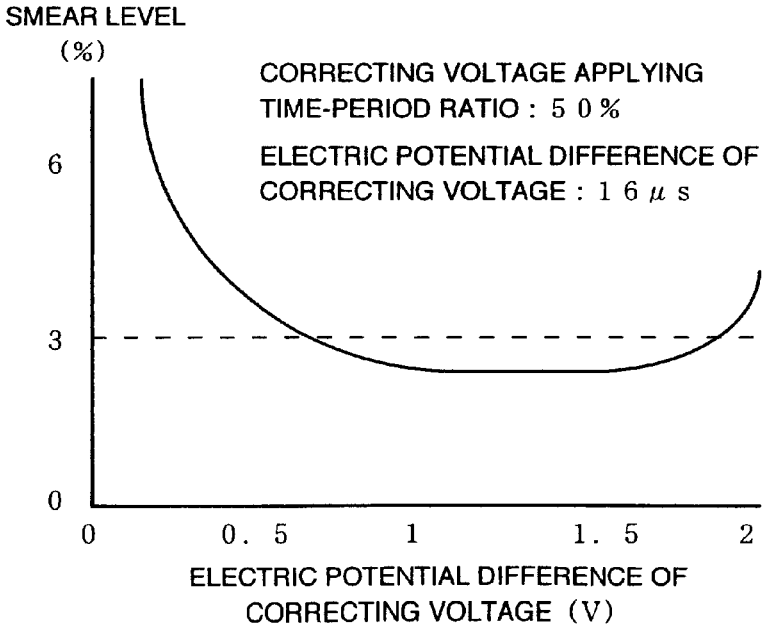
FIG. 20 is a graph for illustrating the relation between the smear level and amount of a correcting voltage in the present invention.

Next, let's consider the case where an opposed electrode voltage brought up to a higher electric potential level than an opposed electrode voltage level of the final purpose is once applied to the opposed electrode voltage Vcom. FIG. 19 illustrates the relation between a time during which the opposed electrode voltage brought up to the higher electric potential level is applied and amount of the variation in the luminance. Also, FIG. 20 illustrates the relation between the amount of the variation in the luminance and the electric potential difference between the opposed electrode voltage level of the final purpose and the opposed electrode voltage level brought up to the higher electric potential level once.

Figure 6:
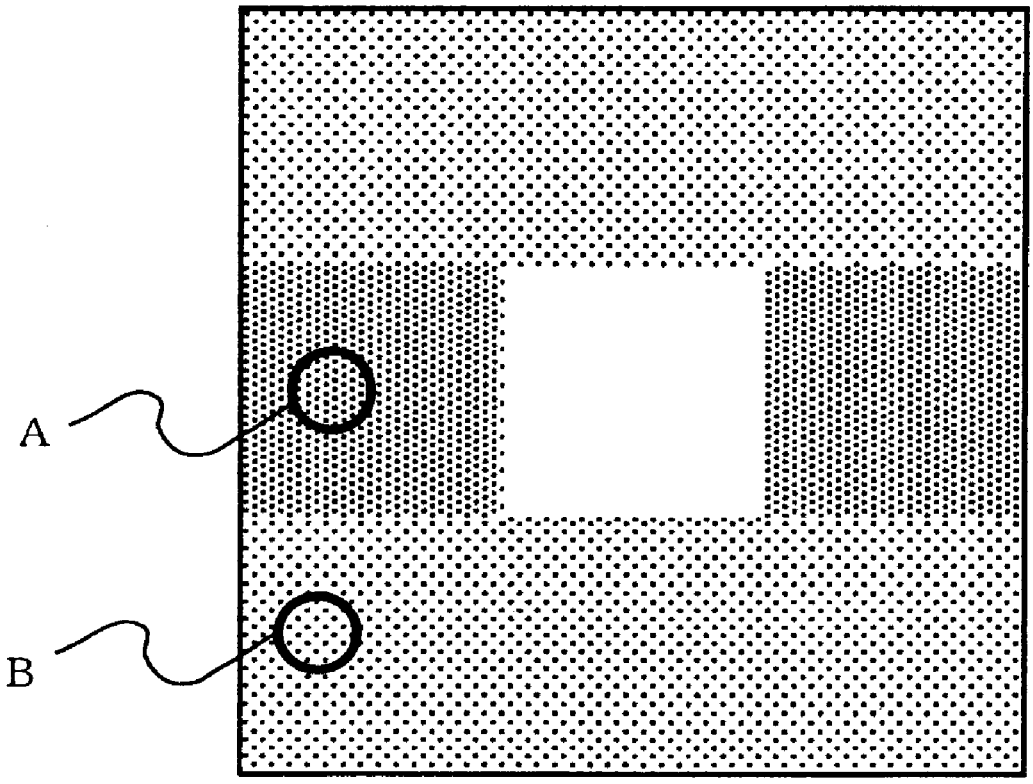
FIG. 6 PRIOR ART
FIG. 6 illustrates a displayed example in the conventional liquid crystal display.
Figure 7A:
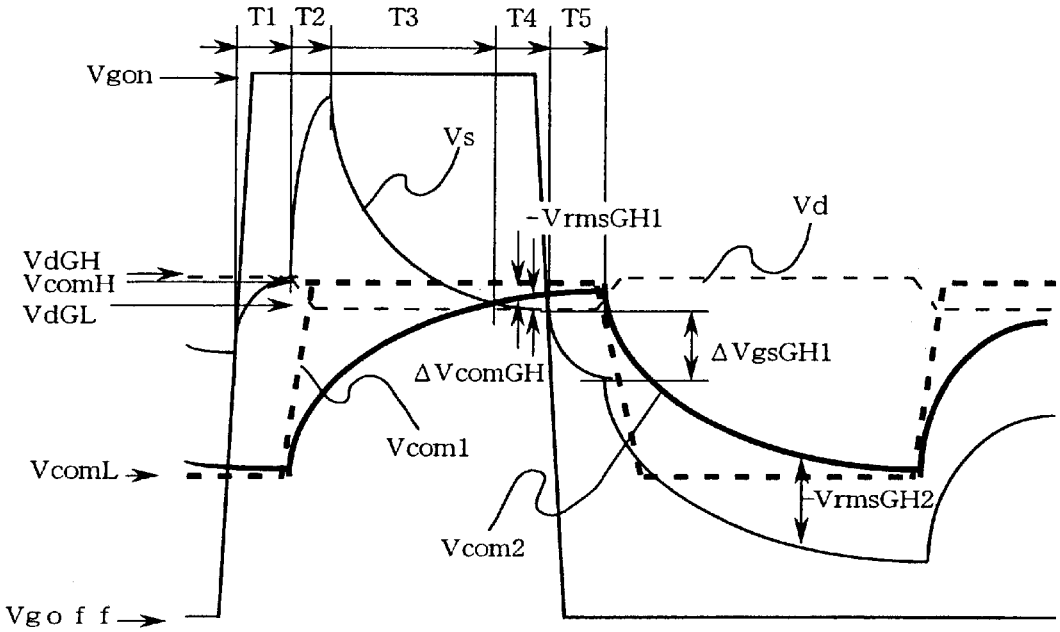
FIG. 7A PRIOR ART
FIGS. 7A, 7B illustrate driving waveform diagrams in the conventional liquid crystal display.
Figure 7B:
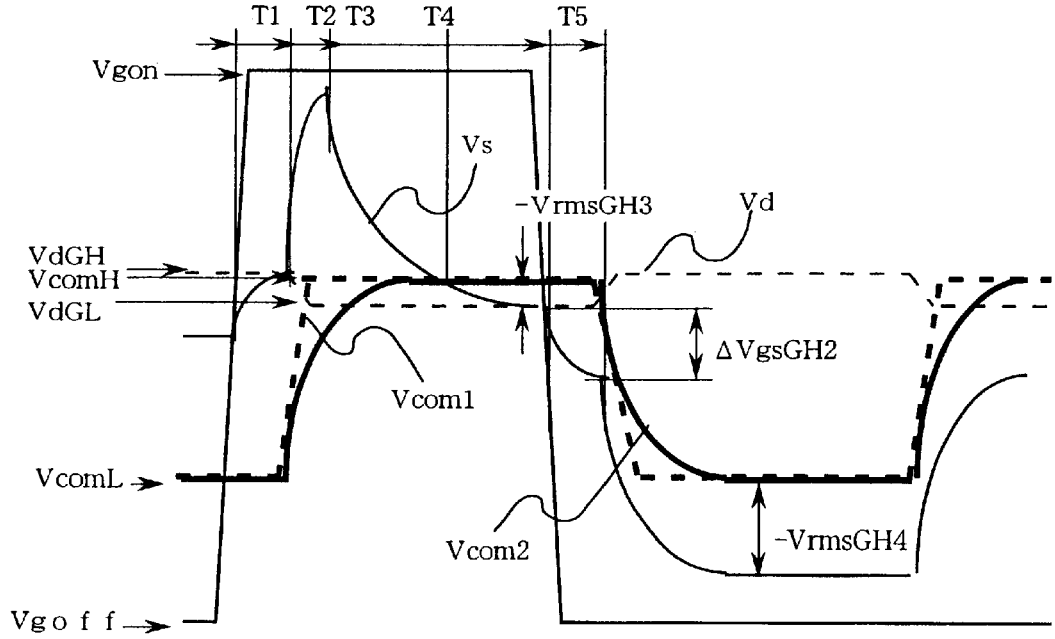
FIG. 7B PRIOR ART
Figure 8:
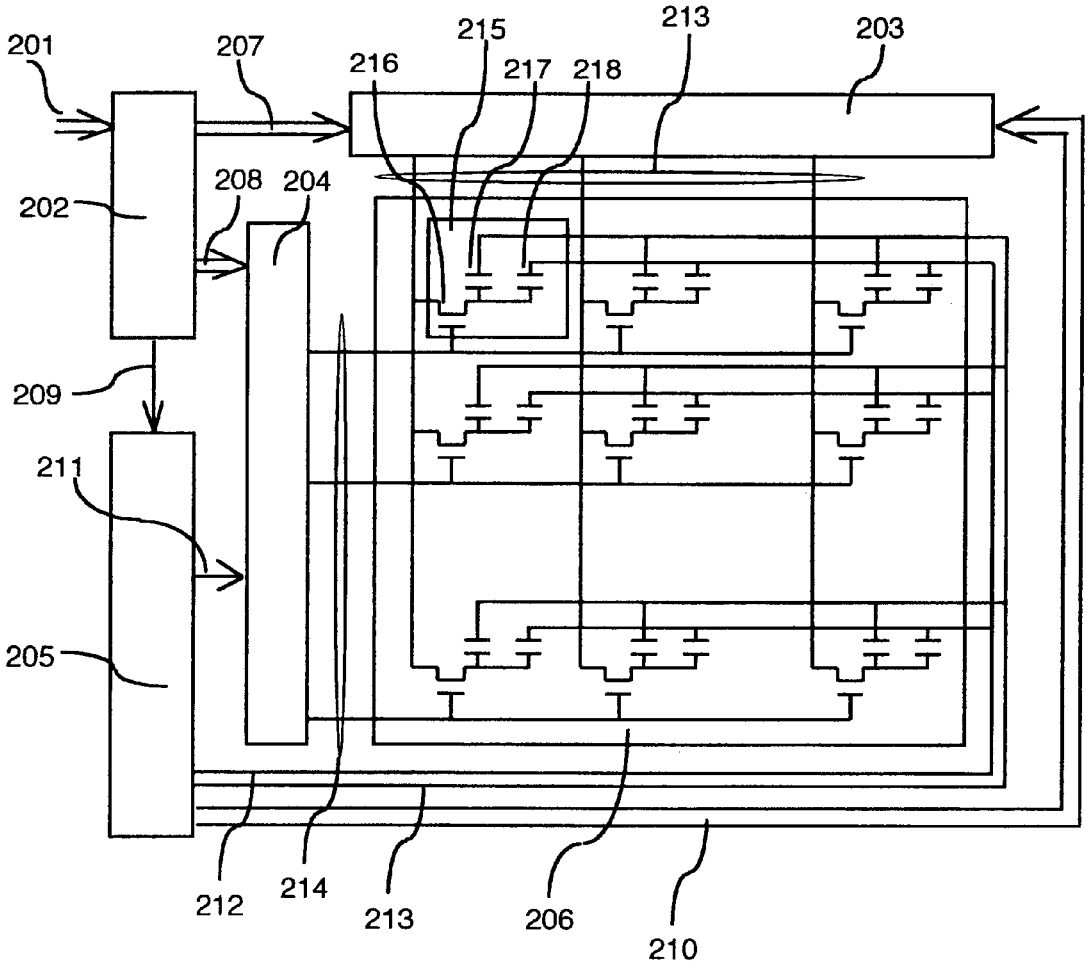
FIG. 8 PRIOR ART
FIG. 8 is a block diagram for illustrating another conventional embodiment of a liquid crystal display.

In FIG. 19, the longitudinal axis represents the smear level. From the difference in the luminance between, "BA", i.e., the background display luminance in the regions "A" on the right and the left sides of the white rectangle, and "BB", i.e., the background display luminance in the regions "B" illustrated in FIG. 6 indicating the conventional embodiment, the smear level can be determined by the following formula:

$$\Delta B=|(BB-BA)/BB| \quad (2)$$

Consequently, in the case where, just like the present conventional embodiment, "BA", i.e., the background display luminance in the regions "A" on the right and the left sides of the white rectangle, is darker and lower than "BB", i.e., the background display luminance in the regions "B", a positive value of the smear level is determined through the absolute value conversion. Also, the smear level of 3% or lower is a level that the human eyes cannot perceive as the difference in the luminance. Moreover, the transverse axis represents a ratio, toward one horizontal time-period, of the time during which the opposed electrode voltage brought up to the higher electric potential level than the opposed electrode voltage level of the final purpose is once applied to the opposed electrode voltage Vcom. In a liquid crystal panel with 1024-dot horizontal resolution and 768 vertical lines, since the one horizontal time-period is equal to about 16 μs, the ratio of, for example, 50% becomes equal to about 8 μs. Also, the description has been given assuming that, at this time, the electric potential difference between the opposed electrode voltage level of the final purpose and the opposed electrode voltage level brought up to the higher electric potential level once is equal to 1.5 V. It can be said from FIG. 19 that applying the correcting voltage in a time-period of about 50% (8 μs) to 75% (12 μs) makes it possible to suppress the smear level down to 3% or lower. This, eventually, means the following: A short correcting voltage applying time-period results in no effect of applying the correcting voltage, and conversely, if the correcting voltage applying time-period is long, the opposed electrode voltage does not attain to the opposed electrode voltage level of the final purpose.

In FIG. 20, the longitudinal axis represents the smear level, and the transverse axis represents the electric potential difference between the opposed electrode voltage level of the final purpose and the opposed electrode voltage level brought up to the higher electric potential level once. FIG. 20 presents an example in which the correcting voltage applying time-period is assumed to be 10 μs. It can be said from FIG. 20 that applying the correcting voltage in the range of 1V to 2 V makes it possible to suppress the smear level down to 3% or lower. this, eventually, means the following: A low voltage level of the correcting voltage results in no effect of applying the correcting voltage, and conversely, if the voltage level of the correcting voltage is high, the opposed electrode voltage does not attain to the opposed electrode voltage level of the final purpose.

As described above, the opposed electrode voltage brought up to the higher electric potential level than the opposed electrode voltage level of the final purpose is once applied to the positive polarity (higher electric potential) opposed electrode voltage Vcom, and the opposed electrode voltage brought up to the higher electric potential level than the opposed electrode voltage level of the final purpose is once applied to the negative polarity (lower electric potential) opposed electrode voltage Vcom. This, as is seen from the explanation of the embodiment in the present invention, makes it possible to solve the transverse smear that has been the problem in the prior art. However, an embodiment in which the present invention is expected to exhibit its effect most clearly is a TFT liquid crystal panel having a small liquid crystal capacitance. The reason is as follows: The small liquid crystal capacitance increases the amount of the diving voltage ΔVgs that dives into the between-gate/source parasitic capacitor. As the result, a writing margin at the source electrode voltage level is lacked when the source electrode voltage is transitioned to the negative polarity (lower electric potential) opposed electrode voltage illustrated in FIG. 17B.

Accordingly, the present invention is considered to exhibit its effect outstandingly in a TFT liquid crystal display that employs, as a system using a liquid crystal material with the small capacitance, a liquid crystal based on a transverse electric field system. Here, the transverse electric field system means a system in which the liquid crystal is operated by an electric field that is substantially parallel to the surface of a substrate between two electrodes configured on the identical substrate and thus incident light launched into the liquid crystal from a clearance between the two electrodes is modulated so as to embody the display.

Next, referring to FIG. 1 and FIGS. 21 to 24, the explanation will be given below concerning another embodiment of the liquid crystal display apparatus according to the present invention.

Figure 21:
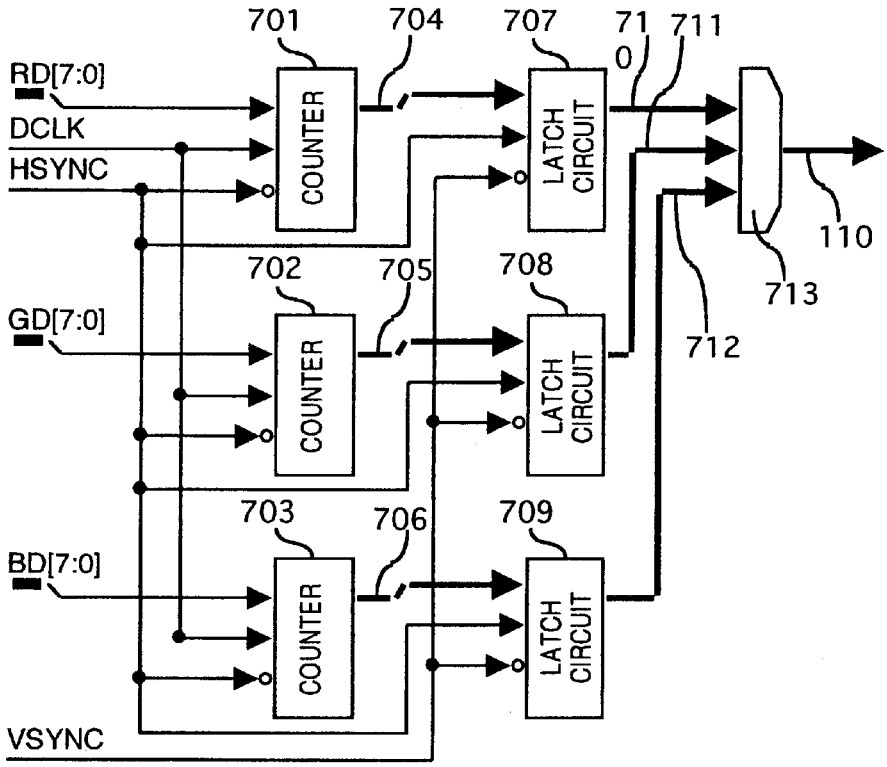
FIG. 21 is a block diagram for illustrating a correction amount data generating circuit according to the present invention.
Figure 22:
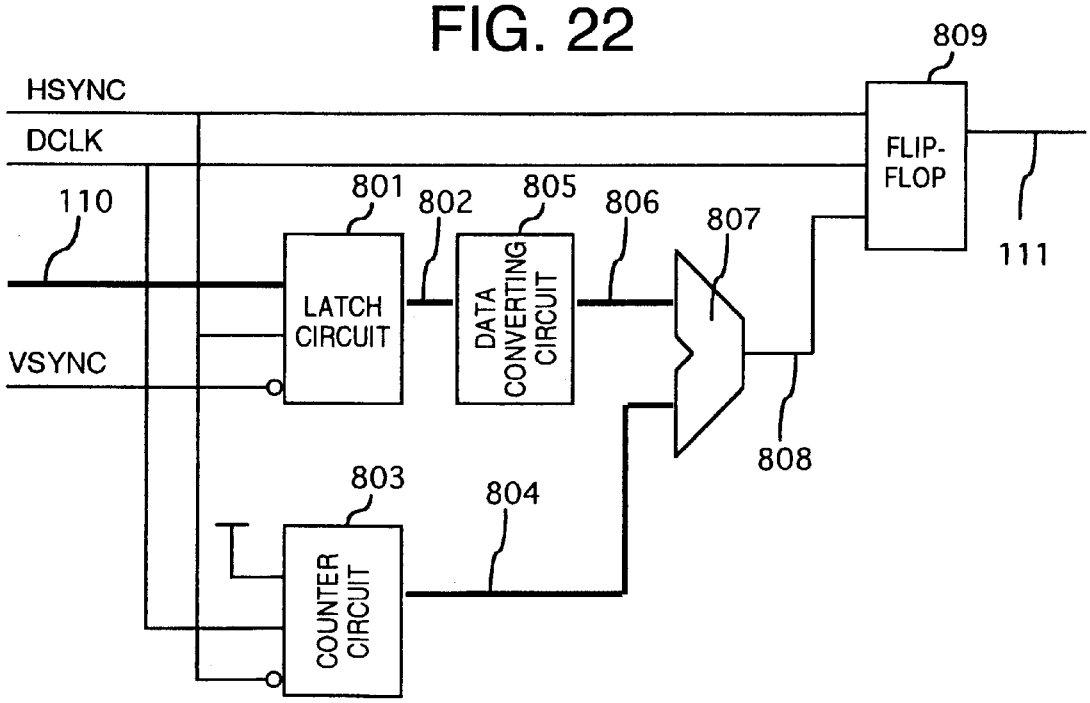
FIG. 22 is a block diagram for illustrating a correction time-period controlling signal generating circuit according to the present invention.
Figure 23:
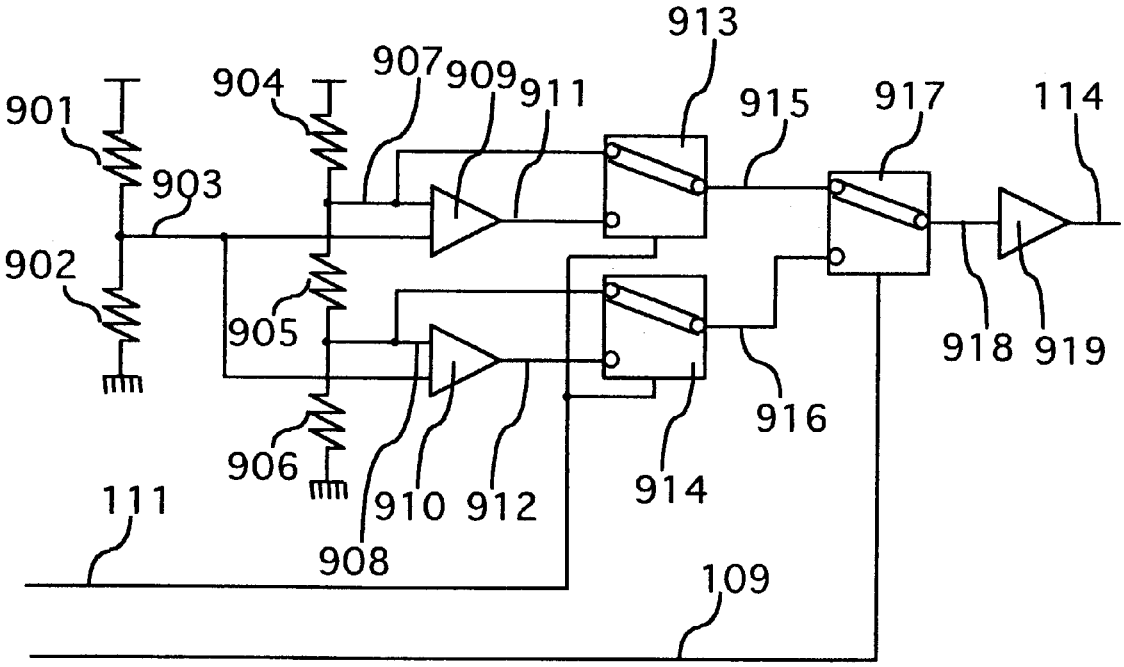
FIG. 23 is a block diagram for illustrating an opposed electrode voltage correcting circuit according to the present invention.
Figure 24:
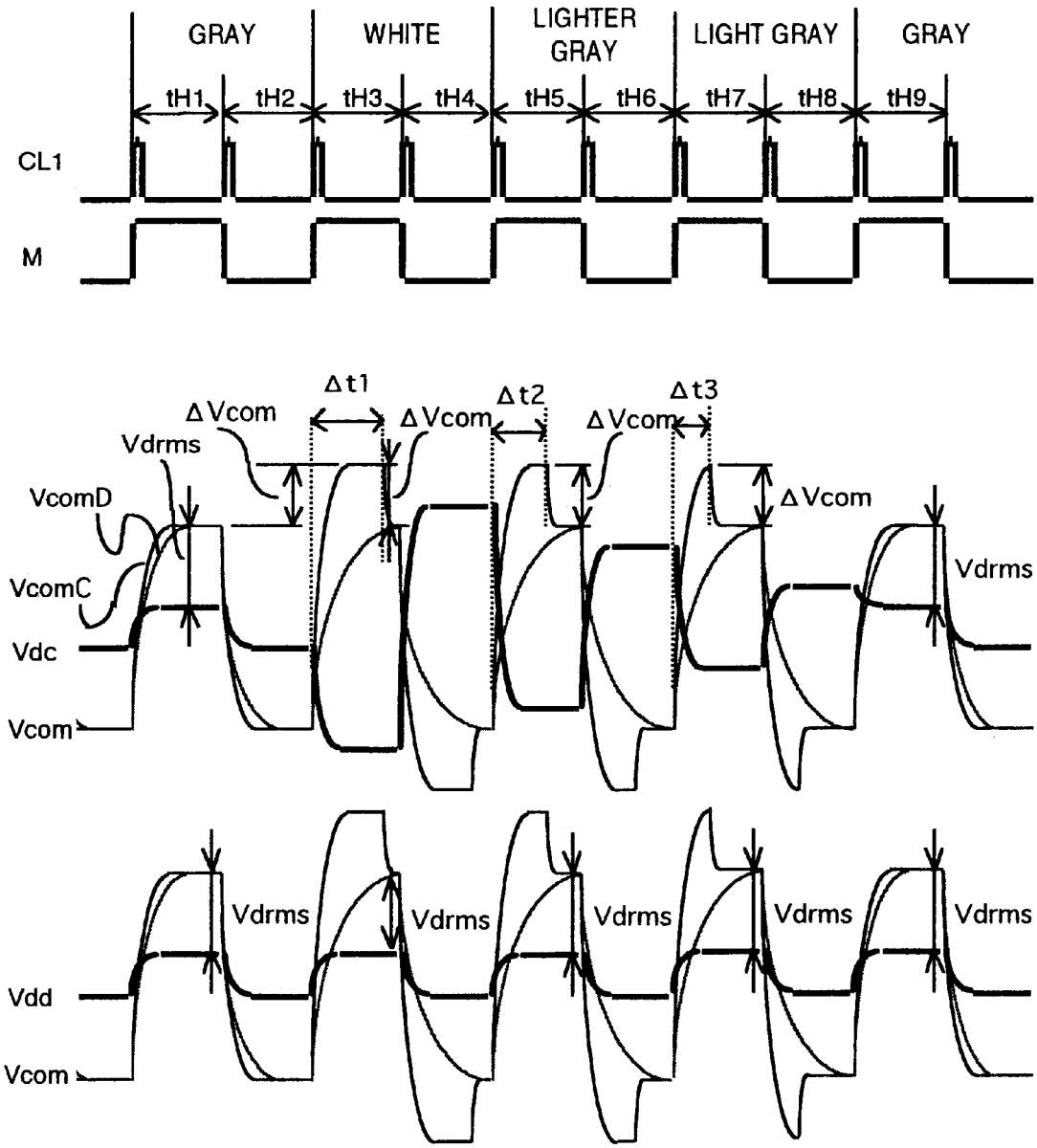
FIG. 24 illustrates driving waveform diagrams in the liquid crystal display according to the present invention.

FIG. 21 is a diagram for illustrating a voltage correction amount calculating circuit located within the interface circuit illustrated in FIG. 1. FIG. 22 is a circuit diagram designed for generating a correction time-period controlling signal for controlling a time-period during which a correction is made to the opposed electrode voltage value within one horizontal time-period in correspondence with display data within the interface circuit according to the present embodiment. FIG. 23 is a diagram for illustrating an opposed electrode voltage correcting circuit according to the present embodiment that uses the correction time-period controlling signal generated in FIG. 22 and that is located within the power supply circuit illustrated in FIG. 1. Also, FIG. 24 illustrates driving waveform diagrams according to the present embodiment.

In the correction amount data generating circuit illustrated in FIG. 21, reference numerals each denote the following components: 701, 702, 703, counters with a loading function, 704, 705, 706, output data buses from the counters 701, 702, 703, respectively, 707, 708, 709, latch circuits, 710, 711, 712, output data buses from the latch circuits 707, 708, 709, respectively, 713, an adding circuit.

Moreover, reference notations each denote the following: RD [7:0] red display data, GD [7:0] green display data, BD [7:0] blue display data, DCLK, a clock in synchronization with each of the above-mentioned display data, HSYNC, a horizontal synchronization signal, VSYNC a vertical synchronization signal. Any one of these signals is included in the interface signal 101 illustrated in FIG. 1, and is transferred from a system (not illustrated).

In the correction time-period controlling signal generating circuit illustrated in FIG. 22, reference numerals each denote the following components: 801 a latch circuit, 802 an output data bus from the latch circuit 801, 803 a counter circuit with a loading function, 804 an output data bus from the counter circuit 803, 805 a data converting circuit that includes decoder circuits and converts amount of the display data outputted from the latch circuit 801 to a counted value corresponding to a time-period during which the correction is made to the opposed electrode voltage value, 806 an output data bus from the data converting circuit 805 that includes the decoder circuits, 807 a coincidence circuit, 808 an output signal line from the coincidence circuit 807, 809 a JK flip-flop circuit. Also, the notations DCLK, HSYNC, and VSYNC denote the same signals as those illustrated in FIG. 21, respectively.

In the opposed electrode voltage correcting circuit illustrated in FIG. 23, reference numerals each denote the following components: 901, 902 voltage-dividing resistors, 903 a correcting voltage line for the opposed electrode voltage, 904, 905, 906 voltage-dividing resistors, 907 a positive polarity opposed electrode reference voltage line, 908 a negative polarity opposed electrode reference voltage line, 909 an analog voltage adding circuit, 910 an analog voltage subtracting circuit, 911, 912 output voltage lines from the analog voltage adding circuit 909 and the analog voltage subtracting circuit 910, respectively, 913, 914 analog voltage selecting circuits, respectively, 915, 916 output voltage lines from the analog voltage selecting circuits 913, 914, respectively, 917 an analog voltage selecting circuit, 918 an output voltage line from the analog voltage selecting circuit 917, 919 an electric current amplifying circuit.

In FIG. 24, a reference notation CL1 denotes a horizontal synchronization signal. The signal CL1 becomes effective at a ratio of one time during the one horizontal time-period, and becomes a timing signal with which tone display data by the amount of one horizontal line are outputted by being transformed into a tone voltage. A notation M denotes the liquid crystal-applying voltage alternating signal. The signal M executes a control of converting the polarity of the opposed electrode voltage Vcom into negative polarity at the time of "Low" level and converting the polarity of the opposed electrode voltage Vcom into positive polarity at the time of "High" level. A notation Vdc denotes a tone voltage waveform of a signal line that outputs a tone voltage for executing the gray display during time-periods tH 1, tH 2 and tH 9, and a tone voltage for executing the white display during time-periods tH 3, tH 4, and a tone voltage for executing the lighter gray display during time-periods tH 5, tH 6, and a tone voltage for executing the light gray display during time-periods tH 7, tH 8. A notation Vdd denotes a tone voltage waveform of a signal line that outputs a tone voltage for executing the gray display during any of the time-periods tH 1, tH 2, tH 3, tH 4, tH 5, tH 6, tH 7, tH 8 and tH 9. Concerning the opposed electrode voltage Vcom, a full line (VcomC) indicates a waveform diagram of the opposed electrode voltage feeding line 114 connected to an output terminal of the power supply circuit 105 illustrated in FIG. 1. Also, a dashed line (VcomD) indicates a waveform diagram inside the liquid crystal panel 106.

The correction amount data generating circuit, which is illustrated in FIG. 21, is located within the interface circuit 102 and outputs the control signal 110 for indicating the voltage correction data. In the present correction amount data generating circuit, when the highest order bit RD 7 of the red display data RD [7:0], the highest order bit GD 7 of the green display data GD [7:0] and the highest order bit BD 7 of the blue display data BD [7:0] become effective, the respective counters 701, 702 and 703 start counting up in synchronization with the dot clock DCLK. If the respective display data are ineffective, the respective counters perform no count-up operation.

When the horizontal synchronization signal HSYNC becomes effective, the respective latch circuits 707, 708 and 709 latch the values counted up by the respective counters 701, 702 and 703. At this time, the horizontal synchronization signal HSYNC clears the respective counters 701, 702 and 703 of the counted data. Then, the adding circuit 713 adds up the red display data, the green display data and the blue display data stored in the latch circuits 707, 708 and 709, thereby detecting the data by the amount of the one horizontal time-period.

Incidentally, in the present embodiment, the control is executed so that the values of the correction amount data are increased when there exist a large amount of the white display data.

The correction time-period controlling signal generating circuit, which is illustrated in FIG. 22, is included within the interface circuit 102 and outputs the correction time-period controlling signal 111 for controlling the time-period during which the correction is made to the opposed electrode voltage value within the one horizontal time-period in correspondence with the display data. In the present correction time-period controlling signal generating circuit, the latch circuit 801 latches the voltage correction data transferred from the correction amount data generating circuit illustrated in FIG. 21. Then, the data converting circuit 805 including the decoder circuits converts the voltage correction data into digital data that have values in the range smaller than the number of the clocks within the one horizontal time-period. Consequently, the data converting circuit 805 including the decoder circuits operates so that the digital data corresponding to the correction time-period are increased/decreased in correspondence with the voltage correction data.

In the present embodiment, the digital data corresponding to the correction time-period are controlled so that when, for example, there exist a large amount of the white display data, a selection time for the opposed electrode voltage to which the correcting voltage has been applied is lengthened and the number of the clocks is increased.

Meanwhile, the counter circuit 803 always performs the count-up operation in synchronization with the dot clock. The horizontal synchronization signal HSYNC clears the counter 803 of the counted data. The counted data in the counter circuit 803 are transferred to the coincidence circuit 807 through the data bus 804.

In the coincidence circuit 807, if the above-described digital data 806, which correspond to the correction time-period converted in accordance with the amount of the voltage correction data, coincide with the counted data 804, i.e., the output from the counter circuit 803, the coincidence circuit 807 outputs a signal to the output signal line 808.

The output signal 808 from the coincidence circuit 807 and the horizontal synchronization signal HSYNC are inputted into the JK flip-flop circuit 809. Then, the flip-flop circuit 809 outputs the correction time-period controlling signal through the signal line 111. Here, the correction time-period controlling signal is positioned at the "High" level during a time-period ranging from a rising edge of the horizontal synchronization signal HSYNC to a rising edge of the output signal 808 from the coincidence circuit 807, and is positioned at the "Low" level during a time-period ranging from the rising edge of the output signal 808 from the coincidence circuit 807 to an end of the one horizontal time-period.

To the opposed electrode voltage correcting circuit (FIG. 23) included within the power supply circuit 105, the amount of the voltage correction data calculated in FIG. 21 is transferred by the control signal 110 and the correction time-period controlling signal 111 generated in FIG. 22 is transferred. In the opposed electrode voltage correcting circuit illustrated in FIG. 23, a correcting voltage for correcting the opposed electrode voltage, which is generated by the voltage-dividing resistors 901, 902, is transferred through the line 903, then being inputted into the analog voltage adding circuit 909 and the analog voltage subtracting circuit 910. Moreover, the positive polarity opposed electrode reference voltage 907 and the negative polarity opposed electrode reference voltage 908, which are generated by the voltage-dividing resistors 904, 905 and 906, are inputted into the analog voltage adding circuit 909 and the analog voltage-subtracting circuit 910, respectively.

The analog voltage adding circuit 909 executes an addition between the correcting voltage for correcting the opposed electrode voltage and the positive polarity opposed electrode reference voltage, then outputting the result. The analog voltage subtracting circuit 910 executes a subtraction between the correcting voltage for correcting the opposed electrode voltage and the negative polarity opposed electrode reference voltage, then outputting the result.

The output from the analog voltage adding circuit 909 and the positive polarity opposed electrode reference voltage are inputted into the analog voltage selecting circuit 913. At this time, the correction time-period controlling signal generating circuit, which is illustrated in FIG. 22 and is included within the interface circuit 102, transfers the correction time-period controlling signal 111 for controlling the time-period during which the correction is made to the opposed electrode voltage value within the one horizontal time-period in correspondence with the display data. Based on the control signal 111, during the time-period ranging from the rising edge of the horizontal synchronization signal HSYNC to the number of the dot clocks corresponding to the correction time-period varied in accordance with the amount of the voltage correction data, the analog voltage selecting circuit 913 selects the output from the analog voltage adding circuit 909, then outputting the output to the analog voltage selecting circuit 917. Also, during the remainder of the above-described time-period within the one horizontal time-period, the analog voltage selecting circuit 913 selects the positive polarity opposed electrode reference voltage, then outputting the reference voltage to the analog voltage selecting circuit 917.

Similarly, the output from the analog voltage subtracting circuit 910 and the negative polarity opposed electrode reference voltage are inputted into the analog voltage selecting circuit 914. Based on the selection signal 111 for selecting the opposed electrode voltage, during the time-period ranging from the rising edge of the horizontal synchronization signal HSYNC to the number of the dot clocks corresponding to the correction time-period varied in accordance with the amount of the voltage correction data, the analog voltage selecting circuit 914 selects the output from the analog voltage subtracting circuit 910, then outputting the output to the analog voltage selecting circuit 917. Also, during the remainder of the above-described time-period within the one horizontal time-period, the analog voltage selecting circuit 914 selects the negative polarity opposed electrode reference voltage, then outputting the reference voltage to the analog voltage selecting circuit 917.

The voltages outputted from the analog voltage selecting circuits 913, 914 are inputted into the analog voltage selecting circuit 917 and are selected in accordance with the polarity of the liquid crystal-applying voltage alternating signal 109 "M", then being outputted to the opposed electrode voltage feeding line 114 through the electric current amplifying circuit 919.

Here, in the case where there exist a large amount of the white display data, by using the correction time-period controlling signal 111 for controlling the correction time-period, which is generated by the correction time-period controlling signal generating circuit illustrated in FIG. 22, and the opposed electrode voltage correcting circuit illustrated in FIG. 23, the following become possible: The opposed electrode voltage-correcting voltage ΔVcom is added to the positive polarity opposed electrode reference voltage only during time-periods Δt 1, Δt 2 and Δt 3 that are adjusted in correspondence with the amount of the correction data within each horizontal time-period. This procedure makes it possible to increase the voltage level as is the case with a voltage waveform of VcomC during the time-periods tH 3, tH 5 and tH 7 illustrated in FIG. 24. Also, the opposed electrode voltage-correcting voltage ΔVcom is subtracted from the negative polarity opposed electrode reference voltage only during the time-periods Δt 1, Δt 2 and Δt 3 that are adjusted in correspondence with the amount of the correction data within each horizontal time-period. This procedure makes it possible to decrease the voltage level as is the case with the voltage waveform of VcomC during the time-periods tH 4, tH 6 and tH 8 that are also illustrated in FIG. 24.

Figure 12:
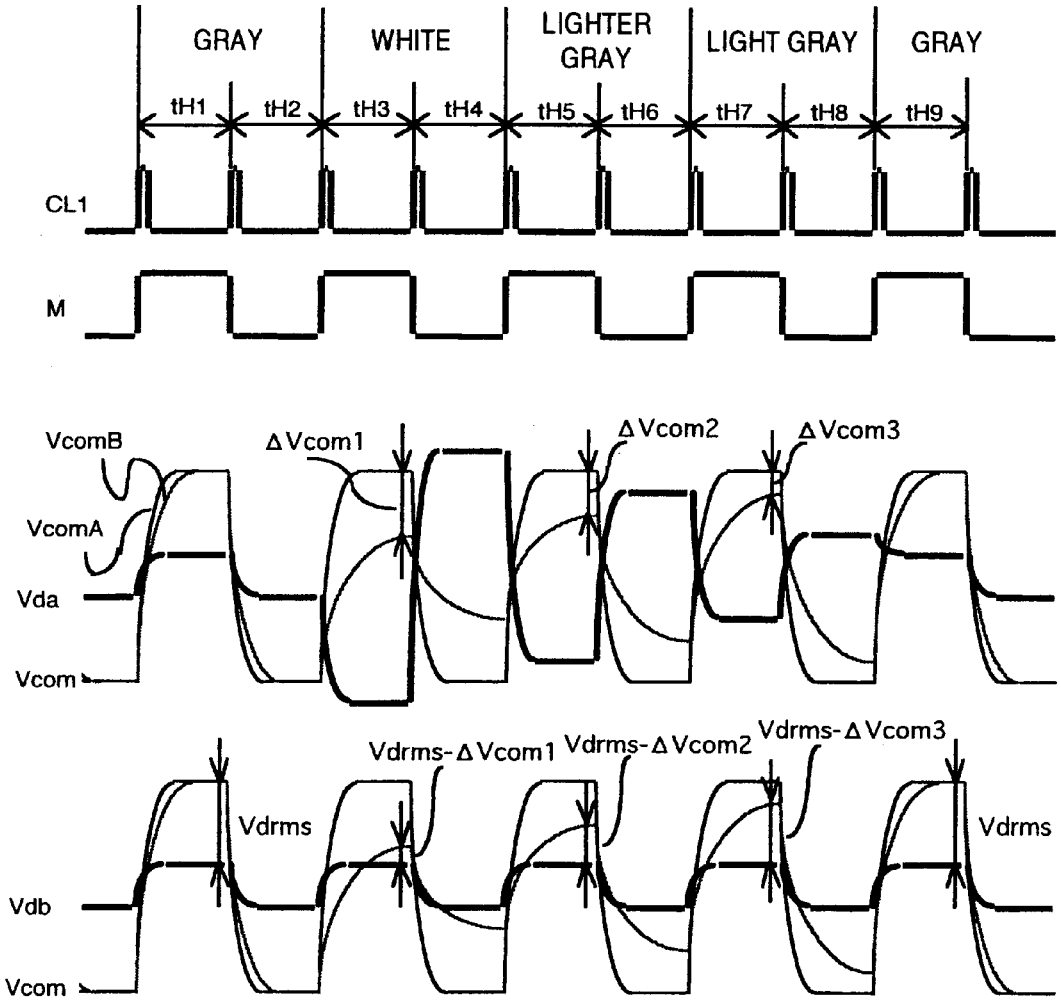
FIG. 12 PRIOR ART
FIG. 12 illustrates driving waveform diagrams in the conventional liquid crystal display.

As explained earlier, there exists the case where, originally, a large amount of the white display data exist and, as is the case with the opposed electrode voltage waveform VcomB inside the liquid crystal panel illustrated in FIG. 12, the opposed electrode voltage Vcom is increased/decreased by the amount of ΔVcom 1, ΔVcom 2, and ΔVcom 3 during the time-periods tH 3, tH 4, the time-periods tH 5, tH 6, and the time-periods tH 7, tH 8. Even in such a case, the opposed electrode voltage-correcting voltage ΔVcom is added/subtracted only during the time-period Δt varied in correspondence with the amount of the correction data, thereby making it possible to stabilize the opposed electrode voltage inside the liquid crystal panel 106 as is the case with VcomD illustrated in FIG. 24. On account of this, the effective voltage value Vdrms, which is actually applied to the liquid crystal 120, becomes constant.

This makes it possible to reduce the picture quality deterioration that has occurred in the conventional liquid crystal display, thus allowing the display of high picture quality to be embodied.

Here, in the present embodiment, data extracted from the display data are only the highest order bit RD 7 of the red display data RD [7:0], the highest order bit GD 7 of the green display data GD [7:0] and the highest order bit BD 7 of the blue display data BD [7:0]. Substantially, the respective counters 701, 702 and 703 are caused to count up, assuming that if any one of higher 128-level tones out of 256-level tone display data is inputted, there exist the display data, and if any one of lower 128-level tones is inputted, there exist no display data. In the meantime, there is a method in which the 256-level tone display data are separated into 3, 4 or more of regions and weights are imposed onto the respective separated regions so as to determine the correction data. This method also results in the same effect.

Next, referring to FIGS. 25 to 27, the explanation will be given below concerning a still another embodiment of the liquid crystal display according to the present invention.

Figure 25:
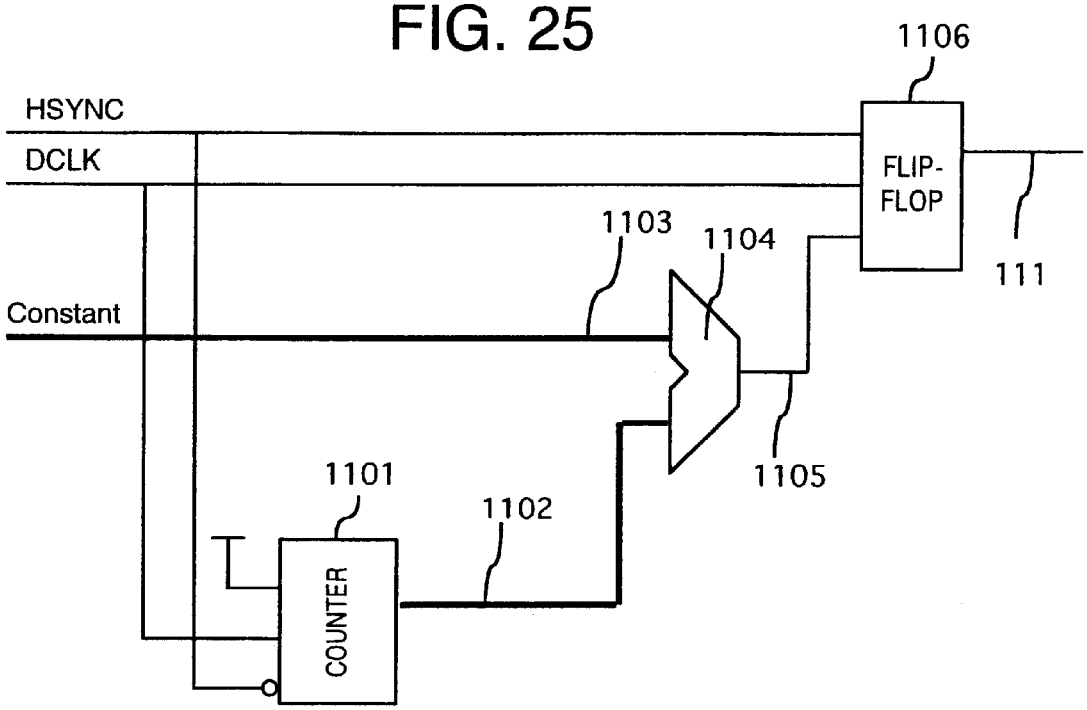
FIG. 25 is a block diagram for illustrating the correction time-period controlling signal generating circuit according to the present invention.

FIG. 25 is a diagram for illustrating a circuit for generating a correction time-period controlling signal for making the correction only during a fixed time-period within one horizontal time-period. FIG. 26 is a diagram for illustrating an opposed electrode voltage correcting circuit according to the present embodiment that is located within the power supply circuit illustrated in FIG. 1. Also, FIG. 27 illustrates driving waveform diagrams in the liquid crystal display according to the present embodiment.

In FIG. 25, reference numerals each denote the following components: 1101 a counter circuit with a loading function, 1102 an output data bus from the counter circuit 1101, 1103 data on the number (a constant value) of clocks corresponding to a correction time-period, 1104 a coincidence circuit, 1105 an output data bus from the coincidence circuit 1104, 1106 a JK flip-flop circuit.

Also, notations DCLK, HSYNC denote the same signals as those illustrated in FIG. 13 and explained in the above-described first embodiment.

Figure 26:
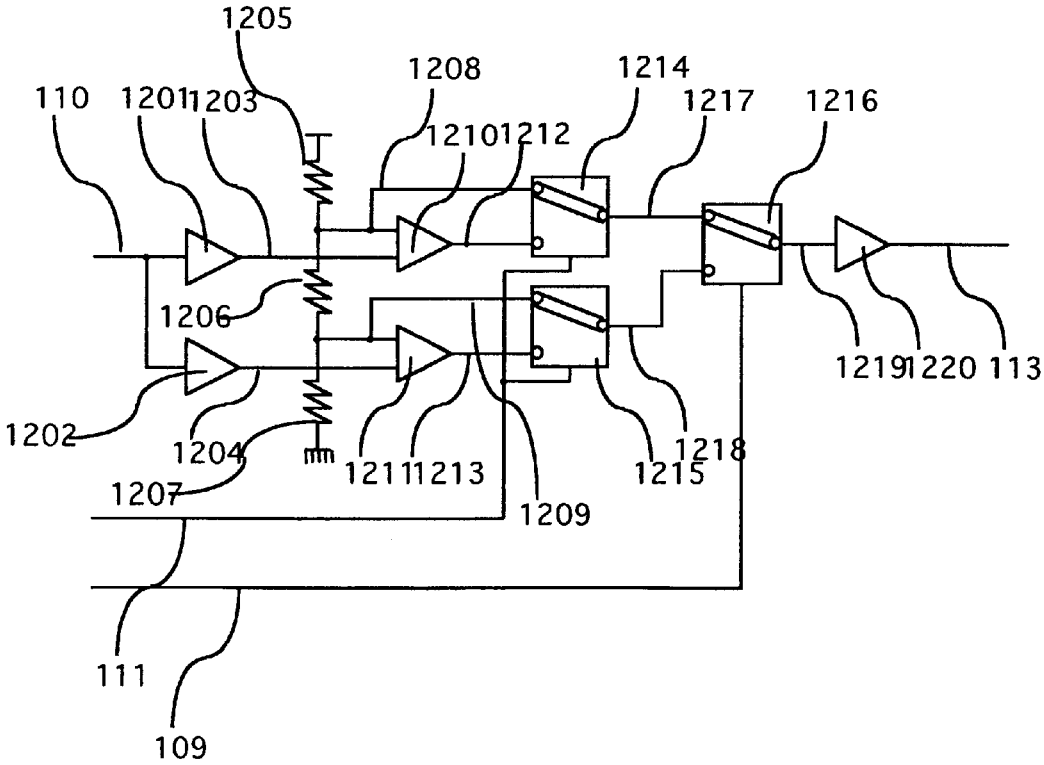
FIG. 26 is a block diagram for illustrating the opposed electrode voltage correcting circuit according to the present invention.

In FIG. 26, reference numerals each denote the following components: 1201, 1202 digital/analog converting circuits, 1203, 1204 correcting voltages that the digital/analog converting circuits 1201, 1202 output, respectively, 1205, 1206, 1207 voltage-dividing resistors, 1208 a positive polarity opposed electrode reference voltage, 1209 a negative polarity opposed electrode reference voltage, 1210 an analog voltage adding circuit, 1211 an analog voltage subtracting circuit, 1212 an output voltage from the analog voltage adding circuit 1210, 1213 an output voltage from the analog voltage subtracting circuit 1211, 1214, 1215, 1216 analog voltage selecting circuits, 1217, 1218, 1219, output voltages from the analog voltage selecting circuits 1214, 1215, 1216, respectively, 1220 an electric current amplifying circuit.

Figure 27:
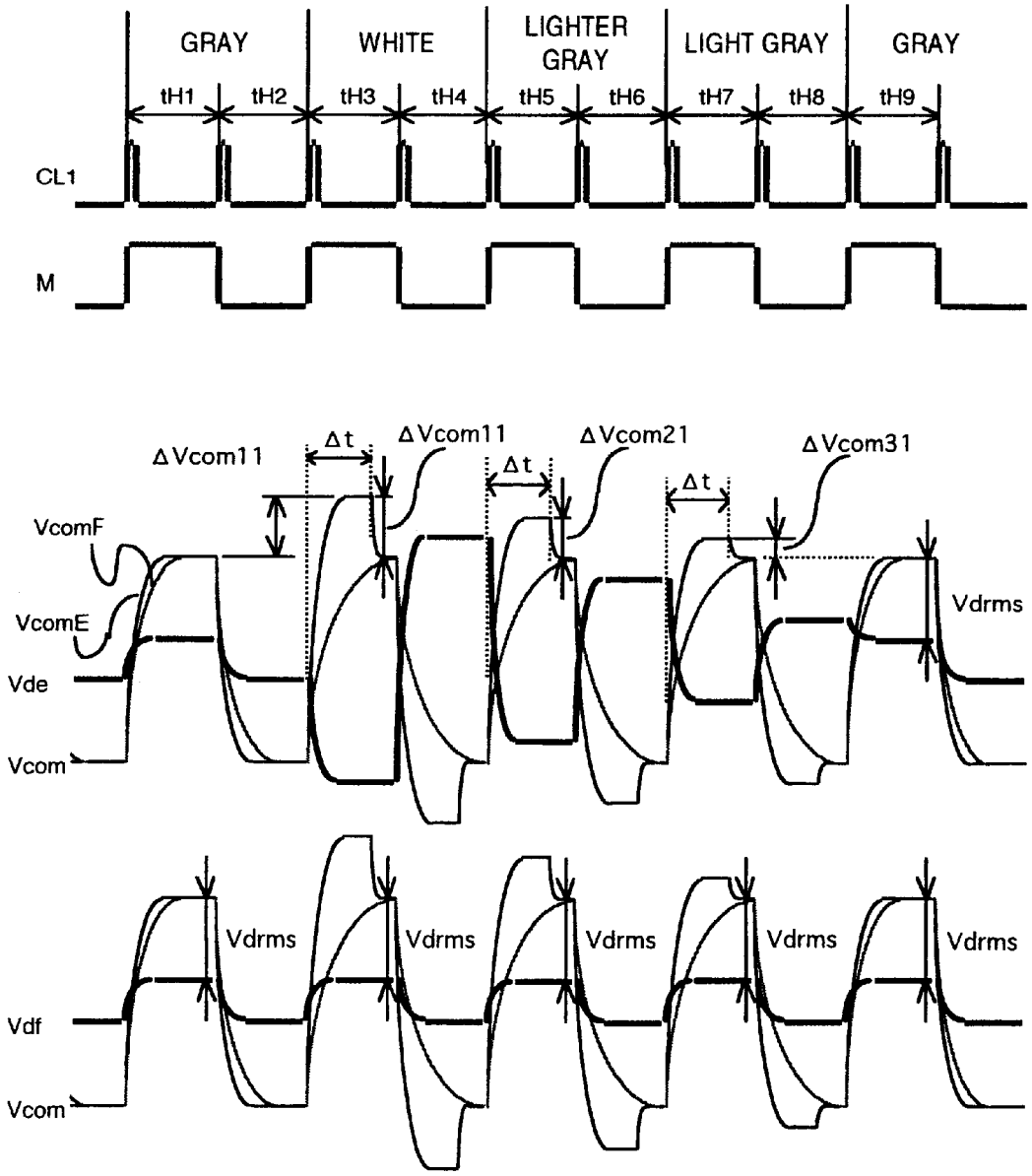
FIG. 27 illustrates driving waveform diagrams in the liquid crystal display according to the present invention.

In FIG. 27, notations CL 1, M denote the same signals as those in the embodiment illustrated in FIG. 24. A notation Vde denotes a tone voltage waveform of a signal line that outputs a tone voltage for executing the gray display during time-periods tH 1, tH 2 and tH 9, and a tone voltage for executing the white display during time-periods tH 3, tH 4, and a tone voltage for executing the lighter gray display during time-periods tH 5, tH 6, and a tone voltage for executing the light gray display during time-periods tH 7, tH 8. A notation Vdf denotes a tone voltage waveform of a signal line that outputs a tone voltage for executing the gray display during any of the time-periods tH 1, tH 2, tH 3, tH 4, tH 5, tH 6, tH 7, tH 8 and tH 9. Concerning the opposed electrode voltage Vcom, a full line (VcomE) indicates a waveform diagram of the opposed electrode voltage feeding line 114 connected to an output terminal of the power supply circuit 105 illustrated in FIG. 1. Also, a dashed line (VcomF) indicates a waveform diagram inside the liquid crystal panel 106.

In the present embodiment, concerning the generation of the voltage correction data, the above-described correction amount data generating circuit, which is illustrated in FIG. 21 and explained in the embodiment in FIG. 24, is employed. Thus, hereinafter, the explanation will be given mainly regarding the points that differ from those in the embodiment in FIG. 24.

In the present embodiment, FIG. 25 illustrates the circuit for generating the correction time-period controlling signal for making the correction only during a fixed time-period within the one horizontal time-period. In the circuit, which is also included within the interface circuit 102, the counter circuit 1101 performs the count-up operation in synchronization with the dot clock DCLK. Then, the counted data outputted from the counter circuit 1101 are inputted into the coincidence circuit 1104 through the output data bus 1102.

The constant counted number data 1103 that correspond to the time-period during which the correction is made within the one horizontal time-period has been inputted into the coincidence circuit 1104. If the output 1102 from the counter circuit 1101 coincides with the constant counted number data 1103, the coincidence circuit 1104 outputs a signal to the output signal line 1105.

The output 1105 from the coincidence circuit 1104 and the horizontal synchronization signal HSYNC are inputted into the JK flip-flop circuit 1106. Then, the flip-flop circuit 1106 outputs the correction time-period controlling signal through the signal line 111. Here, the correction time-period controlling signal is positioned at the "High" level during a time-period ranging from a rising edge of the horizontal synchronization signal HSYNC to a rising edge of the output signal 1105 from the coincidence circuit 1104, and is positioned at the "Low" level during a time-period ranging from the rising edge of the output signal 1105 from the coincidence circuit 1104 to an end of the one horizontal time-period.

In the present embodiment, the voltage correction amount data, which are transferred from the above-described correction amount data generating circuit included within the interface circuit 102 (FIG. 1) and illustrated in FIG. 21, are transferred by the control signal 110 to the opposed electrode voltage correcting circuit included within the power supply circuit 105 and having a configuration illustrated in FIG. 26.

The correction amount data 110 inputted into the opposed electrode voltage correcting circuit illustrated in FIG. 26 are converted into analog voltages by the digital/analog converting circuits 1201, 1202. In this way, the digital/analog converting circuits 1201, 1202 generate amounts of the correcting voltages, depending on the amount of the white display data. This situation is indicated by FIG. 27 in which there are illustrated ΔVcom 11, i.e., the amount of the correcting voltage during the time-periods tH 3, tH 4, ΔVcom 21, i.e., the amount of the correcting voltage during the time-periods tH 5, tH 6, and ΔVcom 31, i.e., the amount of the correcting voltage during the time-periods tH 7, tH 8.

Consequently, the digital/analog converting circuits 1201, 1202 operate so that the voltage levels are increased/decreased in correspondence with the values of the correction amount data.

In the voltages divided by the voltage-dividing resistors 1205, 1206, 1207, the positive polarity opposed electrode reference voltage 1208 is positioned at a voltage level of the peak value of VcomE during the time-period tH 1 illustrated in FIG. 27. Also, the negative positive polarity opposed electrode reference voltage 1209 is positioned at a voltage level of the peak value of VcomF during the time-period tH 2 illustrated in FIG. 27.

Moreover, the positive polarity opposed electrode reference voltage 1208 and the output 1212 from the analog voltage adding circuit 1210 are inputted into the analog voltage selecting circuit 1214. In accordance with the correction time-period controlling signal 111 outputted from the interface circuit 102 for making the correction only during a fixed time-period within the one horizontal time-period, during a fixed time-period Δt that is shorter than the one horizontal time-period, the analog voltage selecting circuit 1214 selects and outputs the output 1212 from the analog voltage adding circuit 1210. Also, during the remainder of the above-described fixed time-period, the analog voltage selecting circuit 1214 selects and outputs the positive polarity opposed electrode reference voltage 1208.

Similarly, the negative polarity opposed electrode reference voltage 1209 and the output 1213 from the analog voltage subtracting circuit 1211 are inputted into the analog voltage selecting circuit 1215. In accordance with the correction time-period controlling signal 111 outputted from the interface circuit 102 for making the correction only during a fixed time-period within the one horizontal time-period, during the fixed time-period Δt that is shorter than the one horizontal time-period, the analog voltage selecting circuit 1215 selects and outputs the output 1213 from the analog voltage subtracting circuit 1211. Also, during the remainder of the above-described fixed time-period, the analog voltage selecting circuit 1215 selects and outputs the negative polarity opposed electrode reference voltage 1209.

The voltages 1217, 1218 outputted from the analog voltage selecting circuits 1214, 1215 are inputted into the analog voltage selecting circuit 1216 and are selected in accordance with the polarity of the liquid crystal-applying voltage alternating signal 109 "M", then being outputted to the opposed electrode voltage feeding line 114 through the electric current amplifying circuit 1220.

Here, in the case where there exist a large amount of the white display data, by using the digital/analog converting circuits 1201, 1202, the analog voltage adding circuit 1210, the analog voltage subtracting circuit 1211 and the analog voltage selecting circuits 1214, 1215, the following become possible: The amounts of the correcting voltages ΔVcom 11, ΔVcom 21 and ΔVcom 31 corresponding to the amount of the white display data are added to the positive polarity opposed electrode reference voltage only during the fixed time-period Δt shorter than the one horizontal time-period. As is the case with the voltage waveform of VcomE during the time-periods tH 3, tH 5 and tH 7 illustrated in FIG. 27, this procedure makes it possible to increase the voltage level of the opposed electrode voltage VcomF inside the liquid crystal panel 106 during the respective time-periods tH 3, tH 5 and tH 7 by the amount of ΔVcom 11, ΔVcom 21 and ΔVcom 31, respectively.

Also, the amounts of the correcting voltages ΔVcom 11, ΔVcom 21 and ΔVcom 31 that correspond to the amount of the white display data during the respective time-periods are subtracted from the negative polarity opposed electrode reference voltage only during the fixed time-period Δt shorter than the one horizontal time-period. As is the case with the voltage waveform of VcomE during the time-periods tH 4, tH 6 and tH 8 illustrated in FIG. 27, this procedure makes it possible to decrease the voltage level of the opposed electrode voltage VcomF inside the liquid crystal panel 106 during the respective time-periods by the amount of ΔVcom 11, ΔVcom 21 and ΔVcom 31, respectively.

Accordingly, in this way, the amounts of the correcting voltages corresponding to the amount of the white display data are added/subtracted only during the fixed time-period Δt that is shorter than the one horizontal time-period. This procedure allows the opposed electrode voltage inside the liquid crystal panel 106 to be stabilized at the values of the positive and the negative polarity opposed electrode reference voltages without being attenuated as is the case with the effective voltage value VcomF illustrated in FIG. 27. On account of this, the effective voltage value Vdrms, which is actually applied to the liquid crystal 120, becomes constant regardless of the amount of the display data. This makes it possible to reduce the picture quality deterioration that has occurred in the conventional liquid crystal display, thus allowing the display of high picture quality to be embodied.

Next, referring to FIGS. 28, 29, the explanation will be given below concerning an even further embodiment of the liquid crystal display according to the present invention.

Figure 28:
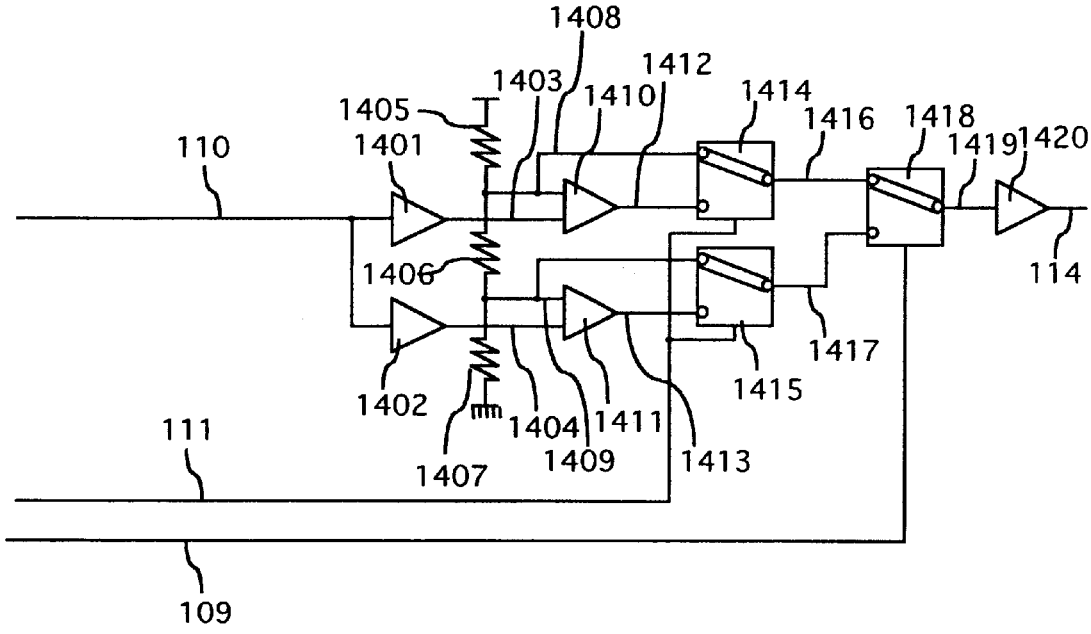
FIG. 28 is a block diagram for illustrating the opposed electrode voltage correcting circuit according to the present invention.

FIG. 28 is a diagram for illustrating an opposed electrode voltage correcting circuit according to the present embodiment that is located within the power supply circuit 105. Also, FIG. 29 illustrates driving waveform diagrams according to the present embodiment.

In FIG. 28, reference numerals each denote the following components: 1401, 1402 digital/analog converting circuits, 1403, 1404 output voltage lines from the digital/analog converting circuits 1401, 1402, 1405, 1406, 1407 voltage-dividing resistors, 1408 a positive polarity opposed electrode reference voltage, 1409 a negative polarity opposed electrode reference voltage, 1410 an analog voltage adding circuit, 1411 an analog voltage subtracting circuit, 1412 an output voltage line from the analog voltage adding circuit 1410, 1413 an output voltage line from the analog voltage subtracting circuit 1411, 1414, 1415 analog voltage selecting circuits, 1416, 1417, output voltage lines from the analog voltage selecting circuits 1414, 1415, respectively, 1418 an analog voltage selecting circuit, 1419 an output voltage line from the analog voltage selecting circuit 1418, 1420 an electric current amplifying circuit.

Figure 29:
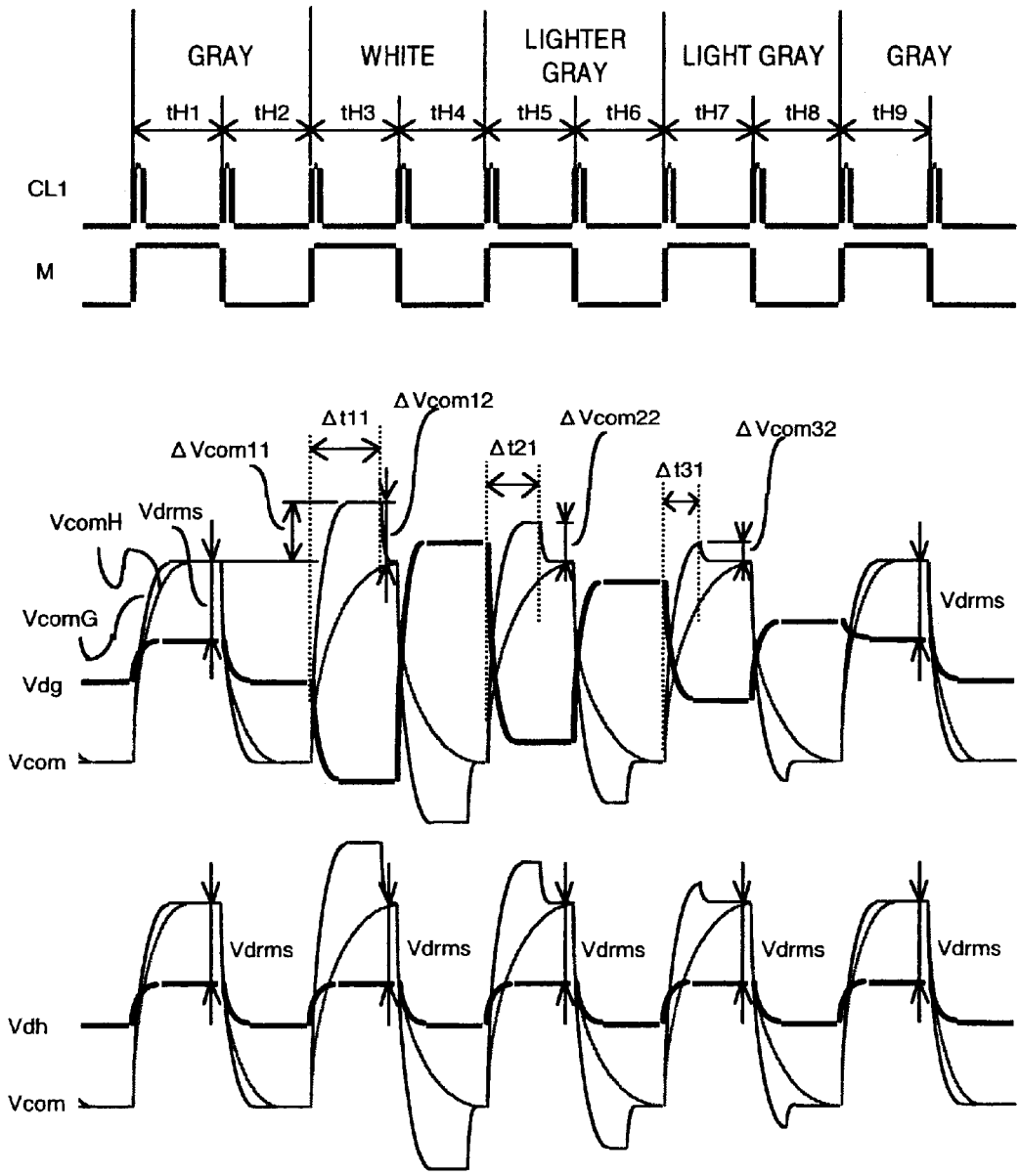
FIG. 29 illustrates driving waveform diagrams in the liquid crystal display according to the present invention.

In FIG. 29, notations CL 1, M denote the same signals as those in the embodiment illustrated in FIG. 24. A notation Vdg denotes a tone voltage waveform of a signal line that outputs a tone voltage corresponding to the gray display during time-periods tH 1, tH 2 and tH 9, and a tone voltage corresponding to the white display during time-periods tH 3, tH 4, and a tone voltage corresponding to the lighter gray display during time-periods tH 5, tH 6, and a tone voltage corresponding to the light gray display during time-periods tH 7, tH 8. A notation Vdh denotes a tone voltage waveform of a signal line that corresponds to the gray display during any of the time-periods tH 1, tH 2, tH 3, tH 4, tH 5 tH 6, tH 7, tH 8 and tH 9.

Concerning the opposed electrode voltage Vcom, VcomG represented by a full line indicates a waveform diagram of the opposed electrode voltage feeding line 114 connected to an output terminal of the power supply circuit 105 illustrated in FIG. 1. Also, VcomH represented by a dashed line indicates a waveform diagram inside the liquid crystal panel 106.

In the embodiment illustrated in FIG. 28, concerning the generation of the voltage correction data, the above-described correction amount data generating circuit illustrated in FIG. 21 is employed. Also, regarding the generation of the correction time-period controlling signal 111 for controlling the time-period during which the correction is made to the opposed electrode voltage value within the one horizontal time-period in correspondence with the display data detected, the correction time-period controlling signal generating circuit illustrated in FIG. 22 is employed. Thus, herein-after, the explanation will be given mainly regarding the points that differ from those in the above-described embodiment.

First, in the opposed electrode voltage correcting circuit illustrated in FIG. 28, the voltage correction data transferred from the correction amount data generating circuit illustrated in FIG. 21 are inputted into the digital/analog converting circuits 1401, 1402. Then, the digital/analog converting circuits 1401, 1402 convert the inputted correction data into analog voltages, respectively. Consequently, the digital/analog converting circuits 1401, 1402 operate so that voltage levels of the analog voltages that they generate are increased/decreased in correspondence with the values of the correction data.

The analog voltage value generated by the digital/analog converting circuit 1401 is inputted into the analog voltage adding circuit 1410 together with the positive polarity opposed electrode reference voltage 1408 generated by the voltage-dividing resistors 1405, 1406, 1407. Then, an analog voltage resulting from the addition is inputted into the analog voltage selecting circuit 1414 together with the positive polarity opposed electrode reference voltage again.

Similarly, the analog voltage value generated by the digital/analog converting circuit 1402 is inputted into the analog voltage subtracting circuit 1411 together with the negative polarity opposed electrode reference voltage 1409 generated by the voltage-dividing resistors 1405, 1406, 1407. Then, an analog voltage resulting from the subtraction is inputted into the analog voltage selecting circuit 1415 together with the negative polarity opposed electrode reference voltage again.

Based on the control signal 111 generated by the correction time-period controlling signal generating circuit illustrated in FIG. 22 and included within the interface circuit, during a time-period Δt that, within the one horizontal time-period, ranges from a rising edge of the horizontal synchronization signal HSYNC to a rising edge of the control signal 111 varied in correspondence with the amount of the correction data, the analog voltage selecting circuit 1414 selects and outputs the output voltage from the analog voltage adding circuit 1410. Also, during the remainder of the one horizontal time-period, the analog voltage selecting circuit 1414 selects and outputs the positive polarity opposed electrode reference voltage.

Similarly, based on the control signal 111, during the time-period Δt that, within the one horizontal time-period, ranges from the rising edge of the horizontal synchronization signal HSYNC to the rising edge of the correction time-period controlling signal adjusted in correspondence with the amount of the correction data, the analog voltage selecting circuit 1415 selects and outputs the output voltage from the analog voltage subtracting circuit 1411. Also, during the remainder of the one horizontal time-period, the analog voltage selecting circuit 1415 selects and outputs the negative polarity opposed electrode reference voltage. The analog voltages outputted from the analog voltage selecting circuits 1414, 1415 are inputted into the analog voltage selecting circuit 1418 and are selected in accordance with the polarity of the liquid crystal-applying voltage alternating signal 109 "M", then being outputted to the opposed electrode voltage feeding line 114 through the electric current amplifying circuit 1420.

Here, in the case where there exist a large amount of the white display data, by using the display amount data 110 generated by the above-described correction amount data generating circuit illustrated in FIG. 21, the correction time-period controlling signal 111 outputted from the above-described correction time-period controlling signal generating circuit illustrated in FIG. 22, and the above-described opposed electrode voltage correcting circuit illustrated in FIG. 28, the following become possible: The opposed electrode voltage-correcting voltages ΔVcom 12, ΔVcom 22 and ΔVcom 32, which are adjusted in correspondence with the amount of the correction data in each horizontal time-period, are added to the positive polarity opposed electrode reference voltage and are outputted during time-periods Δt 11, Δt 21 and Δt 31 that are adjusted in correspondence with the amount of the correction data in each horizontal time-period. This procedure makes it possible to increase the voltage level as is the case with a voltage waveform of VcomG during the time-periods tH 3, tH 5 and tH 7 illustrated in FIG. 29.

Also, the opposed electrode voltage-correcting voltages ΔVcom 12, ΔVcom 22 and ΔVcom 32, which are adjusted in correspondence with the amount of the correction data in each horizontal time-period, are subtracted from the negative polarity opposed electrode reference voltage and are outputted during the time-periods Δt 11, Δt 21 and Δt 31 that are adjusted in correspondence with the amount of the correction data in each horizontal time-period. This procedure makes it possible to decrease the voltage level as is the case with a voltage waveform of VcomG during the time-periods tH 4, tH 6 and tH 8 that are also illustrated in FIG. 29.

As explained earlier, there exists the case where, originally, a large amount of the white display data exist and, as is the case with, for example, VcomB illustrated in FIG. 12, the opposed electrode voltage Vcom is increased/decreased by the amount of ΔVcom 1, ΔVcom 2 and ΔVcom 3 during the time-periods tH 3, tH 41 tH 5, tH 6, tH 7 and tH 8. Even in such a case, the opposed electrode voltage-correcting voltage ΔVcom that is adjusted in correspondence with the amount of the correction data is added/subtracted only during a time-period Δt that is also adjusted in correspondence with the amount of the correction data. This procedure makes it possible to stabilize the opposed electrode voltage inside the liquid crystal panel 106 as is the case with VcomH illustrated in FIG. 29. On account of this, the effective voltage value Vdrms applied to the liquid crystal 120 becomes constant. This, accordingly, makes it possible to reduce the picture quality deterioration that has occurred in the conventional liquid crystal display, thus allowing the display of high picture quality to be embodied.

Next, the explanation will be given below concerning the TFT liquid crystal display that employs a liquid crystal based on the transverse electric field system.

Figure 30:
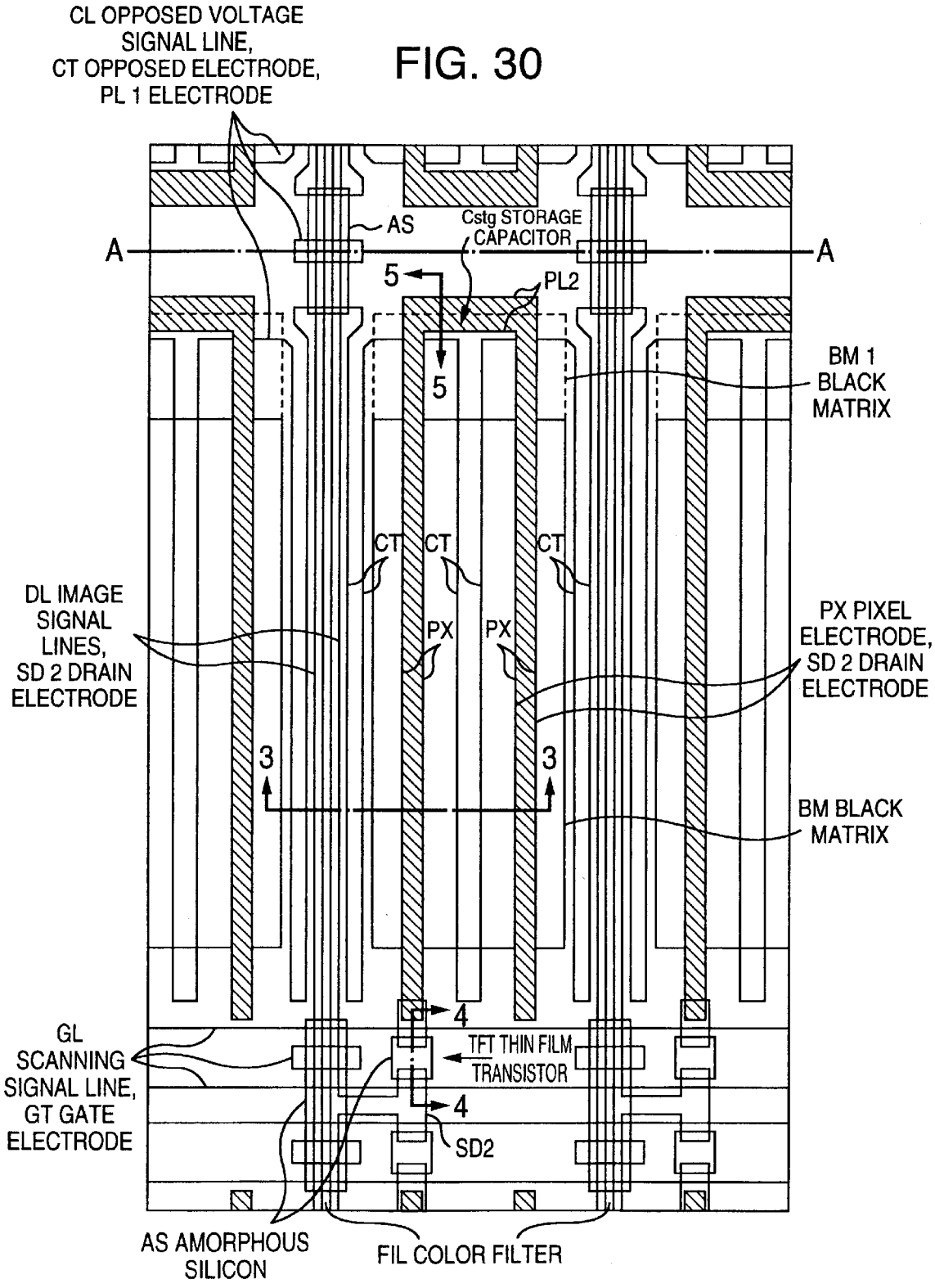
FIG. 30 is a plan view for illustrating one pixel and the periphery thereof of the liquid crystal display apparatus according to the present invention.

FIG. 30 is a plane view for illustrating one pixel and the periphery thereof of the active matrix type color liquid crystal display apparatus according to the present invention. As illustrated in FIG. 30, each pixel is located within an intersection region of the following four lines (i.e., within the region surrounded by the following four lines): A scanning signal line (gate signal line or horizontal signal line) GL, an opposed voltage signal line (opposed electrode interconnection) CL, and two adjacent image signal lines (drain signal lines or vertical signal lines) DL. Each pixel includes a thin film transistor TFT, a storage capacitor Cstg, a pixel electrode PX, and an opposed electrode CT. In the drawing, the scanning signal line GL and the opposed voltage signal line CL extend in the right-to-left direction, and a plurality of them are located in the up-and-down direction. The image signal line DL extends in the up-and-down direction, and a plurality of them are located in the right-to-left direction. The pixel electrode PX is connected to the thin film transistor TFT, and the opposed electrode CT is integrated with the opposed voltage signal line CL.

The pixel electrode PX and the opposed electrode CT are opposed to each other. An electric field between each pixel electrode PX and each opposed electrode CT controls an optical state of a liquid crystal LC, thereby controlling the display. The pixel electrodes PX and the opposed electrodes CT are configured in a comb-tooth manner, and each of them is an electrode that is long and narrow in the up-and-down direction in the drawing.

Figure 31:
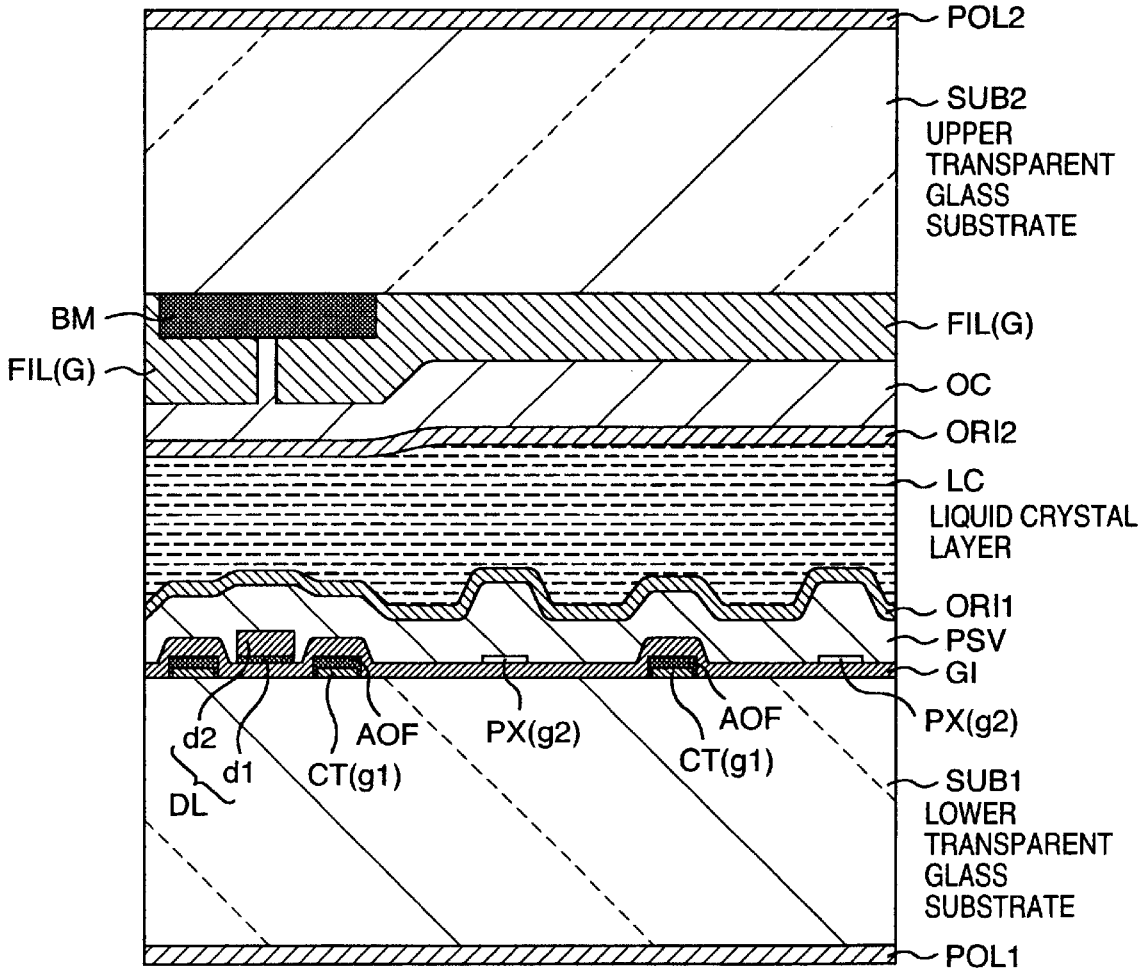
FIG. 31 is a diagram for illustrating the cross section taken on a 3—3 cutting line in FIG. 30.
Figure 32:
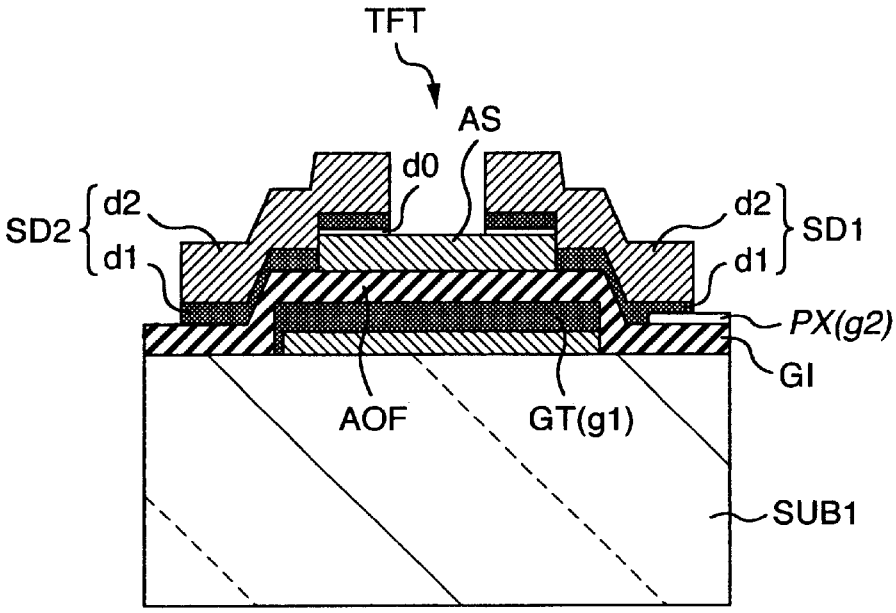
FIG. 32 is a cross sectional view of a thin film transistor TFT taken on a 4—4 cutting line in FIG. 30.
Figure 33:
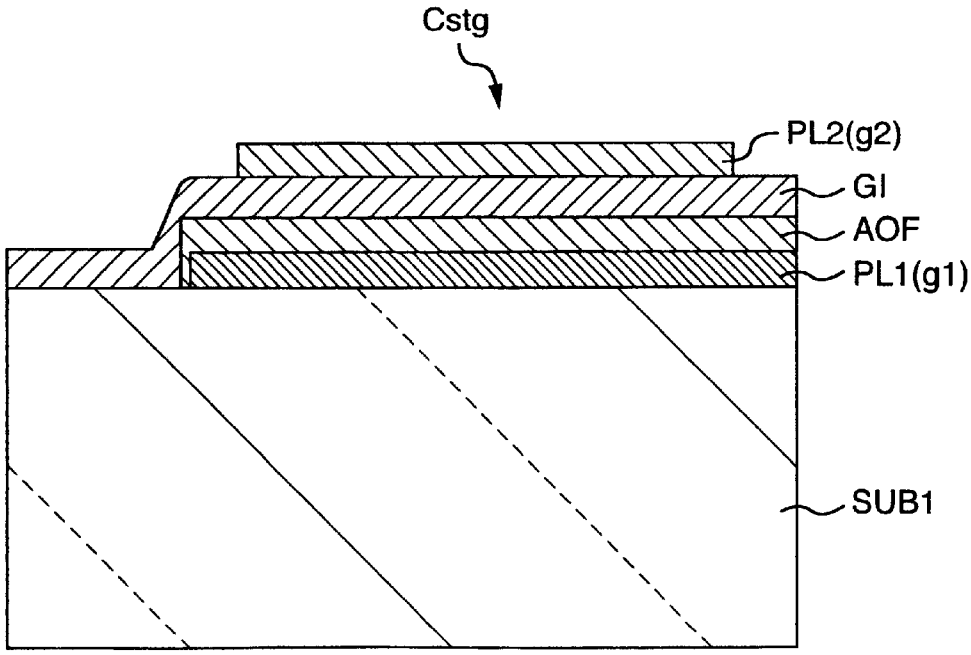
FIG. 33 is a diagram for illustrating a cross section of a storage capacitor Cstg taken on a 5—5 cutting line in FIG. 30.

FIG. 31 is a diagram for illustrating the cross section taken on a 3—3 cutting line in FIG. 30. FIG. 32 is a cross sectional view of the thin film transistor TFT taken on a 4—4 cutting line in FIG. 30. FIG. 33 is a diagram for illustrating a cross section of the storage capacitor Cstg taken on a 5—5 cutting line in FIG. 30. As illustrated in FIGS. 31 to 33, on the side of a lower transparent glass substrate SUB1 with reference to the liquid crystal layer LC, there are formed the thin film transistor TFT, the storage capacitor Cstg and the group of electrodes. Moreover, on the side of an upper transparent glass substrate SUB2, there are formed a color filter FIL and a shielding black matrix pattern BM.

Also, on surfaces of the respective inner side (i.e., on the side of the liquid crystal layer LC) of the transparent glass substrates SUB1, SUB2, there are provided orientation films ORI 1, ORI 2 for controlling an initial orientation of the liquid crystal. In addition, on surfaces of the respective outer side of the transparent glass substrates SUB1, SUB2, there are provided sheet polarizers that are positioned in such a manner that the polarization axes of which are perpendicular to each other (cross Nicol positioning).

The structures illustrated in FIGS. 31 to 33 permits the display to be embodied in the following way: The liquid crystal is operated by an electric field that is substantially parallel to the surface of the substrate between two electrodes configured on the identical substrate, and thus incident light launched into the liquid crystal from a clearance between the two electrodes is modulated so as to embody the display.

Next, a diagram is presented that illustrates the structure of a TFT liquid crystal display panel module to which the present invention is to be applied.

Figure 34:
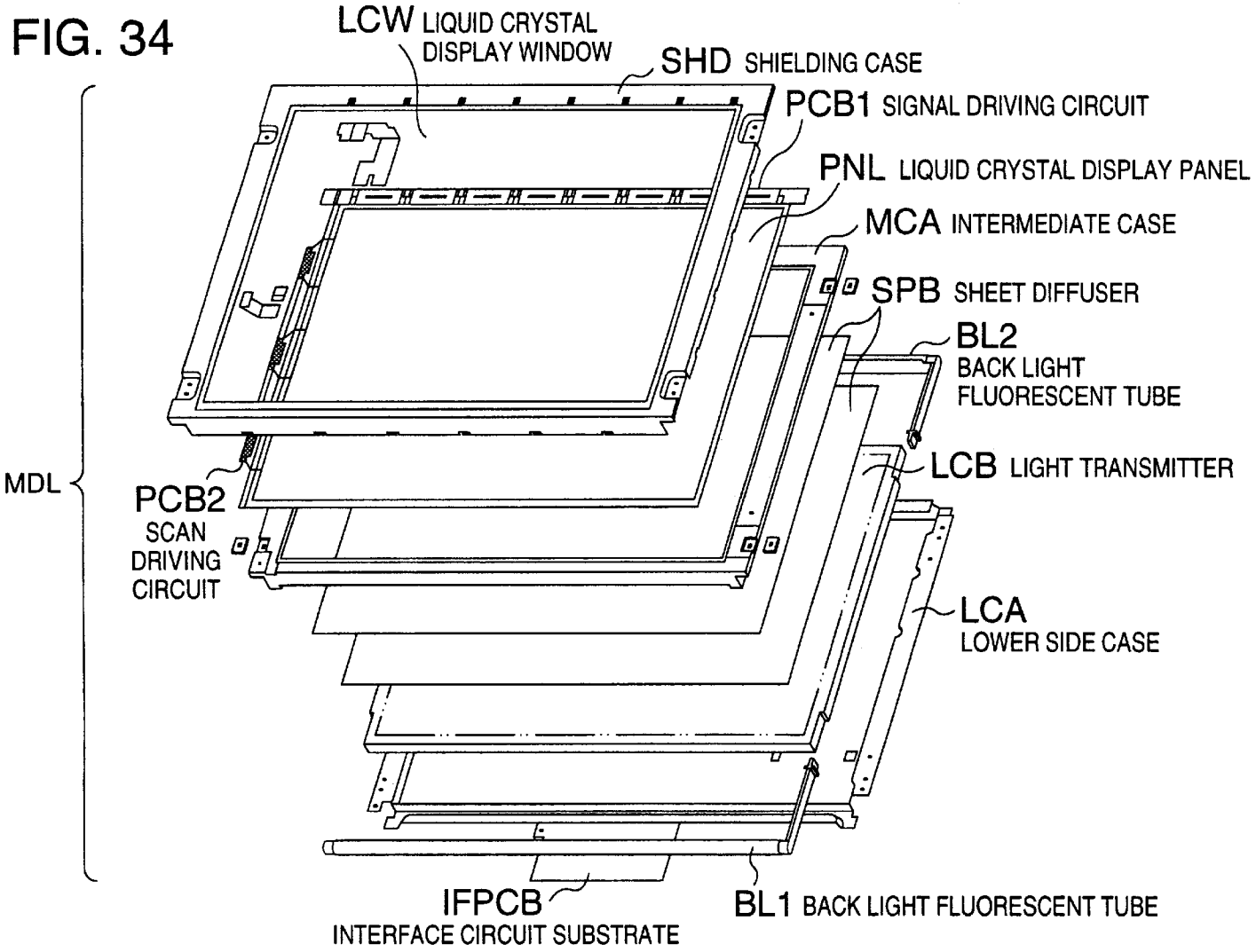
FIG. 34 is an exploded perspective view for illustrating the respective configuration components of a liquid crystal display module MDL according to the present invention.

FIG. 34 is an exploded perspective view for illustrating the respective configuration components of the liquid crystal display module MDL. In the drawing, reference notations each denote the following components: SHD a frame-shaped shielding case (metal frame) composed of a metal, LCW a liquid crystal display window, PNL a liquid crystal display panel, PCB 1 a signal driving circuit, PCB 2 a scan driving circuit, MCA an intermediate case, SPB a sheet diffuser, LCB a light transmitter, BL 1, BL 2 back light fluorescent tubes, LCA a back light case, IFPCB an interface circuit substrate. The respective configuration components are accumulated in the up-and-down positioning relationship illustrated in the drawing, thereby fabricating the module MDL.

Nails and hooks provided on the shielding case SHD play a role of fixing the whole of the module MDL. The back light case LCA has a configuration that is capable of housing the back light fluorescent tubes BL, the sheet diffuser SPB and the light transmitter LCB. Light is emitted from the back light fluorescent tubes BL located on the side surface of the light transmitter LCB. Then, the light is converted into a uniform back light on the display surface by the light transmitter LCB, a sheet reflector RM and the sheet diffuser SPB, then being emitted out onto the side of the liquid crystal display panel PNL. Furthermore, the interface circuit 102 and the power supply circuit 105, which are embodied according to the present invention and illustrated in FIG. 1, are mounted on the IFPCB.

Figure 35:
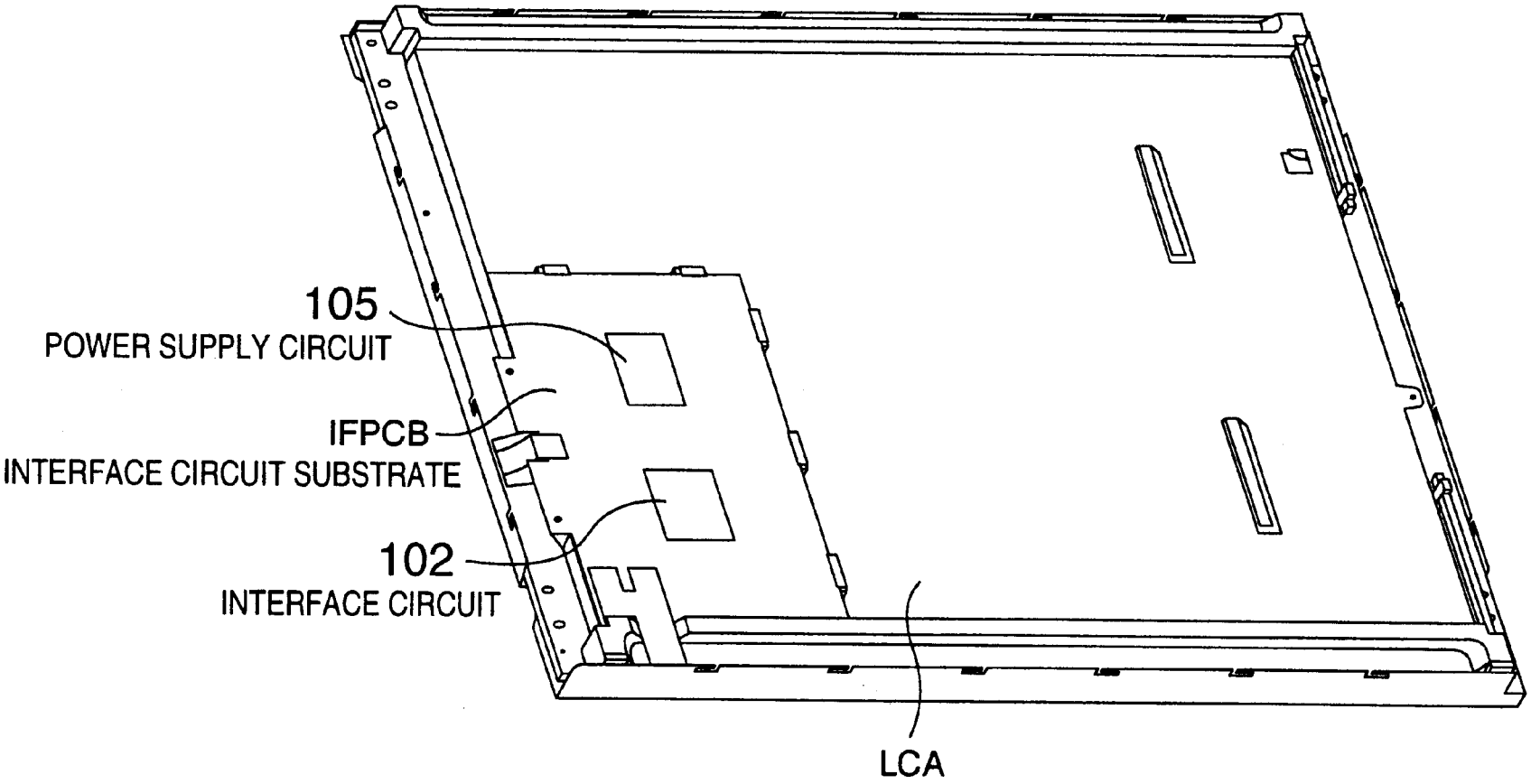
FIG. 35 is a diagram obtained when the liquid crystal display module MDL according to the present invention is viewed from the rear side.

FIG. 35 illustrates an example of the manner at the time when the liquid crystal display module MDL is viewed from the rear side.

In this way, it turns out that the interface circuit 102 and the power supply circuit 105, which are embodied according to the present invention and illustrated in FIG. 1, are mounted on the IFPCB.

The above-described embodiments exhibit the following effects: According to the embodiments in the present invention, when the opposed electrode voltage is transitioned to the positive polarity (higher electric potential) opposed electrode voltage, the upwardly convex correcting voltage is applied. This procedure makes it possible to transition the voltage level of the opposed electrode voltage inside the liquid crystal panel to the normal voltage level within a predetermined time. Also, when the opposed electrode voltage is transitioned to the negative polarity (lower electric potential) opposed electrode voltage, the upwardly convex correcting voltage is applied. This procedure causes the source voltage to be transitioned to the drain voltage level at a high speed, thereby making it possible to transition the voltage level of the opposed electrode voltage inside the liquid crystal panel to the normal voltage level within a predetermined time. Accordingly, it becomes possible to stabilize, without depending on the display data, the effective voltage value to be applied to the liquid crystal. This results in an effect of making it possible to embody the display of high picture quality even if a signal driving circuit designed for the low voltage driving is employed.

Also, it is possible to easily set the time-period during which the correcting voltage is applied, thereby allowing the time-period to be set as variable. Consequently, it becomes possible to easily make the embodiment compatible for a liquid crystal panel having a different load. This brings about an effect of allowing the display of high picture quality to be embodied on liquid crystal panels of various types of specifications.

Also, according to the embodiments in the present invention, by varying a value of the resistance for pulling in the current in the feedback system including the buffer amplifier, it becomes possible to easily vary the level of the correcting voltage for the opposed electrode voltage. Consequently, it becomes possible to easily make the embodiment compatible for the liquid crystal panel having a different load. This brings about the effect of allowing the display of high picture quality to be embodied on the liquid crystal panels of various types of specifications.

According to one mode in the present invention, an amount of the data to be displayed is detected, and a time-period during which a fixed opposed electrode voltage-correcting voltage is added/subtracted to/from the opposed electrode reference voltage is adjusted in correspondence with the detected amount of the display data within the range of the one horizontal time-period. This procedure permits the opposed electrode voltage to be corrected depending on the amount of the display data, thus maintaining constant the effective voltage value applied to the liquid crystal. This results in the effect of making it possible to embody the display of high picture quality even if the signal driving circuit designed for the low voltage driving is employed.

Also, according to another mode in the present invention, an amount of the display data is detected, and an opposed electrode voltage-correcting voltage corresponding to the amount of the display data is added/subtracted to/from the opposed electrode reference voltage during a certain constant time-period. This procedure permits the level of the opposed electrode voltage to be corrected depending on the amount of the display data, thus maintaining constant the effective voltage value applied to the liquid crystal. This results in an effect of making it possible to embody the display of high picture quality even if a signal driving circuit designed for the low voltage driving is employed.

Also, according to a still another mode in the present invention, an amount of the display data is detected, and a time-period is adjusted during which an opposed electrode voltage-correcting voltage corresponding to the amount of the display data is added/subtracted to/from the opposed electrode reference voltage in correspondence with the amount of the display data within the range of the one horizontal time-period. This procedure permits the opposed electrode voltage to be corrected depending on the amount of the display data, thus maintaining constant the effective voltage value applied to the liquid crystal. This results in an effect of making it possible to embody the display of high picture quality even if a signal driving circuit designed for the low voltage driving is employed.

Also, in the modes according to the present invention, it is possible to adjust a time-period during which the opposed electrode voltage-correcting voltage is added/subtracted to/from the opposed electrode reference voltage, depending on the amount of the display data within the range of the one horizontal time-period. This procedure permits the effective voltage value applied to the liquid crystal to be maintained constant regardless of the variation in length of the one horizontal time-period caused by the increase/decrease in the total number of the scanning lines in the liquid crystal panel. This results in the effect of making it possible to embody the display of high picture quality even if the signal driving circuit designed for the low voltage driving is employed.

Also, in the modes according to the present invention, the signal driving circuit designed for the low voltage driving is employed. This condition brings about an effect of making it possible to accomplish the lowering in the power consumption.

Also, in the modes according to the present invention, it becomes possible to employ the signal driving circuit designed for the low voltage driving. This condition allows the signal driving circuit to be configured through a low-cost and general-purpose LSI process, thereby bringing about an effect of making it possible to accomplish the cost lowering of the whole of the liquid crystal panel.

Also, the embodiments according to the present invention make it possible to employ the signal driving circuit designed for the low voltage driving. This condition allows the signal driving circuit to be configured through the low-cost and general-purpose LSI process, thereby bringing about an effect of making it possible to configure the whole of the liquid crystal panel at a low cost.

Also, the embodiments according to the present invention make it possible to configure the signal driving circuit through the low-cost and general-purpose LSI process. Moreover, it is possible to greatly downsize the chip on which the signal driving circuit is to be fabricated. This condition brings about an effect of making it possible to narrow the frame of the liquid crystal display.

The embodiments according to the present invention bring about the effect of making it possible to embody the display of high picture quality even if the signal driving circuit designed for the low voltage driving is employed.

What is claimed is:

1. A liquid crystal display apparatus comprising:

a liquid crystal panel having M units of pixels in a horizontal direction and N units of pixels in a vertical direction, each of the pixels including a switching element and a liquid crystal;

a signal driving circuit for inputting display data and generating a tone voltage corresponding to the inputted display data so as to apply the tone voltage to one group of the pixels arranged in the horizontal direction and corresponding to the display data;

a scan driving circuit for selecting, in sequence, any one group of the pixels arranged in the horizontal direction, the scan driving circuit applying a selection voltage to the selected one group of the pixels arranged in the horizontal direction and applying a non-selection voltage to the unselected other groups of the pixels arranged in the horizontal direction, the liquid crystal having, at one end thereof, an opposed electrode that is common to the respective pixels, the tone voltage generated by the signal driving circuit, when the selection voltage outputted by the scan driving circuit is applied to the switching element in each of the pixels, being applied to the liquid crystal through the opposed electrode so as to control a display luminance by an effective voltage value of the tone voltage toward the opposed electrode;

a circuit for generating an alternating signal and a correction time-period signal, the alternating signal indicating alternating of an opposed electrode voltage applied to the opposed electrode, the correction time-period signal indicating a time period during which a correcting voltage is combined with the opposed electrode voltage applied to the opposed electrode; and an opposed electrode voltage generating circuit that, in accordance with the alternating signal and the correction time-period signal and with respect to the alternated opposed electrode voltage applied to the opposed electrode, adds an upwardly convex correcting voltage to the alternated opposed electrode voltage when the alternated opposed electrode voltage is a positive polarity voltage and subtracts the upwardly convex correcting voltage from the alternated opposed electrode voltage when the alternated opposed electrode voltage is a negative polarity voltage.

2. A liquid crystal display apparatus as claimed in claim 1, wherein the circuit for generating the alternating signal and the correction time-period signal generates the correction time-period signal by comparing a counted value that a counter outputs by counting one horizontal time period with a set value indicating the correction time period, the correction time-period signal indicating the time period during which the correcting voltage is combined with the opposed electrode voltage applied to the opposed electrode.

3. A liquid crystal display apparatus as claimed in claim 1, wherein, when the correction time-period signal is effective, the opposed electrode voltage generating circuit shifts the alternated opposed electrode voltage up to an electric potential voltage level that is higher than a voltage level of a normal standby opposed electrode voltage, the opposed electrode voltage generating circuit, in accordance with the alternating signal and the correction time-period signal and with respect to the alternated opposed electrode voltage applied to the opposed electrode, adding the upwardly convex correcting voltage to the alternated opposed electrode voltage when the alternated opposed electrode voltage the positive polarity voltage and subtracting the upwardly convex correcting voltage from the alternated opposed electrode voltage when the alternated opposed electrode voltage is the negative polarity voltage.

4. A liquid crystal display apparatus as claimed in claim 1, wherein the correction time period becomes effective in the first half of one horizontal time period, and thus the correcting voltage is combined with the opposed electrode voltage applied to the opposed electrode in the first half of one horizontal time period.

5. A liquid crystal display apparatus as claimed in claim 2, wherein a setting circuit for indicating the correction time period permits the time period during which the correcting voltage is combined with the opposed electrode voltage applied to the opposed electrode to be set as variable, depending on characteristics of the liquid crystal panel.

6. A liquid crystal display apparatus as claimed in claim 3, wherein the opposed electrode voltage generating circuit include a correcting voltage generating circuit; and wherein the correcting voltage generating circuit includes a feedback circuit using a buffer circuit for amplifying the alternating signal and a resistor, the feedback circuit including a switching circuit and the resistor, and, in a state where the correction time-period signal is effective, the correcting voltage generating circuit causes the switching circuit to be operated so as to control a quantity of an electric current in the feedback circuit, thereby applying the correcting voltage.

7. A liquid crystal display apparatus as claimed in claim 2, wherein the correction time period that the correction signal indicates differs between the case of the positive polarity opposed electrode voltage and the case of the negative polarity opposed electrode voltage positioned at a lower electric potential than the positive polarity opposed electrode voltage.

8. A liquid crystal display apparatus as claimed in claim 3, wherein a correcting voltage level at which the correcting voltage is positioned differs between the time when the correcting voltage is combined with the positive polarity opposed electrode voltage and the time when the correcting voltage is combined with the negative polarity opposed electrode voltage.

9. A liquid crystal display apparatus as claimed in claim 1, wherein during the time period within which the alternating signal has been applied, the opposed electrode voltage generating circuit, if the opposed electrode voltage is the positive polarity voltage, adds the correcting voltage thereto so that a value of the opposed electrode voltage becomes larger toward the positive polarity side, and, if the opposed electrode voltage exhibits the negative polarity, subtracts the correcting voltage therefrom so that a value of the opposed electrode voltage on the negative polarity side becomes smaller.

10. A liquid crystal display circuit comprising:

a liquid crystal panel having M units of pixels in a horizontal direction and N units of pixels in a vertical direction, each of the pixels including a switching element and a liquid crystal;

a signal driving circuit for inputting display data and generating a tone voltage corresponding to the inputted display data so as to apply the tone voltage to one group of the pixels arranged in the horizontal direction and corresponding to the display data;

a scan driving circuit for selecting, in sequence, any one group of the pixels arranged in the horizontal direction, the scan driving circuit applying a selection voltage to the selected one group of the pixels arranged in the horizontal direction and applying a non-selection voltage to the unselected other groups of the pixels arranged in the horizontal direction, the liquid crystal having, at one end thereof, an opposed electrode that is common to the respective pixels, the tone voltage generated by the signal driving circuit, when the selection voltage outputted by the scan driving circuit is applied to the switching element in each of the pixels, being applied to the liquid crystal through the opposed electrode so as to control a display luminance by an effective voltage value of the tone voltage toward the opposed electrode;

a circuit for generating a correction time-period signal for indicating a time period during which a correcting voltage is combined with an opposed electrode voltage applied to the opposed electrode; and an opposed electrode voltage generating circuit that, during the time period within which an alternating signal has been applied, adds the correcting voltage if the opposed electrode voltage is a positive polarity voltage so that a value of the opposed electrode voltage becomes larger toward the positive polarity side, and subtracts the correcting voltage if the opposed electrode voltage is a negative polarity voltage so that a value of the opposed electrode voltage on the negative polarity side becomes smaller.

11. A liquid crystal display apparatus comprising:

a liquid crystal panel having M units of pixels in a horizontal direction and N units of pixels in a vertical direction, each of the pixels including a switching element and a liquid crystal;

a signal driving circuit for inputting display data and generating a tone voltage corresponding to the inputted display data so as to apply the tone voltage to one group of the pixels arranged in the horizontal direction and corresponding to the display data;

a scan driving circuit for selecting, in sequence, any one group of the pixels arranged in the horizontal direction, the scan driving circuit applying a selection voltage to the selected one group of the pixels arranged in the horizontal direction and applying a non-selection voltage to the unselected other groups of the pixels arranged in the horizontal direction, the liquid crystal having, at one end thereof, an opposed electrode that is common to the respective pixels, the tone voltage generated by the signal driving circuit, when the selection voltage outputted by the scan driving circuit is applied to the switching element in each of the pixels, being applied to the liquid crystal through the opposed electrode so as to control a display luminance by an effective voltage value of the tone voltage toward the opposed electrode;

a display data amount detecting circuit for detecting a display data amount of the inputted display data; and a voltage correcting circuit for correcting, in correspondence with the detected display data amount for each horizontal time period, an opposed electrode voltage by adding a positive correcting voltage to the opposed electrode voltage when the opposed electrode voltage has a positive polarity, and by adding a positive correcting voltage to the opposed electrode voltage when the opposed electrode voltage has a negative polarity.

12. A liquid crystal display apparatus as claimed in claim 11, wherein the voltage correcting circuit includes:

a circuit for generating a correction time-period controlling signal for controlling a time period during which the opposed electrode voltage is corrected in correspondence with the detected display data amount for each horizontal time period; and a circuit for performing an addition control or a subtraction control of a predetermined correcting voltage over the opposed electrode voltage in accordance with the generated correction time-period controlling signal during only a time period corresponding to the detected display data amount within a corresponding horizontal time period.

13. A liquid crystal display apparatus as claimed in claim 11, wherein the voltage correcting circuit includes:

a circuit for generating a correction time-period controlling signal for correcting the opposed electrode voltage during only a predetermined fixed time period within each horizontal time period; and a circuit for performing an addition control or a subtraction control of a correcting voltage corresponding to the detected display data amount over the opposed electrode voltage in accordance with the generated correction time-period controlling signal during only the predetermined fixed time period within each horizontal time period.

14. A liquid crystal display apparatus as claimed in claim 11, wherein the voltage correcting circuit includes:

a circuit for generating a correction time-period controlling signal for controlling a time period during which the opposed electrode voltage is corrected in correspondence with the detected display data for each horizontal time period; and a circuit for performing an addition control or a subtraction control of a correcting voltage corresponding to the detected display data amount over the opposed electrode voltage during only a time period corresponding to the generated correction time-period controlling signal.

15. A liquid crystal display apparatus as claimed in claim 11, wherein the voltage correcting circuit corrects, in correspondence with the detected display data amount for each horizontal time period, a length of a time period during which the voltage correcting circuit corrects the opposed electrode voltage.

16. A method of driving a liquid crystal display apparatus, the liquid crystal display apparatus including a liquid crystal panel having M units of pixels in a horizontal direction and N units of pixels in a vertical direction, each of the pixels including a switching element and a liquid crystal, a signal driving circuit for inputting display data and generating a tone voltage corresponding to the inputted display data so as to apply the tone voltage to one group of the pixels arranged in the horizontal direction and corresponding to the display data, and a scan driving circuit for selecting, in sequence, any one group of the pixels arranged in the horizontal direction, the scan driving circuit applying a selection voltage to the selected one group of the pixels arranged in the horizontal direction and applying a non-selection voltage to the unselected other groups of the pixels arranged in the horizontal direction, the liquid crystal having, at one end thereof, an opposed electrode that is common to the respective pixels, the tone voltage generated by the signal driving circuit, when the selection voltage outputted by the scan driving circuit is applied to the switching element in each of the pixels, being applied to the liquid crystal through the opposed electrode so as to control a display luminance by an effective voltage value of the tone voltage toward the opposed electrode, the method comprising the steps of:

detecting a display data amount of the inputted display data; and correcting, in correspondence with the detected display data amount for each horizontal time period, an opposed electrode voltage by adding a positive correcting voltage to the opposed electrode voltage when the opposed electrode voltage has a positive polarity, and by adding a positive correcting voltage to the opposed electrode voltage when the opposed electrode voltage has a negative polarity.

17. A method of driving a liquid crystal display apparatus as claimed in claim 16, wherein the correcting step includes the step of correcting, in correspondence with the detected display data amount for each horizontal time period, a length of a time period during which the opposed electrode voltage is corrected.

18. A liquid crystal display apparatus comprising:

a liquid crystal panel having M units of pixels in a horizontal direction and N units of pixels in a vertical direction, each of the pixels including a switching element and a liquid crystal;

a signal driving circuit for inputting display data and generating a tone voltage corresponding to the inputted display data so as to apply the tone voltage to one group of the pixels arranged in the horizontal direction and corresponding to the display data;

a scan driving circuit for selecting, in sequence, any one group of the pixels arranged in the horizontal direction, the scan driving circuit applying a selection voltage to the selected one group of the pixels arranged in the horizontal direction and applying a non-selection voltage to the unselected other groups of the pixels arranged in the horizontal direction, the liquid crystal having, at one end thereof, an opposed electrode that is common to the respective pixels, the tone voltage generated by the signal driving circuit, when the selection voltage outputted by the scan driving circuit is applied to the switching element in each of the pixels, being applied to the liquid crystal through the opposed electrode so as to control a display luminance by an effective voltage value of the tone voltage toward the opposed electrode;

a display data amount detecting circuit for detecting a display data amount of the inputted display data; and a voltage correcting circuit for correcting, in correspondence with the detected display data amount for each horizontal time period, both an opposed electrode voltage and a length of a time period during which the voltage correcting circuit corrects the opposed electrode voltage.

19. A method of driving a liquid crystal display apparatus, the liquid crystal display apparatus including a liquid crystal panel having M units of pixels in a horizontal direction and N units of pixels in a vertical direction, each of the pixels including a switching element and a liquid crystal, a signal driving circuit for inputting display data and generating a tone voltage corresponding to the inputted display data so as to apply the tone voltage to one group of the pixels arranged in the horizontal direction and corresponding to the display data, and a scan driving circuit for selecting, in sequence, any one group of the pixels arranged in the horizontal direction, the scan driving circuit applying a selection voltage to the selected one group of the pixels arranged in the horizontal direction and applying a non-selection voltage to the unselected other groups of the pixels arranged in the horizontal direction, the liquid crystal having, at one end thereof, an opposed electrode that is common to the respective pixels, the tone voltage generated by the signal driving circuit, when the selection voltage outputted by the scan driving circuit is applied to the switching element in each of the pixels, being applied to the liquid crystal through the opposed electrode so as to control a display luminance by an effective voltage value of the tone voltage toward the opposed electrode, the method comprising the steps of:

detecting a display data amount of the inputted display data; and correcting, in correspondence with the detected display data amount for each horizontal time period, both an opposed electrode voltage and a length of a time period during which the opposed electrode voltage is corrected.

* * * * *